US007122300B2

(12) United States Patent
Yoshioka

(10) Patent No.: US 7,122,300 B2
(45) Date of Patent: Oct. 17, 2006

(54) PHOTOTHERMOGRAPHIC MATERIAL

(75) Inventor: Yasuhiro Yoshioka, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 11/075,444

(22) Filed: Mar. 9, 2005

(65) Prior Publication Data

US 2005/0202357 A1 Sep. 15, 2005

(30) Foreign Application Priority Data

Mar. 12, 2004 (JP) ..... 2004-071310

(51) Int. Cl.
*G03C 1/00* (2006.01)

(52) U.S. Cl. ..... 430/619; 430/617; 430/618; 430/620

(58) Field of Classification Search ..... 430/617, 430/618, 619, 620
See application file for complete search history.

(56) References Cited

U.S. PATENT DOCUMENTS

2004/0101794 A1* 5/2004 Usagawa et al. ..... 430/619

FOREIGN PATENT DOCUMENTS

JP A 11-352624 12/1999

* cited by examiner

*Primary Examiner*—Geraldine Letscher
(74) *Attorney, Agent, or Firm*—Margaret A. Burke; Sheldon J. Moss

(57) ABSTRACT

A photothermographic material comprising a support, and an image-forming layer and a non-photosensitive layer provided on a surface of the support, wherein the image-forming layer and the non-photosensitive layer are adjacent to each other; the image-forming layer includes a photosensitive silver halide, a first non-photosensitive organic silver salt, a first reducing agent, a polyhalogen compound and a binder; and the non-photosensitive layer includes a second non-photosensitive organic silver salt.

20 Claims, No Drawings

PHOTOTHERMOGRAPHIC MATERIAL

CROSS-REFERENCE TO RELATED APPLICATIONS

This application claims priority under 35 USC 119 from Japanese patent document No. 2004-071310, the disclosure of which is incorporated by reference herein.

BACKGROUND OF THE PRESENT INVENTION

Field of the Invention

Reduction of waste solutions to be treated has been strongly desired in recent years in the medical field from the viewpoints of environmental protection and space saving. Under such circumstances, technologies on photosensitive photothermographic photographic materials for medical diagnosis and photography which can be exposed to light efficiently with a laser image setter or a laser imager, and can form a clear black image having high resolution and sharpness have been demanded. With these photosensitive photothermographic photographic materials, it is possible to supply to customers a heat development treatment system which has eliminated the necessity of using solvent system processing chemicals, and is simpler and does not impair the environment.

The similar requirements also exist in the field of general image forming materials. However, the image for medical use is required to have a high image quality excellent in sharpness and graininess, because fine details of the image are required. In addition, the medical image is characterized by preferably exhibiting a blue black image tone from the viewpoint of ease of medical diagnosis. Currently, various hard copy systems utilizing pigments or dyes such as inkjet printers and apparatuses for electrophotography are prevailing as general image forming systems. However, there is no system which is satisfactory as a medical image-output system.

A thermal image formation system utilizing an organic silver salt is described in a large number of documents. In particular, the photothermographic material generally has an image forming layer in which a catalytically active amount of a photocatalyst (e.g., silver halide), a reducing agent, a reducible silver salt (e.g., organic silver salt), and, if required, a toning agent for controlling the color tone of silver are dispersed in a binder matrix. The photothermographic materials are, after being imagewise exposed, heated to a high temperature (for example, to 80° C. or higher) to form black silver images through the oxidation-reduction reaction between the silver halide or the reducible silver salt (which functions as an oxidizing agent) and the reducing agent therein. The oxidation-reduction reaction is accelerated by the catalytic action of the latent image of the silver halide generated through exposure. For this reason, the black silver images are formed in the exposed areas. Fuji Medical Dry Imager FM-DP L has been distributed as a medical image formation system using a photothermographic material.

In the photothermographic material art, silver content of photothermographic materials is drawing considerable attention from manufacturers. Photothermographic materials capable of forming a high density image with a low silver content save on the amount of silver conventionally required to maintain a given optical density, and reduce the amount of the emulsion necessary for coating, which subsequently reduce the loads on coating and drying processes thus enhancing productivity. Further, reduction of the amount of silver reduces the manufacturing cost of photothermographic materials. However, it is extremely difficult to reduce the amount of the silver and, at the same time, maintain or enhance the photographic performance. Hence, an effective technique for improving the above-mentioned aspects is desired.

As a solution to this problem, a "silver-saving agent" disclosed in JP-A Nos. 2002-6443 and 2002-131864 has been proposed. Addition of the silver-saving agent has resulted in reducing the amount of the silver used and improving the image density.

However, the silver-saving agent comprises a hydrazine derivative compound or the like and structurally also has a function of a nucleating agent. Specifically, addition of the nucleating agent results in reduced storage stability, which causes a problem of fogging and deterioration of printout quality. In addition, when the nucleating agent is used, a latent image grows is size around a material serving as a nucleus and a black-silver image is formed, and hence image graininess tends to deteriorate.

On the other hand, a photosensitive material obtained by incorporating a non-photosensitive organic silver salt into a non-photosensitive layer is proposed by Japanese Patent Application Laid-Open (JP-A) No. 11-352624 among others. However, this technique is aimed at improving storage stability in long-term storage, and the non-photosensitive layer does not form images. As a result, this technique does not have any effect on improving the image quality.

It has been extremely difficult to improve image density while improving image graininess, and an inventive technique to do so has not been yet proposed. Thus there is a need in the art for a photothermographic material with improved image density that also enables a fine-grained image.

SUMMARY OF THE INVENTION

In view of the above circumstances, the present inventors have developed a photothermographic material as follows.

A first embodiment of the present invention is a photothermographic material comprising a support and an image-forming layer formed on a surface of a support, the image-forming layer containing a photosensitive silver halide, a non-photosensitive organic silver salt, a reducing agent, a polyhalogen compound and a binder, wherein a non-photosensitive layer is provided adjacent to the image-forming layer and the non-photosensitive layer contains a non-photosensitive organic silver salt.

DESCRIPTION OF THE PRESENT INVENTION

The inventors have conducted intensive research and, as a result, have succeeded in improving graininess and in increasing image density of the photothermographic material by an arrangement in which a non-photosensitive layer is provided separately from an image-forming layer, the non-photosensitive layer contains an organic silver salt, and silver from the organic silver salt serving as a silver source for the non-photosensitive layer is supplied to a part where the exposure is large. In particular, the present inventors have found that it is advantageous to provide the non-photosensitive layer adjacent to the image-forming layer from the viewpoint of supplying silver. The non-photosensitive layer which is adjacent to the image-forming layer and which includes an organic silver salt is occasionally referred to as "a non-photosensitive layer S", hereinafter.

In the invention, for the first time, the part where the exposure is large was designed so that it was subjected to an image formation using the organic silver salt of the non-photosensitive layer S. As such, with two or more layers, the invention has partitioned the functions corresponding to each of the layers. According to the photothermographic material of the invention having the above-mentioned constitution, in a part where the exposure is small, it is difficult for fogging to occur, and an image can be depicted that faithfully corresponds to the exposure amount while being sensitive to slight variations therein, and in the part where the exposure is large, it clearly forms black images having high density.

The present inventors have conducted further studies and, as a result, have found that in a photothermographic material containing an organic silver salt in a non-photosensitive layer S, by adding a substance which is easy to nucleate to the non-photosensitive layer S and a substance which is difficult to nucleate to the image-forming layer, the effects of the invention are enhanced. Examples of the substance which is easy to nucleate include a nucleating agent and a reducing agent having a specific structure (a reducing agent represented by formula (I) of the invention). It has been found that, if the organic silver salt used is limited to fatty acid silver salts, it is possible to control nucleation even by adjusting the content of silver behenate in the fatty acid silver salt. When the nucleating agent is used, the image graininess is liable to deteriorate because a silver image greatly expands around developed silver which forms a nucleus. However, in the part where the exposure is large, it is unlikely to cause problems in graininess. Therefore, the photothermographic material of the invention forms images having extremely excellent graininess, unlike a case where a nucleating agent is used in a single layer.

The invention is characterized in that the non-photosensitive organic silver salt is contained in the non-photosensitive layer S, which is "adjacent" to the image-forming layer. If the non-photosensitive layer S forms images (in the case where the nucleating agent and the reducing agent are added, or the like), sharpness and graininess are good when the image-forming layer and the non-photosensitive layer S are located as close as possible to each other. In addition, when the non-photosensitive layer S is provided adjacent to the image-forming layer, several substances in the image-forming layer become capable of being transferred between the image-forming layer and the non-photosensitive layer S. Therefore, it is supposed that even if images are not formed in the non-photosensitive layer S, from the perspective of substance transferral, the non-photosensitive layer S greatly influences graininess. In consideration of the transfer of substances, it is preferable to use a binder for the non-photosensitive layer S and a binder for the image-forming layer, which both have similar properties to each other.

The photothermographic material of the invention is characterized in that it comprises a support and an image-forming layer formed on a surface of a support, the image-forming layer containing a photosensitive silver halide, a non-photosensitive organic silver salt, a reducing agent, a polyhalogen compound and a binder, wherein a non-photosensitive layer S is provided adjacent to the image-forming layer and the non-photosensitive layer S contains a non-photosensitive organic silver salt.

The image-forming layer of the invention contains a photosensitive silver halide, a non-photosensitive organic silver salt, a reducing agent, a polyhalogen compound and a binder. In addition to these, various additives can be added thereto.

The non-photosensitive layer S of the invention is provided adjacent to the image-forming layer and contains at least a non-photosensitive organic silver salt. Specifically, the non-photosensitive layer S does not contain a photosensitive silver halide, but contains an organic silver salt and forms a silver image around the organic silver salt. In particular, it is preferred that the non-photosensitive layer S has a constitution which allows easy nucleation. Such a constitution is achieved by (1) using a reducing agent represented by formula (I), and by (2) using a combination of the reducing agent and a nucleating agent. The organic silver salt may be the same as or different from that added to the image-forming layer. When a different organic silver salt is used, it is preferred that an organic silver salt that is an fatty acid silver salt is used and the non-photosensitive layer S is prepared so as to have the content of silver behenate in the fatty acid silver salt lower than that of silver behenate in the image-forming layer. Other various additives can be added to the non-photosensitive layer S, and preferably a polyhalogen compound and a development accelerator may be further added thereto.

First, the constitution of the layers of the photothermographic material of the invention, and then the components of each of the layers will be explained.

1. Constitution of Layer

The photothermographic material of the invention comprises an image-forming layer and a non-photosensitive layer S adjacent to the image-forming layer. According to the invention, the non-photosensitive layer S contains a non-photosensitive organic silver salt.

Generally, non-photosensitive layers can be classified, based on the configuration thereof, as (a) a surface protecting layer formed on the image-forming layer (a side farthest from a support), (b) intermediate layers provided between plural image-forming layers and between an image-forming layer and a surface protecting layer, (c) an undercoating layer provided between an image-forming layer and a support, and (d) a back layer formed on the side of the support opposite to an image-forming layer.

In the invention, a layer adjacent to an image forming layer is preferably a non-photosensitive layer S containing a non-photosensitive organic silver salt. Although the non-photosensitive layer S is not photosensitive, it can form an image.

Further, in the invention, non-photosensitive layers can include a second surface protecting layer (a), an intermediate layer (b), an undercoating layer (c) and a back layer (d). These layers may be each independently a single layer or plural layers.

In addition, a layer serving as an optical filter is also provided, which is provided as the layer of (a) or (b) of the non-photosensitive layer. An antihalation layer is provided in the photosensitive layer as the layer of (c) or (d).

The photothermographic material of the invention may be a single-sided photothermographic material having an image-forming layer only on one side of the support or a double-sided photothermographic material having image-forming layers on both sides of the support. In the case of a double-sided photothermographic material, at least one side of the support has a non-photosensitive layer S containing an organic silver.

When the photothermographic material of the invention is used as a multicolor photothermographic material, the material may comprise an arbitrary combination of two or more layers for each color or comprise a single layer including all the components as described in U.S. Pat. No. 4,708,928, the disclosure of which is incorporated by reference herein. When a plurality of dyes are used in the multicolor photothermographic material, the respective emulsion layers are separated from each other generally by functional or non-functional barrier layers provided between the respective photosensitive layers as described in U.S. Pat. No. 4,460,681, the disclosure of which is incorporated by reference herein.

(1) Single-sided Photothermographic Material

As for the single-sided type, the back layer is preferably provided on the side (which is hereinafter referred to as a back side) of the support opposite to the side having the image forming layer.

The single-sided photothermographic material in the invention can be used as a mammographic X-ray sensitive material. It is important that the single-sided photothermographic material to be used for the object be designed so as to provide an image with a contrast within a proper range.

As for the preferred constituent features as the mammographic X-ray sensitive material, JP-A-5-45807, JP-A-10-62881, JP-A-10-54900, and JP-A-11-109564 can serve as references, the disclosures of which are incorporated by reference herein.

(2) Double Sided Type Photothermographic Material

The photothermographic material of the invention can be preferably used for an image formation method for recording an X-ray image using an X-ray intensifying screen.

The process of forming an image using the photothermographic material includes the following steps:

(a) a step of setting the photothermographic material between a pair of X-ray intensifying screens, and thereby obtaining an assembly for image formation;

(b) a step of arranging a specimen between the assembly and an X ray source;

(c) a step of irradiating the specimen with an X ray having an energy level within a range of 25 kVp to 125 kVp;

(d) a step of taking out the photothermographic material from the assembly; and (e) a step of heating the photothermographic material taken at a temperature within a range of 90° C. or more to 180° C. or less.

The photothermographic material for use in the assembly in the invention is preferably such a photothermographic material as to provide, when subjected to stepwise exposure with an X ray and heat development, an image having a characteristic curve satisfying the following conditions on a plane defined by rectangular coordinates. The rectangular coordinates are a coordinates representing exposure amount (logE) and a coordinate representing optical density (D), and unit length of the coordinates are the same. On the characteristic curve, the mean gamma (γ) between a point corresponding to (the minimum density (Dmin)+0.1) and a point corresponding to (the minimum density (Dmin)+0.5) is 0.5 to 0.9, and the mean gamma (γ) between a point corresponding to (the minimum density (Dmin)+1.2) and a point corresponding to (the minimum density (Dmin)+1.6) is 3.2 to 4.0. Use of the photothermographic material for X ray photographing systems having such a characteristic curve can achieve an X-ray image having excellent photographic properties such as a very elongated leg and high gamma in the medium density region. Such advantageous photographic properties result in superior descriptive property of low density areas such as the mediastinum portion or the shadow of the heart whose transmittance to X-rays is low, easy-to-view density of the image of the lung field whose transmittance to X-rays is high, and favorable contrast.

The photothermographic material having the foregoing preferred characteristic curve can be manufactured with ease in the following manner. For example, each of the image forming layers on opposite sides is composed of two or more silver halide emulsion layers having mutually different sensitivities. Particularly, each image forming layer is preferably formed by using a high sensitivity emulsion for the upper layer, and using an emulsion having a low sensitivity and hard photographic properties for the lower layer. When such an image forming layer comprised of two layers is used, the ratio of the sensitivity of the layer having a higher sensitivity to the sensitivity of the layer having a lower sensitivity is in the range of 1.5 to 20, preferably in the range of 2 to 15. The ratio between the amounts of emulsions for forming the respective layers varies according to the difference in sensitivity between the emulsions to be used and the covering power. In general, the larger the sensitivity difference is, the lower the ratio of the emulsion with a higher sensitivity. For example, when the sensitivity of a first emulsion is twice as high as the sensitivity of a second emulsion and their covering powers are approximately the same, the ratio of the silver amount in the first emulsion to the silver amount in the second emulsion is preferably in the range of 1/50 to 1/20.

For the techniques of crossover cut (double-sided photosensitive material) and antihalation (single-sided photosensitive material), the dyes or the combination of dyes and mordants described in JP-A No. 2-68539, line 1 in the lower left column, page 13, to line 9 in the lower left column, page 14 (the disclosure of which is incorporated by reference herein) may be used.

Then, the fluorescent intensifying paper (radiation intensifying screen) of the invention will be described. The radiation intensifying screen is composed, as a basic structure, of a support and a phosphor layer formed on one side thereof. The phosphor layer is a layer containing a phosphor dispersed in a binder. A transparent protective layer is generally provided on the surface of the phosphor layer opposite to the support (the surface on the side not facing the support) to protect the phosphor layer from chemical change in quality and physical impact.

In the invention, as preferred phosphors, mention may be made of the following ones: tungstate type phosphors ($CaWO_4$, $MgWO_4$, $CaWO_4$: Pb, and the like), terbium-activated rare earth element oxysulfide type phosphors ($Y_2O_2S$:Tb, $Gd_2O_2S$:Tb, $La_2O_2S$:Tb, $(Y,Gd)_2O_2S$:Tb, $(Y,Gd)O_2S$:Tb, Tm, and the like), terbium-activated rare earth element phosphate type phosphors ($YPO_4$:Tb, $GdPO_4$:Tb, $LaPO_4$:Tb, and the like) terbium-activated rare earth element oxyhalide type phosphors (LaOBr:Tb, LaOBr:Tb, Tm, LaOCl:Tb, LaOCl:Tb, Tm, LaOBr:Tb, GdOBr:Tb, GdOCl:Tb, and the like), thulium-activated rare earth element oxyhalide type phosphors (LaOBr:Tm, LaOCl:Tm, and the like), a barium sulfate type phosphors ($BaSO_4$:Pb, $BaSO_4$:$Eu^{2+}$, (Ba, Sr)$SO_4$:$Eu^{2+}$, and the like), bivalent europium-activated alkaline earth metal phosphate type phosphors ($(Ba_2PO_4)_2$:$Eu^{2+}$, $(Ba_2PO_4)_2$:$Eu^{2+}$, and the like), bivalent europium-activated alkaline earth metal fluorohalide type phosphors (BaFCl:$Eu^{2+}$, BaFBr:$Eu^{2+}$, BaFCl:$Eu^{2+}$, Tb, BaFBr:$Eu^{2+}$, Tb, $BaF_2$.BaCl.KCl:$Eu^{2+}$, (Ba, Mg)$F_2$.BaCl.KCl:$Eu^{2+}$, and the like), iodide type phosphors (CsI:Na, CsI:Tl, NaI, KI:Tl, and the like), sulfide type phosphors (ZnS:Ag, (Zn, Cd) S:Ag, (Zn, Cd)S:Cu, (Zn, Cd)S:Cu, Al, and the like), hafnium phosphate type phosphors ($HfP_2O_7$:Cu, and the like), and $YTaO_4$, and the ones obtained by adding various activators thereto as luminescent centers. However, the phosphors for use in the invention are not limited thereto, and any phosphors are usable so long as they are the phosphors showing light emission in the visible or near-ultraviolet region through irradiation with a radiation.

The fluorescent intensifying paper for use in the invention is preferably filled with a phosphor in a gradient particle diameter structure. In particular, preferably, large-diameter phosphor particles are applied on the surface protective layer side, and small-diameter phosphor particles are applied on the support side. Preferably, the diameter of the small-diameter particle is in the range of 0.5 μm to 2.0 μm, and the diameter of the large-diameter particle is in the range of 10 μm to 30 μm.

As an image formation method using the photothermographic material of the invention, a method for forming an image by the combination with a phosphor having a main peak at 400 nm or less may be preferably used. A method for forming an image by the combination with a phosphor having a main peak at 380 nm or less is further preferably used. Either of the double-sided photosensitive material and the single-sided photosensitive material may be used in the form of an assembly. As the screen having a main light emission peak at 400 nm or less, the screens described in JP-A No. 6-11804 and WO 93/01521 (the disclosures of which are incorporated herein by reference), and the like may be used, but usable screens are not limited thereto. As the techniques of ultraviolet crossover cut (double-sided photosensitive material) and antihalation (single-sided photosensitive material), the techniques described in JP-A No. 8-76307 are usable, the disclosure of which is incorporated herein by reference. The ultraviolet absorbing dye is particularly preferably selected from the dyes described in JP-A No. 2001-144030, the disclosure of which is incorporated by reference.

2. Components of Each Layer (Organic silver salt)

1) Composition

The non-photosensitive organic silver salt used in the invention is an organic silver salt which is relatively stable to light and which supplies a silver ion when heated to 80° C. or higher under the presence of the exposed photosensitive silver halide and the reducing agent, to form a silver image. The organic silver salt may be any organic substance that can be reduced by the reducing agent to provide a silver ion. Such non-photosensitive organic silver salts are described in JP-A No. 10-62899, Paragraph 0048 to 0049, EP-A No. 0803764A1, Page 18, Line 24 to Page 19, Line 37, EP-A No. 0962812A1, JP-A Nos. 11-349591, 2000-7683, and 2000-72711, etc. The disclosures of the above patent documents are incorporated herein by reference. The organic silver salt is preferably a silver salt of an organic acid, particularly preferably a silver salt of a long-chain aliphatic carboxylic acid having 10 to 30 carbon atoms, preferably having 15 to 28 carbon atoms. Examples of the fatty acid silver salts include silver lignocerate, silver behenate, silver arachidate, silver stearate, silver oleate, silver laurate, silver caproate, silver myristate, silver palmitate, silver erucate, and mixtures thereof. In the invention, the proportion of the amount of silver behenate to the total amount of the organic silver sal is preferably 50 to 100 mol %, more preferably 85 to 100 mol %, further preferably 90 to 100 mol %.

Further, the ratio of the amount of silver erucate to the total amount of the organic silver salts is preferably 2 mol % or less, more preferably 1 mol % or less, further preferably 0.1 mol % or less.

Further, the ratio of the amount of silver stearate to the total amount of the organic silver salts is preferably 1 mol % or lower so as to obtain a photothermographic material with a low Dmin, high sensitivity, and excellent image storability. The ratio of the amount of silver stearate to the total amount of the organic silver salts is more preferably 0.5 mol % or lower. In a preferable embodiment, the organic silver salts includes substantially no silver stearate.

When the organic silver salts include silver arachidate, the ratio of the amount of silver arachidate to the total amount of the organic silver salts is preferably 6 mol % or lower from the viewpoint of achieving a low Dmin and excellent image storability. The ratio of the amount of silver arachidate to the total amount of the organic silver salts is more preferably 3 mol % or lower.

The organic silver salt contained in the image-forming layer may be the same as or different from the organic silver salt contained in the non-photosensitive layer S. In a preferable embodiment, the organic silver salts contained in each of the image-forming layer and the non-photosensitive layer S is an fatty acid silver salt and the silver salt in the non-photosensitive layer S has a lower silver behenate content than that of the silver salt in the image-forming layer. If the silver behenate content of the fatty acid silver salt is high, it is difficult to supply silver because of increased crystallinity and a heightened melting point. On the contrary, if the silver behenate content of the fatty acid silver salt is low, it is easy to supply silver because of poor crystallinity and a lower melting point.

The silver behenate content of the fatty acid silver salt contained in the non-photosensitive layer S is preferably from 40 mol % to 100 mol %, more preferably from 55 mol % to 96 mol %, and still more preferably from 70 mol % to 90 mol %. The silver behenate content of the fatty acid silver salt contained in the image-forming layer is preferably from 55 mol % to 100 mol %, more preferably from 85 mol % to 99 mol %, and still more preferably from 90 mol % to 98 mol %.

2) Shape

The shape of organic silver salt usable in the image-forming layer and the non-photosensitive layer S according to the invention is not particularly restricted. The organic silver salt grains may be in a needle shape, a rod shape, a tabular shape, or a flaky shape.

In the invention, the organic silver salt grains are preferably in a flaky shape. Further, it is also preferable to use organic silver salt grains in a short needle-shape, a rectangular shape, a cubic shape, or a potato-like shape, wherein each shape has a ratio of the longer axis to the shorter axis of lower than 5. Such organic silver salt grains cause less fogging which develops on the resultant photothermographic material in the heat development than long needle-shaped grains having a length ratio of the longer axis to the shorter axis of 5 or higher. The ratio of the longer axis to the shorter axis is more preferably 3 or lower, since the mechanical stability of the coating film is improved when organic silver salt grains having such a shape are used.

In the invention, organic silver salt grains in a flaky shape are defined as follows. Organic silver salt grains are observed by an electron microscope, and the shape of each grain is approximated by a rectangular parallelepiped shape. The lengths of the three sides of the rectangular parallelepiped shape are respectively represented by a, b, and c in the ascending order (wherein c and b may be the same values), and a value x is calculated from the smaller values a and b using the following equation: x=b/a. The values x of approximately 200 grains are calculated in the above-described manner to obtain an average x (the average of the values x). The organic silver salt grains in a flaky shape are defined as grains with an average x of 1.5 or larger. The average x is preferably 1.5 to 30, more preferably 1.5 to 15. In contrast, the organic silver salt grains in a needle-shape are defined as grains with an average x of 1 or larger but smaller than 1.5.

In the flaky grains (grains in a flaky shape), the length a may be considered as the thickness of a tabular grain having a main plane defined by the sides with the lengths b and c. The average of the lengths a of the grains is preferably 0.01 to 0.3 μm, more preferably 0.1 to 0.23 μm. The average of values c/b of the grains is preferably 1 to 9, more preferably 1 to 6, furthermore preferably 1 to 4, most preferably 1 to 3.

When the equivalent sphere diameters of the organic silver salt grains are 0.05 to 1 μm, the grains hardly aggregate in the photosensitive material, resulting in excellent image storability. The equivalent sphere diameter is preferably 0.1 to 1 μm. In the invention, the equivalent sphere diameter is measured by: directly photographing a sample using an electron microscope, and then image-processing the negative.

The aspect ratio of the flaky grain is defined as the value of the equivalent sphere diameter/a. The aspect ratio of the flaky grain is preferably 1.1 to 30, more preferably 1.1 to 15, so as to prevent the aggregation of the grains in the photosensitive material, thereby improving the image storability.

The grain size distribution of the organic silver salt grains is preferably monodisperse distribution. In the monodisperse distribution, the percentage obtained by dividing the standard deviation of the length of the longer axis by the length of the longer axis and the percentage obtained by dividing the standard deviation of the length of the shorter axis by the length of the shorter axis are preferably 100% or lower, more preferably 80% or less, further preferably 50% or less. In order to observe the shape of the organic silver salt grain, a transmission electron microscope may be used to give a micrograph of the organic silver salt dispersion. Alternatively, the monodisperse distribution may be evaluated based on the standard deviation of the volume-weighted average diameter of the organic silver salt grains, and the percentage (the variation coefficient) obtained by dividing the standard deviation by the volume-weighted average diameter is preferably 100% or lower, more preferably 80% or lower, further preferably 50% or lower. For example, the grain size (the volume-weighted average diameter) may be measured by: dispersing the organic silver salt grains in a liquid, and exposing the dispersion to a laser light and obtaining the autocorrelation function of fluctuation of the scattering light to time.

3) Preparation

The organic silver salt grains may be prepared and dispersed by known methods described, for example, in JP-A No. 10-62899, EP-A Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868, the disclosures of which are incorporated herein by reference.

When the organic silver salt grains are dispersed in the presence of a photosensitive silver salt, the fogging is intensified and the sensitivity is remarkably reduced. Thus, in a preferable embodiment, substantially no photosensitive silver salts are present when the organic silver salt grains are dispersed. In the invention, the amount of photosensitive silver salts in the aqueous dispersion liquid of the organic silver salt is preferably 1 mol % or less, more preferably 0.1 mol % or less, per 1 mol of the organic silver salt. It is more preferable not to add photosensitive silver salts to the dispersion liquid actively.

In an embodiment, the photosensitive material is prepared by processes comprising mixing an aqueous organic silver salt dispersion liquid with an aqueous photosensitive silver salt dispersion liquid. The mixing ratio between the organic silver salt and the photosensitive silver salt may be selected depending on the use of the photosensitive material. The mole ratio of the photosensitive silver salt to the organic silver salt is preferably 1 to 30 mol %, more preferably 2 to 20 mol %, particularly preferably 3 to 15 mol %. It is preferable to mix two or more aqueous organic silver salt dispersion liquids and two or more aqueous photosensitive silver salt dispersion liquids so as to adjust the photographic properties.

4) Amount

The amount of the organic silver salt may be selected without particular restrictions, and the total amount of the applied silver (including the photosensitive silver halide) is preferably 0.1 $g/m^2$ to 3.0, more preferably 0.3 $g/m^2$ to 2.0 $g/m^2$, furthermore preferably 0.5 $g/m^2$ to 1.8 $g/m^2$. In order to improve the image storability, the total amount of the applied silver is preferably 1.5 $g/m^2$ or less, more preferably 1.3 $g/m^2$ or less. In the invention, when a reducing agent preferred in the invention is used, sufficient image density can be achieved even with such a small amount of silver.

In the invention, the photothermographic material comprises two or more layers including organic silver salt(s). There is no particular limitation to the amount of organic silver salt contained in each layer. The ratio of the amount of organic silver salt in the image-forming layer to the amount of organic silver salt in the non-photosensitive layer S is preferably from 90:10 to 40:60, more preferably 80:20 to 60:40.

(Description of Reducing Agent)

The photothermographic material of the invention contains a reducing agent. The reducing agent is contained preferably in the image-forming layer and in the non-photosensitive layer S.

The reducing agent contained in the image-forming layer is not particularly limited and may be any substance (preferably an organic substance) capable of reducing silver ions to metallic silver. Preferably, such a reducing agent is a compound represented by formula (R) described below.

The reducing agent contained in the non-photosensitive layer S is not particularly limited either and may be any substance (preferably an organic substance) capable of reducing silver ions to metallic silver. In particular, such a constitution of the non-photosensitive layer S is preferable as to generate nuclei easily. Such a configuration is achieved by using (1) a reducing agent represented by formula (I) or (2) a combination of a reducing agent and a nucleating agent.

In the following, the reducing agent is described in more detail.

(1) Reducing Agent of Non-photosensitive Layer S

1) When a Reducing Agent Represented by Formula (I) is Used

It is considered that the reducing agent represented by formula (I) is a compound having a nucleating activity. It is presumed that when a reducing agent represented by formula (I) is added to the non-photosensitive layer S, the non-photosensitive organic silver salt contained in the non-photosensitive layer S reacts with the reducing agent to form a nucleus in an area where exposure is large, to form an image. A polyhalogen compound and a development accelerator have influence on the reaction. In the non-photosensitive layer S, an amount of polyhalogen compound is preferably small and an amount of development accelerator is preferably large, compared with the photosensitive layer.

Formula (I)

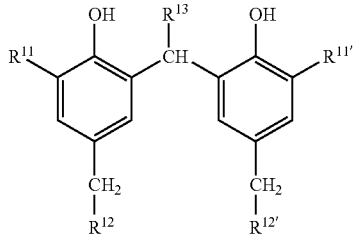

In formula (I), $R^{11}$ and $R^{11'}$ each independently represent a secondary or tertiary alkyl group having 3 to 20 carbon atoms; $R^{12}$ and $R^{12'}$ each independently represent a hydrogen atom, or a group in which the atom bonded to the $CH_2$ group on the ring is selected from the group consisting of a nitrogen atom, an oxygen atom, a phosphorus atom and a sulfur atom; and $R^{13}$ represents a hydrogen atom or an alkyl group having 1 to 20 carbon atoms.

In the following, formula (I) is described in detail. $R^{11}$ and $R^{11'}$ are each preferably a secondary or tertiary alkyl group having 3 to 12 carbon atoms. Specific examples thereof include an isopropyl group, a t-butyl group, a tert-amyl group, a 1,1-dimethylpropyl group, a 1,1-dimethylbutyl group, a 1,1-dimethylhexyl group, a 1,1,3,3-tetramethylbutyl group, a 1,1-dimethyldecyl group, a 1-methylcyclohexyl group, a tert-octyl group and a 1-methylcyclopropyl group. $R^{11}$ and $R^{11'}$ are each preferably a t-butyl group, a tert-amyl group, a tert-octyl group or a 1-methylcyclohexyl group, more preferably a t-butyl group.

$R^{12}$ and $R^{12'}$ are each preferably a hydrogen atom, a hydroxy group, an alkoxy group, an aryloxy group, an amino group or an anilino group, more preferably a hydrogen atom, a methoxy group or a benzyloxy group, particularly preferably a hydrogen atom.

When any of $R^{12}$ and $R^{12'}$ is an aryloxy group, an arylthio group, an anilino group, a heterocyclic group, or a heterocyclylthio group, the group may have a substituent. The substituent may be any substituent as long as the substituent can be bonded to a benzene ring or a heterocycle. Examples of the substituent include an alkyl group, an aryl group, a heterocyclic group, a halogen atom, an alkoxy group, a hydroxy group, an aryloxy group, an alkylthio group, an arylthio group, an amino group, an acyl group, an acyloxy group, an acylamino group, an alkoxycarbonyl group, a carbamoyl group, a sulfonyl group, a sulfonamido group, a sulfonyloxy group, a sulfamoyl group, a sulfoxide group, an ureido group and an urethane group. When any of $R^{12}$ and $R^{12'}$ is an alkoxy group, a carbonyloxy group, an acyloxy group, an alkylthio group, an amino group, an acylamino group, an ureido group, or an urethane group, the group may further have a substituent. Examples of the substituent include an alkoxy group, an alkoxycarbonyl group, an acyloxy group, a sulfonyl group, a carbonyl group, an alkylthio group, an aryloxy group, an arylthio group, a sulfonamido group, and an acylamino group.

$R^{13}$ is preferably a hydrogen atom or an alkyl group having 1 to 15 carbon atoms, more preferably an alkyl group having 1 to 8 carbon atoms. The alkyl group is preferably methyl, ethyl, propyl, isopropyl, or 2,4,4-trimethylpentyl. $R^{13}$ is particularly preferably a hydrogen atom, a methyl group, an ethyl group, a propyl group or an isopropyl group.

In the following, specific examples of reducing agents represented by formula (I) in the invention are explained, but the invention is not limited thereto.

R1-1

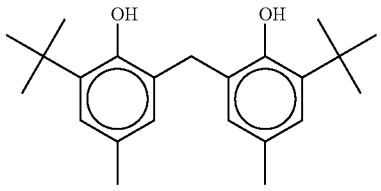

R1-2

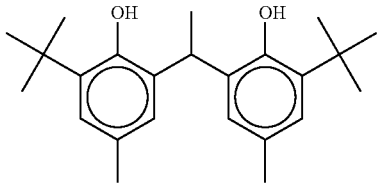

R1-3

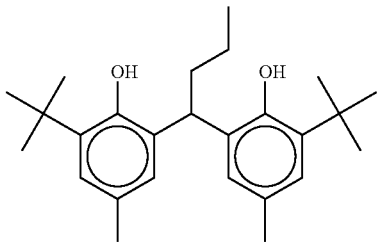

R1-4

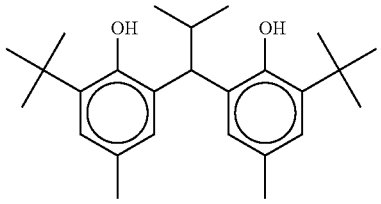

R1-5

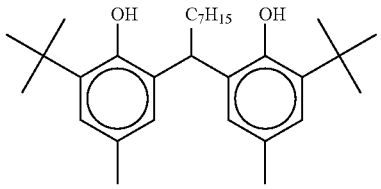

R1-6

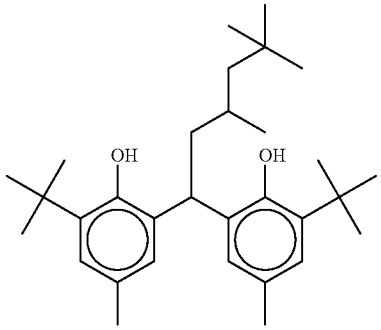

-continued
R1-7
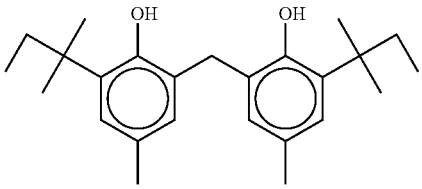
R1-8
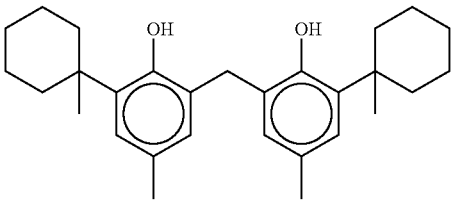
R1-9
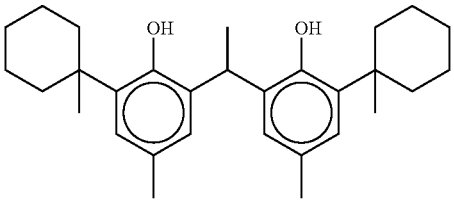
R1-10
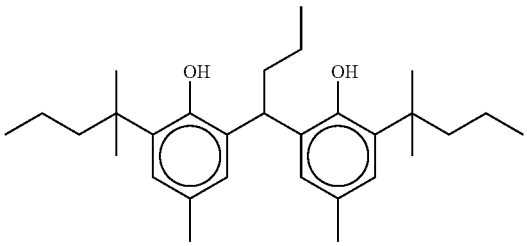
R1-11
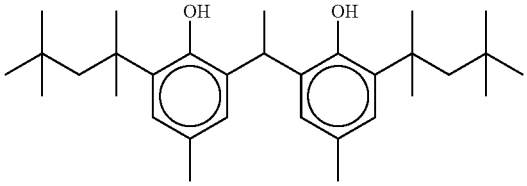
R1-12
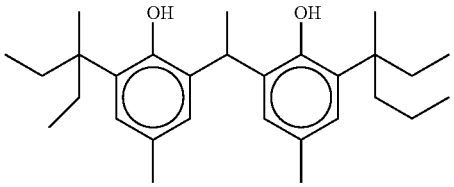
R1-13
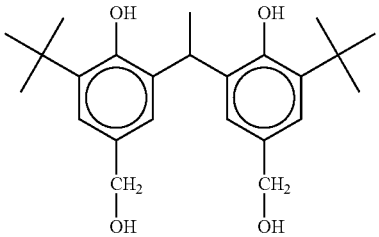
-continued
R1-14
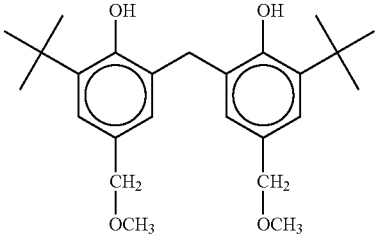
R1-15
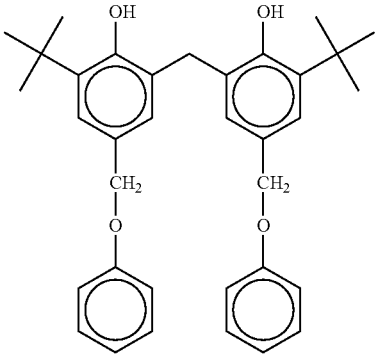
R1-16
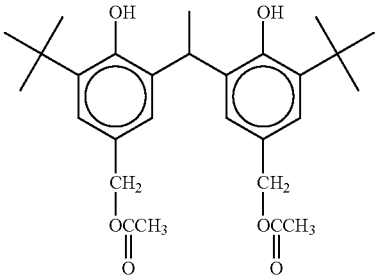
R1-17
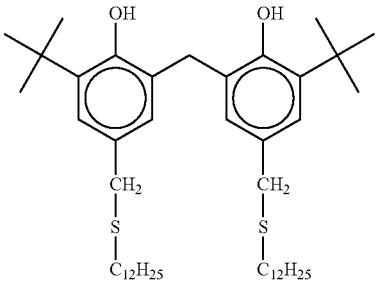
R1-18
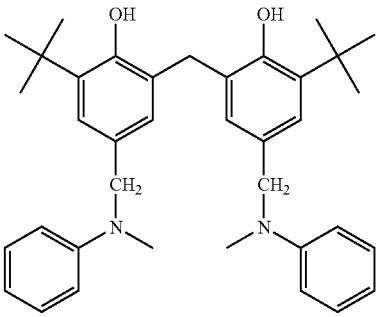

-continued
R1-19
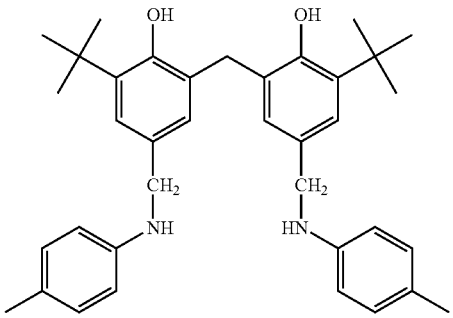
R1-20
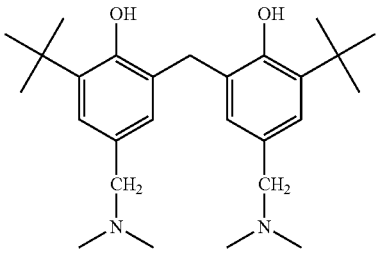
R1-21
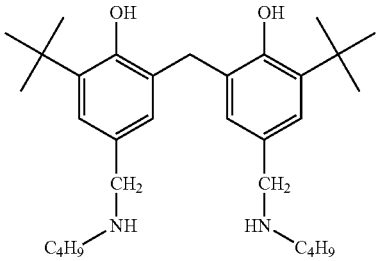
R1-22
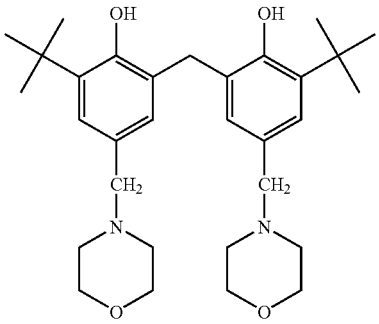
R1-23
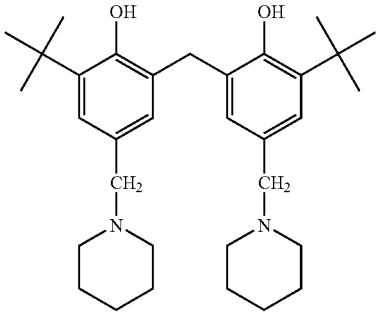
-continued
R1-24
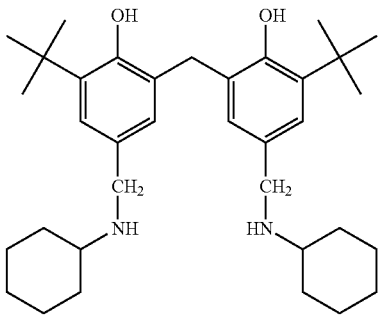
R1-25
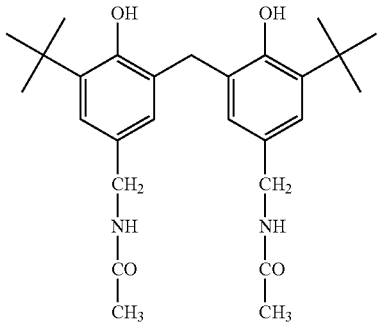
R1-26
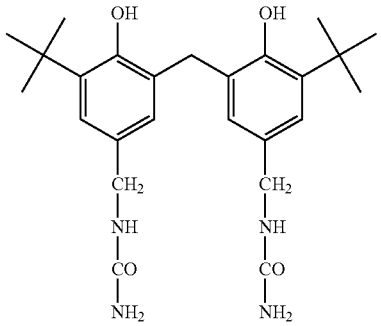
R1-27
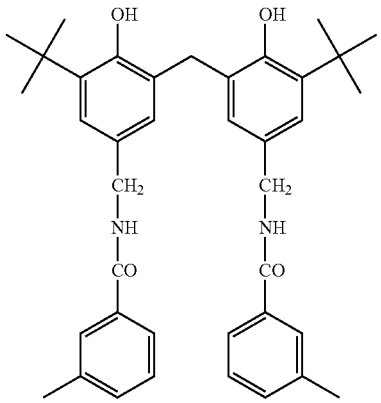

-continued
R1-28
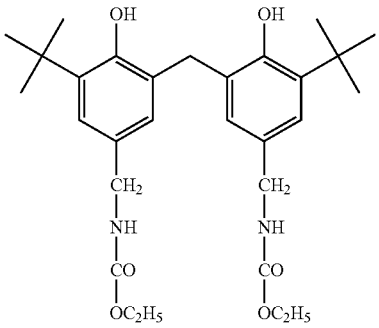
R1-29
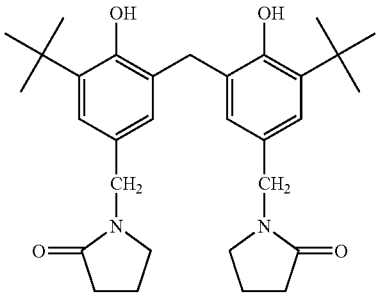
R1-30
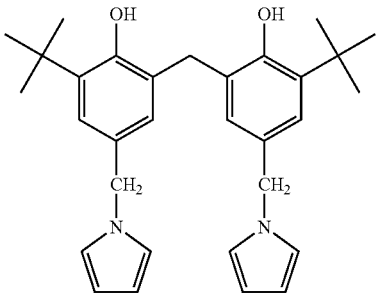
R1-31
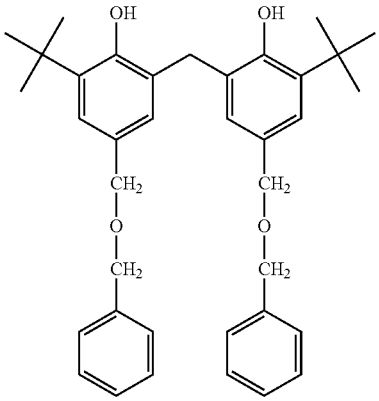
-continued
R1-32
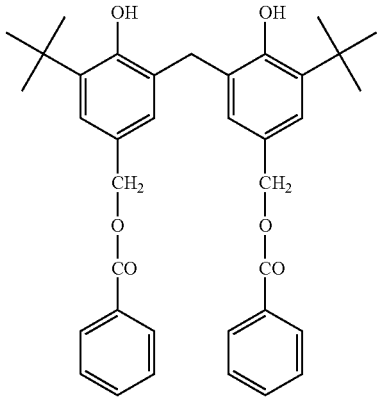
R1-33
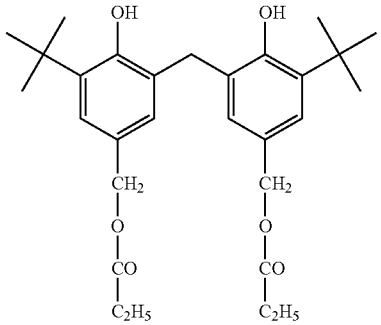
R1-34
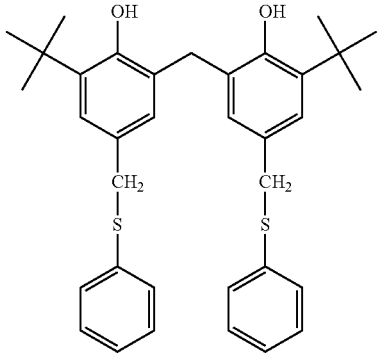
R1-35
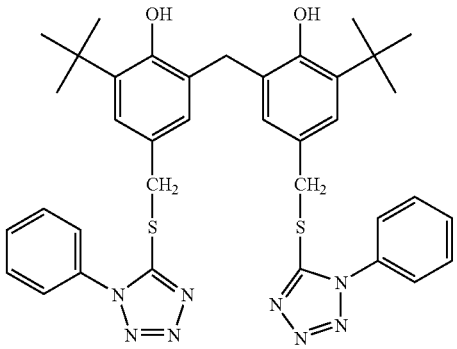

-continued

R1-36

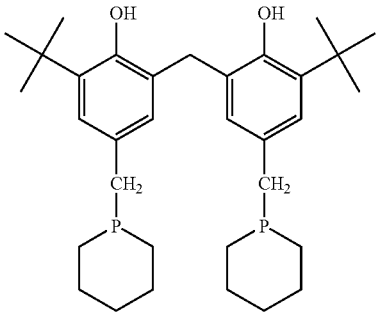

When a reducing agent represented by formula (I) is used, the reducing agent may be used in combination with a nucleating agent which will be explained below.

2) When a Reducing Agent Represented by Formula (I) is Not Used

When the reducing agent is not a compound represented by formula (I), the reducing agent is preferably used in combination with a nucleating agent because the reducing agent itself is supposed to have poor nucleating activity.

Types of the nucleating agent usable in the invention are not particularly limited, but preferable examples of the nucleating agent include the hydrazine derivatives represented by formula (H) described in JP-A No. 2002-090868 (specifically, the hydrazine derivatives described in Tables 1 to 4) (the disclosure of which is incorporated herein by reference) and all the hydrazine derivatives described in JP-A Nos. 10-10672, 10-161270, 10-62898, 9-304870,9-304872, 9-304871 and 10-31282, U.S. Pat. No. 5,496,695, and EP-A No. 741,320 A, the disclosures of which are incorporated herein by reference. In addition, the nucleating agent may be preferably selected from the substituted alkene derivatives, substituted isoxazole derivatives and specific acetal compounds represented by the formulae (1) to (3) described in JP-A No. 2002-090868, the disclosure of which is incorporated herein by reference in its entirety. The nucleating agent may be more preferably selected from the cyclic compounds each independently represented by formula (A) or (B) described in JP-A No. 20024)90868, and specifically compounds 1 to 72 described in the [Chemical formula 8] to [Chemical formula 12] in JP-A No. 2002-090868.

Further, the nucleating agent may be selected from the compounds disclosed in JP-A Nos. 11-119372, 10-339932, 11-84575, 11-84576, 11-95365, 11-95366, 11-102047, 11-109546, 11-119373, 11-133545, 11-133546, 11-149136, 11-231459 and 2000-162733, and U.S. Pat. Nos. 5,545,515, 5,635,339, 5,654,130, 5,686,228 and 5,705,324, the disclosures of which are incorporated herein by reference. Further, the nucleating agent may be an imidazoline derivative. In an embodiment, two or more nucleating agents are used in combination.

The nucleating agent may be used in the form of a solution in water or an appropriate organic solvent, such as an alcohol (such as methanol, ethanol, propanol or a fluorinated alcohol), a ketone (such as acetone or methyl ethyl ketone), dimethylformamide, dimethylsulfoxide or methyl cellosolve. In an embodiment, the nucleating agent is dissolved in an oil such as dibutyl phthalate, tricresyl phosphate, glyceryl triacetate or diethyl phthalate optionally using an auxiliary solvent such as ethyl acetate or cyclohexanone, and mechanically emulsified by a known emulsification method to give an emulsion, then used. In another embodiment, the nucleating agent is used in the form of a dispersion prepared by a known method for solid dispersion in which powder of the nucleating agent is dispersed in an appropriate solvent such as water using a ball mill, a colloid mill or ultrasonic wave. The nucleating agents may be added to any layers on the image-forming layer side of the support, but is preferably added to the image-forming layer or a layer adjacent thereto. The nucleating agent is preferably added in an amount of from $1\times10^{-6}$ to 1 mol, more preferably from $1\times10^{-5}$ to $5\times10^{-1}$, and most preferably from $2\times10^{-5}$ to $2\times10^{-1}$ per mol of silver.

In addition to the above-mentioned compounds, the compounds described in U.S. Pat. Nos. 5,545,515, 5,635,339 and 5,654,130, WO97/34196, U.S. Pat. No. 5,686,228, or compounds described in JP-A Nos. 11-119372, 11-133546, 11-119373, 11-109546, 11-95365, 11-95366 and 11-149136 are also usable, the disclosures of which are incorporated herein by reference.

The nucleating agent may be a hydrazine derivative compound represented by the following formula [H], a vinyl compound represented by formula (G), or a quaternary onium compound represented by formula (P).

Formula [H]

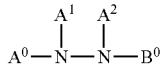

Formula [G]

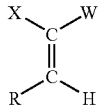

Formula [P]

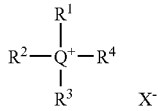

In formula (H), $A^0$ represents an aliphatic group, an aromatic group, a heterocyclic group or a $-G^0-D^0$ group, each of which may have a substituent; $B^0$ represents a blocking group; one of $A^1$ and $A^2$ represents a hydrogen atom, and the other represents a hydrogen atom, an acyl group, a sulfonyl group or an oxalyl group. Herein, $-G^0$ represents a —CO— group, a —COCO— group, -a CS— group, a $—C(=NG^1D^1)$-group, a —SO— group, a $—SO_2—$ group or a $—P(O)(G^1D^1)$-group, $-G^1$ represents a bond, an —O— group, a —S— group or an $—N(D^1)-$ group; $D^1$ represents an aliphatic group, an aromatic group, a heterocyclic group or a hydrogen atom, and when a plurality of $D^1$ are present in the molecule, they may be the same or different from each other. $D^0$ represents a hydrogen atom, an aliphatic group, an aromatic group, a heterocyclic group, an amino group, an alkoxy group, an aryloxy group, an alkylthio group or an arylthio group. $D^0$ is preferably a hydrogen atom, an alkyl group, an alkoxy group or an amino group.

The aliphatic group represented by $A^0$ is a straight, branched or cyclic alkyl group having preferably 1 to 30 carbon atoms, more preferably 1 to 20 carbon atoms. Examples thereof include a methyl group, an ethyl group, a t-butyl group, an octyl group, a cyclohexyl group and a benzyl group, each of which may be further substituted by a suitable substituent (an aryl group, an alkoxy group, an aryloxy group, an alkylthio group, an arylthio group, a sulfoxy group, a sulfonamido group, a sulfamoyl group, an acylamino group, an ureido group, etc.).

When $A^0$ represents an aromatic group, the aromatic group represented by $A^0$ is preferably a monocycle aryl group or a condensed ring aryl group, and may be, for example, a benzene ring or a naphthalene ring. When $A^0$ represents a heterocyclic group, the heterocyclic group represented by $A^0$ is preferably a monocyclic group or a condensed-cyclic group containing at least one hetero atom selected from nitrogen atoms, sulfur atoms and oxygen atoms, and may be, for example, a residue such as a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring or a furan ring.

The aromatic group, the heterocyclic group or the $-G^0-D^0$ group represented by $A^0$ may have a substituent. $A^0$ is particularly preferably an aryl group or a $-G^0-D^0$ group.

Further, $A^0$ preferably contains at least one group selected from anti-diffusion groups and adsorbent groups which can adsorb silver halide. The anti-diffusion group is preferably a ballast group commonly employed in immobile photographic additives such as couplers, and the ballast group may be an alkyl group, an alkenyl group, an alkynyl group, an alkoxy group, a phenyl group, a phenoxy group, or an alkylphenoxy group each of which is photographically inactive, wherein the total number of carbon atoms in the substituent is preferably 8 or more.

The adsorbent group which can adsorb silver halide may be a thiourea group, a thiourethane group, a mercapto group, a thioether group, a thione group, a heterocyclic group, a thioamide heterocyclic group, a mercapto heterocyclic group, or any of the adsorbent groups described in JP-A No. 64-90439.

$B^0$ represents a blocking group, preferably a $-G^0-D^0$ group, wherein $G^0$ represents a —CO— group, a —COCO— group, a —CS— group, a —C(=N $G^1D^1$)- group, a —SO— group, a —$SO_2$— group or a —P(O)($G^1D^1$)- group. $G^0$ is preferably a —CO— group or a —COCO— group. $G^1$ represents a simple bond, an —O— group, a —S— group or an —N($D^1$)- group; $D^1$ represents an aliphatic group, an aromatic group, a heterocyclic group or a hydrogen atom. When a plurality of $D^1$ are present in the molecule, they may be the same or different from each other. $D^0$ represents a hydrogen atom, an aliphatic group, an aromatic group, a heterocyclic group, an amino group, an alkoxy group, an aryloxy group, an alkylthio group or an arylthio group. $D^0$ is preferably a hydrogen atom, an alkyl group, an alkoxy group or an amino group.

One of $A^1$ and $A^2$ represents a hydrogen atom, and the other represents a hydrogen atom, an acyl group (acetyl, trifluoroacetyl, benzoyl, etc.), a sulfonyl group (methanesulfonyl, toluenesulfonyl, etc.) or an oxalyl group (ethoxalyl, etc.).

The hydrazine derivative is more preferably a compound represented by the following formulae (H-1), (H-2), (H-3) or (H-4).

Formula (H-1)

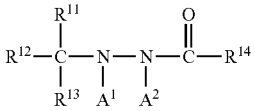

-continued

Formula (H-2)

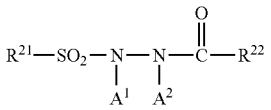

Formula (H-3)

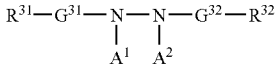

Formula (H-4)

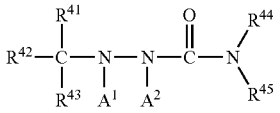

In formula (H-1), $R^{11}$, $R^{12}$ and $R^{13}$ each independently represent a substituted or unsubstituted aryl or heteroaryl group, and specific examples of the aryl group include phenyl, p-methylphenyl and naphthyl. Specific examples of the heteroaryl group include triazole, imidazole, pyridine, furan and thiophene. In addition, $R^{11}$, $R^{12}$ and $R^{13}$ may be bonded to each other via any connecting group. When $R^{11}$, $R^{12}$ or $R^{13}$ has a substituent, the substituent may be an alkyl group, an alkenyl group, an alkynyl group, an aryl group, a heterocyclic group, a heterocyclic group containing a quaternized nitrogen atom, a hydroxyl group, an alkoxy group (which may be a group containing repeating ethyleneoxy units or repeating propyleneoxy units), an aryloxy group, an acyloxy group, an acyl group, an alkoxycarbonyl group, an aryloxycarbonyl group, a carbamoyl group, a urethane group, a carboxyl group, an imido group, an amino group, a carbonamido group, a sulfonamido group, a ureido group, a thioureido group, a sulfamoylamino group, a semicarbazido group, a thiosemicarbazido group, a hydrazino group, a quaternized ammonium group, an (alkyl, aryl, or heterocyclic)thio group, a mercapto group, an (alkyl, or aryl)sulfonyl group, an (alkyl or aryl)sulfinyl group, a sulfo group, a sulfamoyl group, an acylsulfamoyl group, an (alkyl or aryl)sulfonylureido group, an (alkyl or aryl)sulfonylcarbamoyl group, a halogen atom, a cyano group, a nitro group or a phosphoric amide group. In a preferable embodiment, $R^{11}$, $R^{12}$ and $R^{13}$ are each a substituted or unsubstituted phenyl group. In another preferable embodiment, $R^{11}$, $R^{12}$ and $R^{13}$ are each an unsubstituted phenyl group.

$R^{14}$ represents a heteroaryloxy group or a heteroarylthio group, and the heteroaryloxy group may be a pyridyloxy group, a pyrimidyloxy group, an indolyloxy group, a benzothiazolyloxy group, a benzoimidazolyloxy group, a furyloxy group, a thienyloxy group, a pyrazolyloxy group or an imidazolyloxy group. When $R^{14}$ represents a heteroarylthio group, the heteroarylthio group may be a pyridylthio group, a pyrimidylthio group, an indolylthio group, a benzothiazolylthio group, a benzoimidazolylthio group, a furylthio group, a thienylthio group, a pyrazolylthio group or an imidazolylthio group. $R^{14}$ is preferably a pyridyloxy group or a thienyloxy group.

One of $A^1$ and $A^2$ represents a hydrogen atom, and the other represents a hydrogen atom, an acyl group (acetyl, trifluoroacetyl, benzoyl, etc.), a sulfonyl group (methanesulfonyl, toluenesulfonyl, etc.), or an oxalyl group (ethoxalyl, etc.). Preferably, both of $A^1$ and $A^2$ are hydrogen atoms.

In formula (H-2), $R^{21}$ is a substituted or unsubstituted alkyl group, a substituted or unsubstituted aryl group or a substituted or unsubstituted heteroaryl group. The alkyl group may be a methyl group, an ethyl group, a t-butyl group, a 2-octyl group, a cyclohexyl group, a benzyl group or a diphenylmethyl group. Specific examples of the aryl group and the heteroaryl group are the same as in the case of $R^{11}$, $R^{12}$ and $R^{13}$. When $R^{21}$ has a substitutent, specific examples of the substituent are the same as in the case of $R^{11}$, $R^{12}$ and $R^{13}$. $R^{21}$ is preferably an aryl group or a heteroaryl group, and particularly preferably a substituted or unsubstituted phenyl group.

$R^{22}$ is a hydrogen atom, an alkylamino group, an arylamino group or heteroarylamino group. The alkylamino group may be a methylamino group, an ethylamino group, a propylamino group, a butylamino group, a dimethylamino group, a diethylamino group or an ethylmethylamino group. The arylamino group may be an anilino group. The heteroaryl group may be a thiazolylamino group, a benzimidazolylamino group or a benzthiazolylamino group. $R^{22}$ is preferably a dimethylamino group or a diethylamino group.

The definitions of $A^1$ and $A^2$ are the same as the definitions of $A^1$ and $A^2$ in formula (H-1).

In formula (H-3), $R^{31}$ and $R^{32}$ each independently represent a monovalent substituent which may be selected from above-described examples of substituents on $R^{11}$, $R^{12}$ and $R^{13}$. The monovalent substituent is preferably an alkyl group, an aryl group, a heteroaryl group, an alkoxy group or an amino group, more preferably an aryl group or an alkoxy group. In a preferable embodiment, at least one of $R^{31}$ and $R^{32}$ is a t-butoxy group. In another preferable embodiment, $R^{31}$ is a phenyl group and $R^{32}$ is a t-butoxy group.

$G^{31}$ and $G^{32}$ each independently represent a —(CO)— group, a —COCO— group, a —C(=S)— group, a sulfonyl group, a sulfoxy group, a —P(=O)$R^{33}$— group or an iminomethylene group, in which $R^{33}$ is an alkyl group, an alkenyl group, an alkynyl group, an aryl group, an alkoxy group, an alkenyloxy group, an alkynyloxy group, an aryloxy group or an amino group. When $G^{31}$ is a sulfonyl group, $G^{32}$ is not a carbonyl group. $G^{31}$ and $G^{32}$ are each preferably selected from a —CO— group, a —COCO— group, a sulfonyl group and a —CS— group. In a preferable embodiment, both of $G^{31}$ and $G^{32}$ are —CO— groups or sulfonyl groups. The definitions of $A^1$ and $A^2$ are the same as in formula (H-1).

In formula (H-4), the difinitions of $R^{41}$, $R^{42}$ and $R^{43}$ are the same as in formula (H-1). In a preferable embodiment, $R^{41}$, $R^{42}$ and $R^{43}$ are each a substituted or unsubstituted phenyl group. In another preferable embodiment, $R^{41}$, $R^{42}$ and $R^{43}$ are each an unsubstituted phenyl group. $R^{44}$ and $R^{45}$ each independently represent an unsubstituted or substituted alkyl group which may be a methyl group, an ethyl group, a t-butyl group, a 2-octyl group, a cyclohexyl group, a benzyl group or a diphenylmethyl group. In a preferable embodiment, both of $R^{44}$ and $R^{45}$ are ethyl groups. The definitions of $A^1$ and $A^2$ are the same as in formula (H-1).

Compounds represented by formulae (H-1) to (H-4) can be easily synthesized in accordance with methods known in the art, for example, by methods described in U.S. Pat. Nos. 5,464,738 and 5,496,695, the disclosures of which are incorporated herein by reference.

The following hydrazine derivatives are also usable in the invention which can be synthesized by methods known in the art: the compounds H-1 to H-29 described in columns 11 to 20 of U.S. Pat. No. 5,545,505 and the compounds 1 to 12 described in columns 9 to 11 of U.S. Pat. No. 5,464,738, the disclosures of which are incorporated herein by reference.

In formula (G), although X and R are expressed in the cis form, a trans-form is also included in the scope of formula (G). When a compound disclosed in the present invention has a geometric isomer, the geometric isomer is also included in the scope of the invention.

In formula (G), X is an electron-attractive group; W is a hydrogen atom, an alkyl group, an alkenyl group, an alkynyl group, an aryl group, a heterocyclic group, a halogen atom, an acyl group, a thioacyl group, an oxalyl group, an oxyoxalyl group, a thiooxalyl group, an oxamoyl group, an oxycarbonyl group, a thiocarbonyl group, a carbamoyl group, a thiocarbamoyl group, a sulfonyl group, a sulfinyl group, an oxysulfinyl group, a thiosulfinyl group, a sulfamoyl group, an oxysulfinyl group, a thiosulfinyl group, a sulfinamoyl group, a phosphoryl group, a nitro group, an imino group, an N-carbonylimino group, an N-sulfonylimino group, a dicyanoethylene group, an ammonium group, a sulfonium group, a phosphonium group, a pyrylium group or an inmonium group.

R is a halogen atom, a hydroxyl group, an alkoxy group, an aryloxy group, a heterocyclyloxy group, an alkenyloxy group, an acyloxy group, an alkoxycarbonyloxy group, an aminocarbonyloxy group, a mercapto group, an alkylthio group, an arylthio group, a heterocyclic thio group, an alkenylthio group, an acylthio group, an alkoxycarbonylthio group, an aminocarbonylthio group, an organic or inorganic salt of a hydroxyl or mercapto group (a sodium salt, a potassium salt, a silver salt, etc.), an amino group, an alkylamino group, a cyclic amino group (pyrrolidino, etc.), an acylamino group, an oxycarbonylamino group, a heterocyclic group (a 5- to 6-membered nitrogen-containing heterocyclic group, a benzotriazolyl group, an imidazolyl group, a triazolyl group, a tetrazolyl group, etc.), an ureido group or a sulfonamido group. X and W may be bonded to each other to form a cyclic structure, and X and R may be bonded to each other to form a cyclic structure. The ring formed by X and W may be, for example, a pyrazolone ring, a pyrazolidinone ring, a cyclopentadione ring, β-ketolactone ring or a β-ketolactam ring.

In formula (G), the electron-attractive group represented by X is a group whose substituent constant σp can be a positive value. The electron-attracting group may be a substituted alkyl group (halogenated alkyl, etc.), a substituted alkenyl group (cyanovinyl, etc.), a substituted or unsubstituted alkynyl group (trifluoromethylacetylenyl, cyanoacetylenyl, etc.), a substituted aryl group (cyanophenyl, etc.), a substituted or unsubstituted heterocyclic group (pyridyl, triazinyl, benzoxazolyl, etc.), a halogen atom, a cyano group, an acyl group (acetyl, trifluoroacetyl, formyl, etc.), a thioacetyl group (thioacetyl, thioformyl, etc.), an oxalyl group (methyloxalyl, etc.), an oxyoxalyl group (ethoxalyl, etc.), a thiooxalyl group (ethylthiooxalyl, etc.), an oxamoyl group (methyloxamoyl, etc.), an oxycarbonyl group (ethoxycarbonyl, etc.), a carboxyl group, a thiocarbonyl group (ethylthiocarbonyl, etc.), a carbamoyl group, a thiocarbamoyl group, a sulfonyl group, a sulfinyl group, an oxysulfonyl group (ethoxysulfonyl, etc.), a thiosulfonyl group (ethylthiosulfonyl, etc.), a sulfamoyl group, an oxysulfinyl group (methoxysulfinyl, etc.), a thiosulfinyl (methylthiosulfinyl, etc.), a sulfinamoyl group, a phosphoryl group, a nitro group, an imino group, N-carbonylimino group (N-acetylimino, etc.), an N-sulfonylimino group (N-methanesufonylimino, etc.), a dicyanoethylene group, an ammonium group, a sulfonium group, a phosphonium group, a pyrilium group or an inmonium group. In an embodiment, the electron-attracting group is a heterocyclic group formed by ring-closure reaction of an ammonium group, a sulfonium group, a phosphonium group, or an immonium group. σp of the substituent is preferably 0.30 or more.

When W represents an alkyl group, the alkyl group may be methyl, ethyl, or trifluoromethyl; when W represents an alkenyl group, the alkenyl group may be vinyl, halogenated vinyl or cyanovinyl; when W represents an alkynyl group, the alkynyl group may be acetylenyl or cyanoacetylenyl; when W represents an aryl group, the aryl group may be nitrophenyl, cyanophenyl or pentafluorophenyl; and when W represents a heterocyclic group, the heterocyclic group may be pyridyl, pyrimidyl, triazinyl, succinimido, tetrazolyl, triazolyl, imidazolyl or benzoxazolyl. W is preferably an electron-attractive group having a positive σp, more preferably an electron-attractive group having a op of 0.30 or more.

The substituents represented by R is preferably a hydroxyl group, a mercapto group, an alkoxy group, an alkylthio group, a halogen atom, an organic or inorganic salt of a hydroxyl or mercapto group or a heterocyclic group, more preferably a hydroxyl group, an alkoxy group, an organic or inorganic salt of a hydroxyl or mercapto group, or a heterocyclic group, still more preferably a hydroxyl group or an organic or inorganic salt of a hydroxyl or mercapto group.

The substituent represented by X or W is preferably a substituent having a thioether bond.

In formula (P), Q represents a nitrogen atom or a phosphorus atom, $R^1$, $R^2$, $R^3$ and $R^4$ each independently represent a hydrogen atom or a substituent, and $X^-$ represents an anion. $R^1$ to $R^4$ may be bonded to each other to form a ring.

The substituent represented by any of $R^1$ to $R^4$ may be an alkyl group (a methyl group, an ethyl group, a propyl group, a butyl group, a hexyl group, a cyclohexyl group, etc.), an alkenyl group (an allyl group, a butenyl group, etc.), an alkynyl group (a propargyl group, a butynyl group, etc.), an aryl group (a phenyl group, a naphthyl group, etc.), a heterocyclic group (a piperidinyl group, a piperazinyl group, a morpholinyl group, a pyridyl group, a furyl group, a thienyl group, a tetrahydrofuryl group, a tetrahydrothienyl group, a sulfolanyl group, etc.) or an amino group.

The ring formed by a combination of some of $R^1$ to $R^4$ may be a piperidine ring, a morpholine ring, a piperazine ring, a quinuclidine ring, a pyridine ring, a pyrrole ring, an imidazole ring, a triazole ring or a tetrazole ring.

The group represented by $R^1$ to $R^4$ each may have a substituent such as a hydroxyl group, an alkoxy group, an aryloxy group, a carboxyl group, a sulfo group, an alkyl group or an aryl group. $R^1$, $R^2$, $R^3$ and $R^4$ are each preferably a hydrogen atom or an alkyl group.

Examples of the anion represented by $X^-$ include inorganic ions and organic ions such as halide ions, a sulfate ion, a nitrate ion, an acetate ion and a p-toluenesulfonate ion.

The nucleating agent is more preferably a compound represented by formulae (Pa), (Pb) or (Pc), or a compound represented by formula (T):

Formula (Pa)

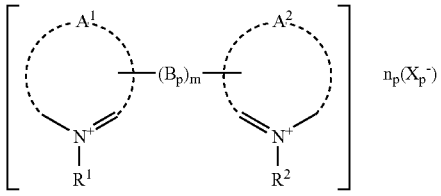

-continued

Formula (Pb)

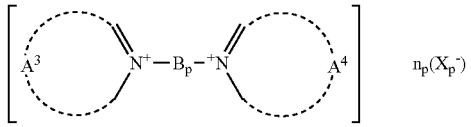

Formula (Pc)

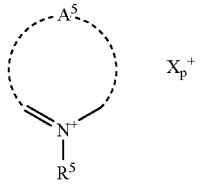

In formulae (Pa), (Pb) and (Pc), $A^1$, $A^2$, $A^3$, $A^4$ and $A^5$ each independently represent a non-metallic atom group capable of forming a nitrogen-containing heterocyclic ring, which may contain an atom or atoms selected from oxygen atoms, nitrogen atoms, and sulfur atoms. The heterocyclic ring formed by the nitrogen and any of $A^1$, $A^2$, $A^3$, $A^4$ and $A^5$ may be condensed with a benzene ring. The heterocyclic rings including $A^1$, $A^2$, $A^3$, $A^4$ and $A^5$ respectively may be the same as each other or different from each other. The heterocyclic rings including $A^1$, $A^2$, $A^3$, $A^4$ and $A^5$ each may have a substituent. The substituent may be an alkyl group, an aryl group, an aralkyl group, alkenyl group, an alkynyl group, a halogen atom, an acyl group, an alkoxycarbonyl group, an aryloxycarbonyl group, a sulfo group, a carboxyl group, a hydroxyl group, an alkoxy group, an aryloxy group, an amido group, a sulfamoyl group, a carbamoyl group, a ureido group, an amino group, a sulfonamido group, a sulfonyl group, a cyano group, a nitro group, a mercapto group, an alkylthio group, or an arylthio group.

The heterocycle including $A^1$, $A^2$, $A^3$, $A^4$ or $A^5$ may be a 5-membered ring or a 6-membered ring (e.g., pyridine, imidazole, thiozole, oxazole, pyrazine, pyrimidine, etc.), more preferably a pyridine ring.

Bp is a divalent linkage group, and m is 0 or 1. Examples of the divalent linkage group include alkylene groups, arylene groups, alkenylene groups, —$SO_2$—, —SO—, —O—, —S—, —CO—, N($R^6$)—, in which $R^6$ is an alkyl group, an aryl group or a hydrogen atom. The divalent linkage group may be a divalent linkage group which is a combination of some of the above divalent linkage groups. Bp is preferably an alkylene group or an alkenylene group.

$R^1$, $R^2$ and $R^5$ each independently represent an alkyl group having 1 to 20 carbon atoms, and $R^1$ and $R^2$ may be the same as each other or different from each other. The alkyl group may be substituted or unsubstituted. When the alkyl group has a substituent, the substituent may be selected from the above-described substituents cited as substituents on $A^1$, $A^2$, $A^3$, $A^4$ and $A^5$.

$R^1$, $R^2$ and $R^5$ are each preferably an alkyl group having 4 to 10 carbon atoms, more preferably an aryl-substituted alkyl group, which may or may not be further substituted.

$X_p^-$ is a counter ion necessary for maintaining charge balance of the entire molecule. $X_p^-$ may be a chlorine ion, a bromine ion, an iodine ion, a nitrate ion, a sulfate ion, a p-toluenesulfonate ion or an oxalate ion. $n_p$ is the number of counter ion(s) necessary for maintaining charge balance of the entire molecule. If the compound represented by formula (Pa), (Pb), or (Pc) is an intramolecular salt, $n_p$ is 0.

Formula [T]

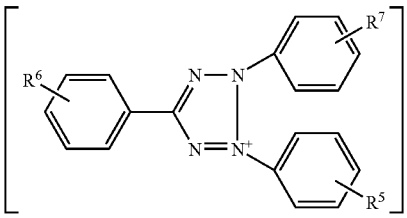

$(1/n \cdot X_T^{n-})$

The substituents respectively represented by $R^5$, $R^6$ and $R^7$ on the phenyl groups of the triphenyltetrazolium compound represented by formula [T] are each preferably a hydrogen atom or a group having a negative Hammett's sigma value ($\sigma_p$). The Hammett's sigma value ($\sigma_p$) indicates a degree of electron attractiveness.

The Hammett's sigma values of substituents on phenyl groups are disclosed in many references. For example, a report by C. Hansch in Journal of Medical Chemistry, Vol. 20, pp. 304 (1977) (the disclosure of which is incorporated herein by reference), etc. can be mentioned. Preferable examples of groups having negative sigma values include a methyl group ($\sigma_p$=−0.17; in the following, the values in the parentheses indicate $\sigma_p$ value), an ethyl group (−0.15), a cyclopropyl group (−0.21), a propyl group (−0.13), an i-propyl group (−0.15), a cyclobutyl group (−0.15), a butyl group (−0.16), isobutyl group (−0.20), a pentyl group (−0.15), a cyclohexyl group (−0.22), an amino group (−0.66), an acetylamino group (−0.15), a hydroxyl group (−0.37), a methoxy group (−0.27), an ethoxy group (−0.24), a propoxy group (−0.25), a butoxy group (−0.32), and a pentoxy group (−0.34). Each of these groups can be used as the substituent represented by $R^5$, $R^6$ or $R^7$ in formula [T].

n represents 1 or 2. Examples of the anion represented by $X_T^{n-}$ include: halide ions such as a chloride ion, a bromide ion and an iodide ion; acid radicals of inorganic acids such as nitric acid, sulfuric acid and perchloric acid; acid radicals of organic acids such as sulfonic acid and carboxylic acid; and anionic surfactants, for example, lower alkylbenzenesulfonate anions such as p-toluenesulfonate anion, higher alkylbenzenesulfonate anions such as p-dodecylbenzenesulfonate anion, higher alkyl sulfate anions such as lauryl sulfate anion, borate anions such as tetraphenylboron, dialkylsulfosuccinate anions such as di-2-ethylhexylsulfosuccinate anion, higher fatty acid anions such as cetyl polyethenoxysulfate anion, and polymers having acid groups such as polyacrylate anion.

The quaternary onium salt compounds described above can be readily synthesized according to methods commonly known in the art. For example, the above described tetrazolium compound may be synthesized based on Chemical Reviews, Vol. 55, pp. 335–483, the disclosure of which is incorporated herein by reference.

The above described nucleating agent is added preferably in an amount of $10^{-5}$ to 1 mol, more preferably $10^{-4}$ to $5\times10^{-1}$ mol, per mol of organic silver salt. Only a single nucleating agent may be used or two or more nucleating agents may be used.

When a nucleating agent is used in the non-photosensitive layer S, the reducing agent contained in the non-photosensitive layer S is not particularly limited and may be any substance (preferably an organic substance) capable of reducing silver ions to metallic silver. Examples of such a reducing agent are described, for example, in JP-A No. 11-65021, Paragraph Nos. [0043] to [0045] and EP-A No. 0803764 A1, p. 7, line 34 to p. 18, line 12, the disclosures of which are incorporated herein by reference.

When a nucleating agent is used in the non-photosensitive layer S, the reducing agent is preferably a so-called hindered phenol reducing agent having a substituent at an ortho-position of a phenolic hydroxyl group or a bisphenol reducing agent, more preferably a compound represented by the following formula (R).

Formula (R)

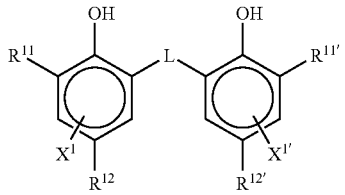

In the formula (R), $R^{11}$ and $R^{11'}$ each independently represent an alkyl group having 1 to 20 carbon atoms; $R^{12}$ and $R^{12'}$ each independently represent a hydrogen atom or a substituent which can be bonded to the benzene ring; L represents an —S— group or a —$CHR^{13}$— group, and $R^{13}$ represents a hydrogen atom or an alkyl group having 1 to 20 carbon atoms; $X^1$ and $X^{1'}$ each independently represent a hydrogen atom or a substituent which can be bonded to the benzene ring.

The formula (R) is described in detail below. In the following, the scope of the term "an alkyl group" encompasses "a cycloalkyl group" unless mentioned otherwise.

1) $R^{11}$ and $R^{11'}$ $R^{11}$ and $R^{11'}$ each independently represent a substituted or unsubstituted alkyl group having 1 to 20 carbon atoms. There are no particular restrictions on the substituents on the alkyl group. Examples of preferred substituents on the alkyl group include aryl groups, a hydroxy group, alkoxy groups, aryloxy groups, alkylthio groups, arylthio groups, acylamino groups, sulfonamide groups, sulfonyl groups, phosphoryl groups, acyl groups, carbamoyl groups, ester groups, ureido groups, urethane groups, and halogen atoms.

2) $R^{12}$ and $R^{12'}$, and $X^1$ and $X^{1'}$ $R^{12}$ and $R^{12'}$ each independently represent a hydrogen atom or a substituent which can be bonded to the benzene ring. Also $X^1$ and $X^{1'}$ each independently represent a hydrogen atom or a substituent which can be bonded to the benzene ring. Examples of preferable substituents which can be bonded to the benzene ring include alkyl groups, aryl groups, halogen atoms, alkoxy groups, and acylamino groups.

3) L

L represents an —S— group or a —$CHR^{13}$— group. $R^{13}$ represents a hydrogen atom or an alkyl group having 1 to 20 carbon atoms, and the alkyl group may have a substituent. When $R^{13}$ represents an unsubstituted alkyl group, examples thereof include a methyl group, an ethyl group, a propyl group, a butyl group, a heptyl group, an undecyl group, an isopropyl group, a 1-ethylpentyl group, a 2,4,4-trimethylpentyl group, a cyclohexyl group, a 2,4-dimethyl-3-cyclohexenyl group, and a 2,4-dimethyl-3-cyclohexenyl group. Examples of the substituent on the alkyl group represented by $R^{13}$ include the substituents described above as examples of the substituents on $R^{11}$ or $R^{11'}$. The substituent on the alkyl group may be a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, or a sulfamoyl group.

4) Preferred Substituents $R^{11}$ and $R^{11'}$ are each preferably a primary alkyl group having 1 to 15 carbon atoms, a secondary alkyl group having 1 to 15 carbon atoms, or a tertiary alkyl group having 1 to 15 carbon atoms. Specific examples of such an alkyl group include a methyl group, an isopropyl group, a t-butyl group, a t-amyl group, a t-octyl group, a cyclohexyl group, a cyclopentyl group, a 1-methyl cyclohexyl group, and a 1-methylcyclopropyl group. $R^{11}$ and $R^{11'}$ are each more preferably an alkyl group having 1 to 4 carbon atoms, furthermore preferably a methyl group, a t-butyl group, a t-amyl group, or a 1-methylcyclohexyl group, most preferably a methyl group or a t-butyl group.

$R^{12}$ and $R^{12'}$ are each preferably an alkyl group having 1 to 20 carbon atoms, and specific examples thereof include a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, and a methoxyethyl group. $R^{12}$ and $R^{12'}$ are each more preferably a methyl group, an ethyl group, a propyl group, an isopropyl group, or a t-butyl group, particularly preferably a methyl group or an ethyl group.

$X^1$ and $X^{1'}$ are each preferably a hydrogen atom, a halogen atom, or an alkyl group, more preferably a hydrogen atom.

L is preferably a —$CHR^{13}$— group.

$R^{13}$ is preferably a hydrogen atom or an alkyl group having 1 to 15 carbon atoms. The alkyl group may be a linear alkyl group or a cyclic alkyl group, and may have a C═C bond. The alkyl group is preferably a methyl group, an ethyl group, a propyl group, an isopropyl group, a 2,4,4-trimethylpentyl group, a cyclohexyl group, a 2,4-dimethyl-3-cyclohexenyl group, or a 3,5-dimethyl-3-cyclohexenyl group. $R^{13}$ is particularly preferably a hydrogen atom, a methyl group, an ethyl group, a propyl group, an isopropyl group, or a 2,4-dimethyl-3-cyclohexenyl group.

When $R^{11}$ and $R^{11'}$ are tertiary alkyl groups and $R^{12}$ and $R^{12'}$ are methyl groups, $R^{13}$ is preferably a primary or secondary alkyl group having 1 to 8 carbon atoms such as a methyl group, an ethyl group, a propyl group, an isopropyl group, or a 2,4-dimethyl-3-cyclohexenyl group.

When $R^{11}$ and $R^{11'}$ are tertiary alkyl groups and $R^{12}$ and $R^{12'}$ are alkyl groups other than methyl, $R^{13}$ is preferably a hydrogen atom.

When none of $R^{11}$ and $R^{11'}$ is a tertiary alkyl group, $R^{13}$ is preferably a hydrogen atom or a secondary alkyl group, particularly preferably a secondary alkyl group. The secondary alkyl group is preferably an isopropyl group or a 2,4-dimethyl-3-cyclohexenyl group.

The combination of $R^{11}$, $R^{11'}$, $R^{12}$, $R^{12'}$ and $R^{13}$ affects the heat developability of the resultant photothermographic material, the tone of the developed silver, and the like. It is preferable to use a combination of two or more reducing agents depending on the purpose since such properties can be adjusted by the combination of the reducing agents.

In the following, specific examples of the reducing agent added only to the image-forming layer are shown, but the invention is not limited thereto.

(R-1)

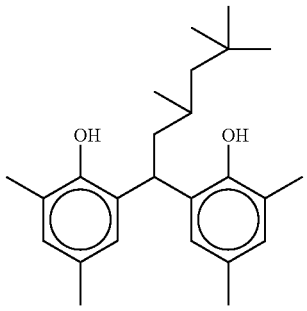

(R-2)

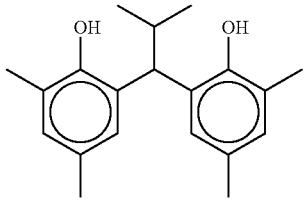

(R-3)

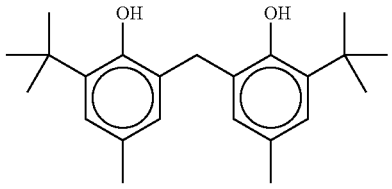

(R-4)

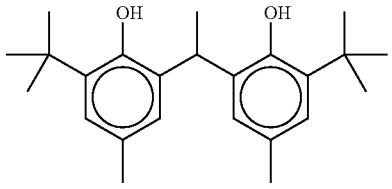

(R-5)

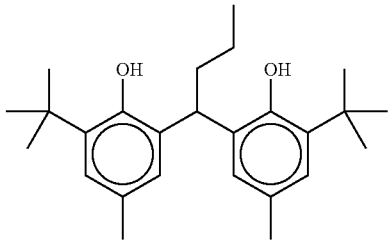

(R-6)

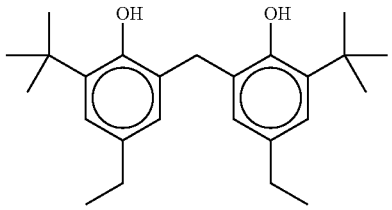

(R-7)

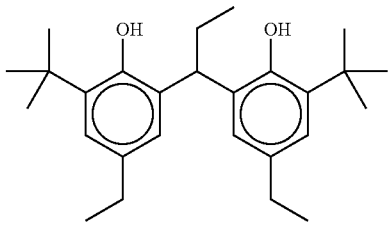

-continued (R-8)

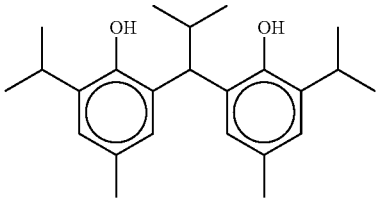

(R-9)

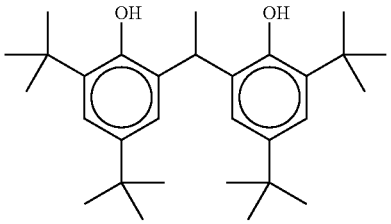

(R-10)

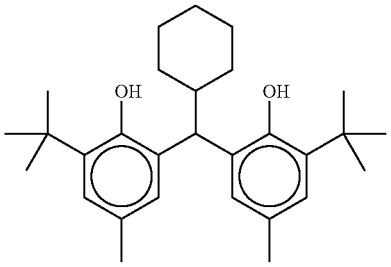

(R-11)

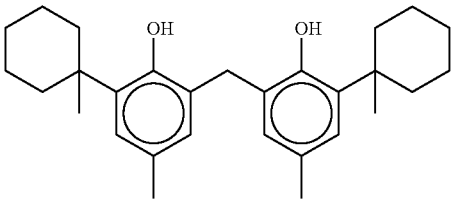

(R-12)

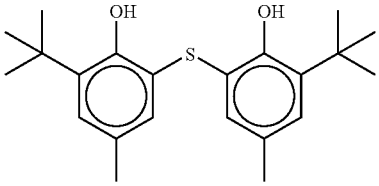

(R-13)

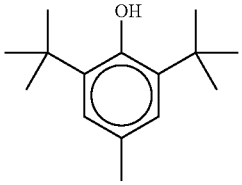

(R-14)

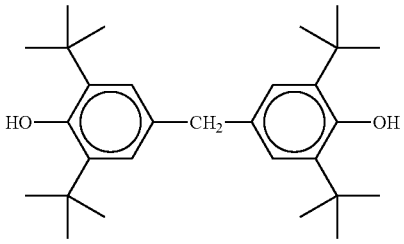

-continued (R-15)

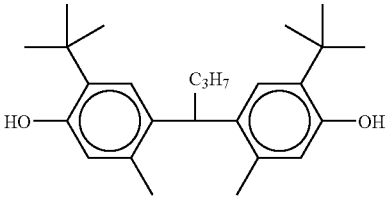

(R-16)

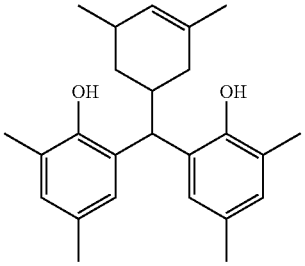

(R-17)

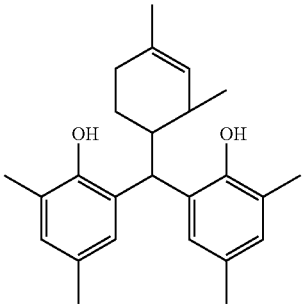

(R-18)

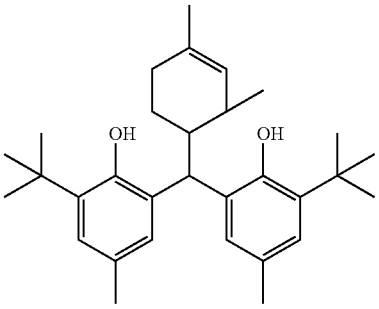

(2) Reducing Agent of Image-Forming Layer

The reducing agent contained in the image-forming layer may be any substance (preferably an organic substance) capable of reducing silver ions to metallic silver. Preferable examples of the reducing agent in the image-forming layer are the same as preferable examples of the reducing agent in the non-photosensitive layer S which includes a nucleating agent.

(3) Combination of Reducing Agent in Image-Forming Layer and Reducing Agent in Non-Photosensitive Layer S The reducing agents respectively in the non-photosensitive layer S and the image-forming layer may be the same as each other or different from each other. In a preferable embodiment, a reducing agent represented by formula (I) is added to the non-photosensitive layer S and a reducing agent represented by formula (II) is added to the image-forming layer.

Formula (II)

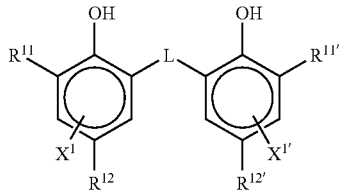

In the formula (II), $R^{11}$ and $R^{11'}$ each independently represent an alkyl group having 1 to 20 carbon atoms; $R^{12}$ and $R^{12'}$ each independently represent a hydrogen atom or a substituent which can be bonded to the benzene ring; L represents an —S— group or a —$CHR^{13}$— group, and $R^{13}$ represents a hydrogen atom or an alkyl group having 1 to 20 carbon atoms; $X^1$ and $X^{1'}$ each independently represent a hydrogen atom or a substituent which can be bonded to the benzene ring.

The scope of reducing agents represented by formula (II) includes compounds represented by formula (I). However, it is necessary to use different reducing agents in the different image-forming layers (the photosensitive layer and the non-photosensitive layer S) because the effects of the invention are executed by difference between nucleating activities of the reducing agents in the respective layers. In an embodiment, two or more reducing agents represented by formula (I) are added to respectively different image-forming layers.

Each substituent is explained in detail.

1) $R^{11}$ and $R^{11'}$ $R^{11}$ and $R^{11'}$ each independently represent a substituted or unsubstituted alkyl group having 1 to 20 carbon atoms. There are no particular restrictions on substituents on the alkyl group. The substituents are preferably selected from primary alkyl groups having 1 to 20 carbon atoms. Examples of preferred substituents on the alkyl group include aryl groups, a hydroxy group, alkoxy groups, aryloxy groups, alkylthio groups, arylthio groups, acylamino groups, sulfonamide groups, sulfonyl groups, phosphoryl groups, acyl groups, carbamoyl groups, ester groups, and halogen atoms.

2) $R^{12}$ and $R^{12'}$, and $X^1$ and $X^{1'}$ $R^{12}$ and $R^{12'}$ each independently represent a hydrogen atom or a substituent which can be bonded to the benzene ring. Also $X^1$ and $X^{1'}$ each independently represent a hydrogen atom or a substituent which can be bonded to the benzene ring. Examples of preferable substituents which can be bonded to the benzene ring include alkyl groups, aryl groups, halogen atoms, alkoxy groups, and acylamino groups.

3) L

L represents an —S— group or a —$CHR^{13}$— group. $R^{13}$ represents a hydrogen atom or an alkyl group having 1 to 20 carbon atoms, and the alkyl group may have a substituent. When $R^{13}$ represents an unsubstituted alkyl group, examples thereof include a methyl group, an ethyl group, a propyl group, a butyl group, a heptyl group, an undecyl group, an isopropyl group, a 1-ethylpentyl group, and a 2,4,4-trimethylpentyl group. Examples of the substituent on the alkyl group represented by $R^{13}$ include the substituents described above as examples of the substituents on $R^{11}$ or $R^{11'}$. The substituent on the alkyl group may be a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, or a sulfamoyl groups.

4) Preferred Substituent $R^{11}$ and $R^{11'}$ are each preferably a primary alkyl group having 1 to 15 carbon atoms, and specific examples thereof include a methyl group, an ethyl group, a propyl group, a butyl group, an amyl group and a hexyl group.

When $R^{12}$ and $R^{12'}$ are alkyl groups each having at least 2 carbon atoms, $R^{11}$ and $R^{11'}$ are each preferably a secondary or tertiary alkyl group, more preferably a tertiary alkyl group, and particularly preferably a t-butyl group.

$R^{12}$ and $R^{12'}$ are each preferably an alkyl group having 1 to 20 carbon atoms, and specific examples thereof include a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group and a methoxyethyl group, more preferably a methyl group, an ethyl group, a propyl group, an isopropyl group and a t-butyl group.

In addition, when $R^{11}$ and $R^{11'}$ are tertiary alkyl groups, $R^{12}$ and $R^{12'}$ are each preferably an alkyl group having at least 2 carbon atoms, more preferably a straight-chain alkyl group having 2 to 4 carbon atoms, and particularly preferably an ethyl group.

$X^1$ and $X^{1'}$ are each preferably a hydrogen atom, a halogen atom or an alkyl group, more preferably a hydrogen atom.

L is preferably a —$CHR^{13}$— group.

$R^{13}$ is preferably a hydrogen atom or an alkyl group having 1 to 15 carbon atoms. Examples of the alkyl group include a methyl group, an ethyl group, a propyl group, an isopropyl group, a 2,4,4-trimethylpentyl group, a cyclohexyl group and a 1,3-dimethylcyclohexen-4-yl group. $R^{13}$ is particularly preferably a hydrogen atom, a methyl group, a propyl group or an isopropyl group.

When $R^{11}$ and $R^{11'}$ are tertiary alkyl groups and $R^{13}$ is a hydrogen atom, $R^{12}$ and $R^{12'}$ are each preferably an alkyl group having 2 to 5 carbon atoms, more preferably an ethyl group or a propyl group, still more preferably an ethyl group.

When $R^{11}$ and $R^{11'}$ are primary alkyl groups and $R^{13}$ is a primary or secondary alkyl group having 1 to 8 carbon atoms, $R^{12}$ and $R^{12'}$ are each preferably a methyl group. When $R^{13}$ represents a primary or secondary alkyl group having 1 to 8 carbon atoms, the group represented by $R^{13}$ is preferably a methyl group, an ethyl group, a propyl group, an isopropyl group or a cyclohexyl group, more preferably a methyl group, an isopropyl group or a cyclohexyl group.

When $R^{11}$, $R^{11'}$, $R^{12}$ and $R^{12'}$ are all methyl groups, $R^{13}$ is preferably a secondary alkyl group. In this case, the secondary alkyl group represented by $R^{13}$ is preferably an isopropyl group, an isobutyl group, a 1-ethylpentyl group, a cyclohexyl group or a 1,3-dimethylcyclohexen-4-yl group, more preferably an isopropyl group.

In the following, specific examples of compounds represented by formula (R) of the invention are shown, but the invention is not limited thereto.

(R-1)
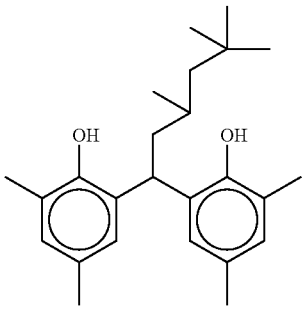
(R-2)
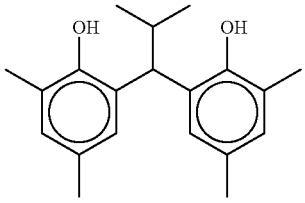
(R-3)
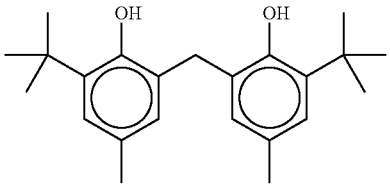
(R-4)
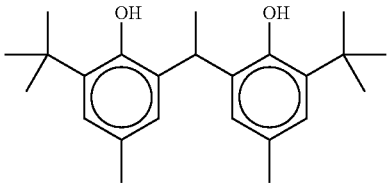
(R-5)
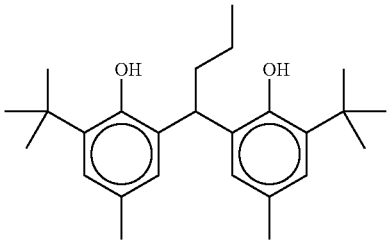
(R-6)
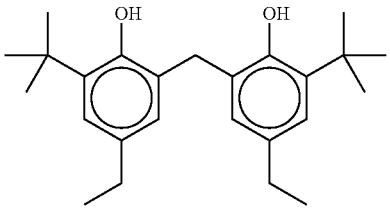
(R-7)
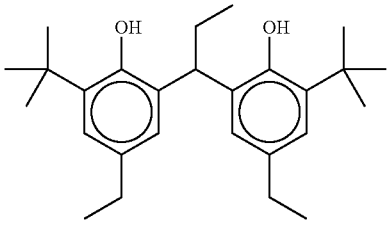
-continued
(R-8)
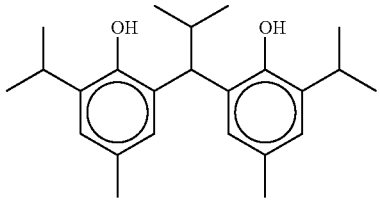
(R-9)
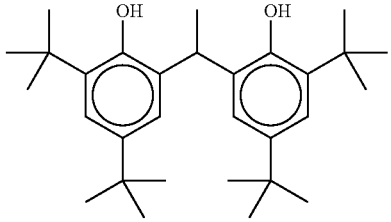
(R-10)
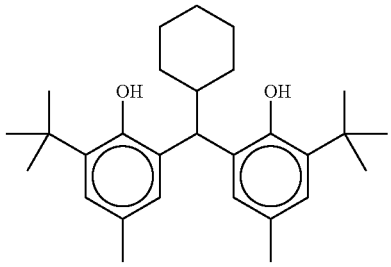
(R-11)
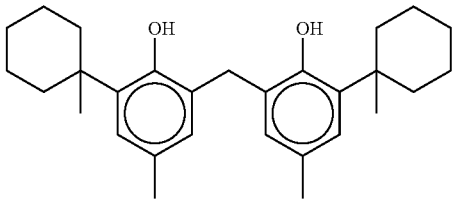
(R-12)
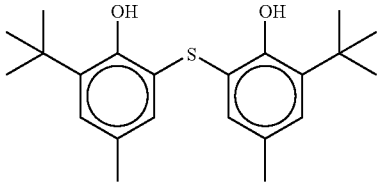
(R-13)
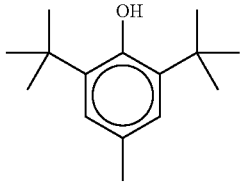
(R-14)
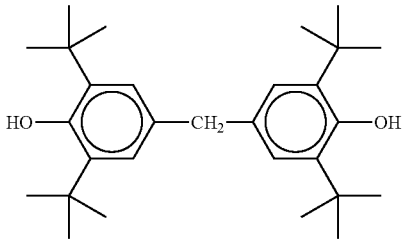

-continued (R-15)

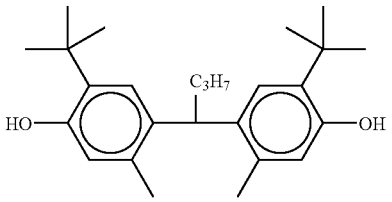

(R-16)

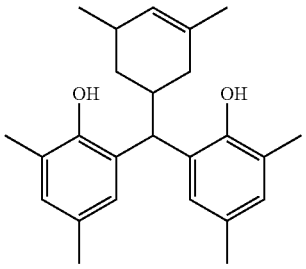

(R-17)

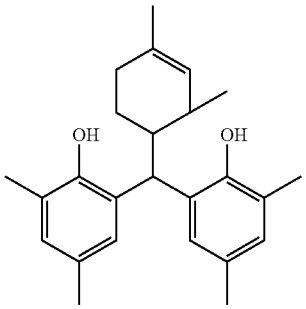

(R-18)

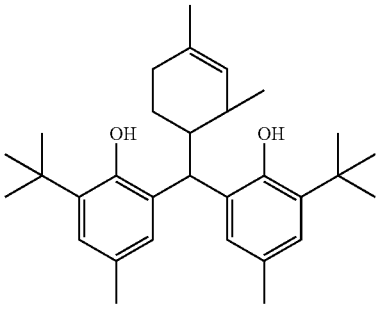

(4) Coating Amount of Reducing Agent

The amount of the reducing agent in the photothermographic material is preferably 0.1 to 3.0 g/m$^2$, more preferably 0.2 to 2.0 g/m$^2$, furthermore preferably 0.3 to 1.0 g/m$^2$. Further, the mol ratio of the reducing agent to silver on the image-forming layer side is preferably 5 to 50 mol %, more preferably 8 to 30 mol %, further preferably 10 to 20 mol %.

The ratio by mol of the amount of the reducing agent contained in the non-photosensitive layer S to the amount of the reducing agent in the image-forming layer is not particularly limited, but preferably from 10:90 to 60:40, more preferably from 20:80 to 40:60.

Only a single reducing agent represented by formula (I) may be used or two or more reducing agents represented by formula (I) may be used, and only a single reducing agent represented by formula (II) may be used or two or more reducing agents represented by formula (II) may be used, if the total amounts of the reducing agents in each layer satisfies the above-mentioned relationship and fall within the above preferable range.

(4) Method of Incorporating Reducing Agent into Coating liquid

The state of the reducing agent in the coating liquid may be any state such as a solution, an emulsion, or a solid particle dispersion.

The emulsion of the reducing agent may be prepared by a well-known emulsifying method. The exemplary method comprises: dissolving the reducing agent in an oil such as dibutyl phthalate, tricresyl phosphate, glyceryl triacetate, or diethylphthalate, optionally using a cosolvent such as ethyl acetate or cyclohexanone; and then mechanically emulsifying the reducing agent.

In an embodiment, the solid particle dispersion is prepared by a method comprising dispersing powder of the reducing agent in an appropriate solvent such as water using a ball mill, a colloid mill, a vibration ball mill, a sand mill, a jet mill, a roll mill, or ultrasonic wave. The solid particle dispersion may be prepared preferably by using a sandmill. A protective colloid (e.g. a polyvinyl alcohol) and/or a surfactant such as an anionic surfactant (e.g. a mixture of sodium triisopropylnaphthalenesulfonates each having a different combination of the substitution positions of the three isopropyl groups) may be used in the preparation. In a preferable embodiment, the aqueous dispersion includes an antiseptic agent such as a benzoisothiazolinone sodium salt.

The reducing agent is particularly preferably used in the state of a solid particle dispersion. The reducing agent is preferably added in the form of fine particles having an average particle size of 0.01 to 10 μm, more preferably 0.05 to 5 μm, further preferably 0.1 to 2 μm. In the invention, the particle sizes of particles in other solid dispersions are preferably in the above range.

(Description of Anti-foggant)

Examples of antifoggants, stabilizers, and stabilizer precursors usable in the invention include compounds disclosed in JP-A No. 10-62899, Paragraph 0070 and EP-A No. 0803764A1, Page 20, Line 57 to Page 21, Line 7; compounds described in JP-A Nos. 9-281637 and 9-329864; and compounds described in U.S. Pat. No. 6,083,681 and EP No. 1048975. The disclosures of the above patent documents are incorporated herein by reference.

(1) Polyhalogen Compound

Organic polyhalogen compounds, which can be preferably used as the antifoggant in the invention, are described in detail below. The antifoggant is particularly preferably an organic polyhalogen compound represented by the following formula (H) since such an organic polyhalogen compound can improve the storability of the unexposed photosensitive material (the unprocessed stock storability), and can suppress the development of fog during storage under high temperature in the dark:

$$Q\text{-}(Y)_n\text{—}C(Z1)(Z2)X. \qquad \text{Formula (H)}$$

In the formula (H), Q represents an alkyl group, an aryl group, or a heterocyclic group, Y represents a divalent linking group, n represents 0 to 1, Z1 and Z2 each independently represent a halogen atom, and X represents a hydrogen atom or an electron-withdrawing group.

In the formula (H), Q represents preferably an alkyl group having 1 to 6 carbon atoms, an aryl group having 6 to 12 carbon atoms, or a heterocyclic group including at least one nitrogen atom such as a pyridyl group and a quinolyl group.

When Q represents an aryl group, the aryl group is preferably a phenyl group substituted by an electron-withdrawing group with a positive Hammett's substituent constant σp. The Hammett's substituent constant is described, for example, in *Journal of Medicinal Chemistry,* 1973, Vol. 16, No. 11, 1207–1216, the disclosure of which is incorporated herein by reference. Examples of such an electron-withdrawing group include halogen atoms, alkyl groups substituted by electron-withdrawing groups, aryl groups substituted by electron-withdrawing groups, heterocyclic groups, alkyl sulfonyl groups, aryl sulfonyl groups, acyl groups, alkoxycarbonyl groups, carbamoyl groups, and sulfamoyl groups. The electron-withdrawing group is preferably a halogen atom, a carbamoyl group, or an arylsulfonyl group, particularly preferably a carbamoyl group.

X represents preferably an electron-withdrawing group. The electron-withdrawing group is preferably a halogen atom, an aliphatic, aryl, or heterocyclyl sulfonyl group, an aliphatic, aryl, or heterocyclyl acyl group, an aliphatic, aryl, or heterocyclyl oxycarbonyl group, a carbamoyl group, or a sulfamoyl group, more preferably a halogen atom or a carbamoyl group, particularly preferably a bromine atom.

Z1 and Z2 each independently represent preferably a bromine atom or an iodine atom, more preferably a bromine atom.

Y represent preferably —C(═O)—, —SO—, —$SO_2$—, —C(═O)N(R)—, or —$SO_2$N(R)—, more preferably —C(═O)—, —$SO_2$—, or —C(═O)N(R)—, particularly preferably —$SO_2$— or —C(═O)N(R)—, in which R represents a hydrogen atom, an aryl group, or an alkyl group, preferably a hydrogen atom or an alkyl group, particularly preferably a hydrogen atom.

In the formula (H), n represents 0 or 1, preferably 1.

In the formula (H), Y represents preferably —C(═O)N(R)— when Q represents an alkyl group, and Y represents preferably —$SO_2$— when Q represents an aryl group or a heterocyclic group.

In an embodiment, the antifoggant is a compound including two or more units represented by the formula (H), wherein each unit is bound to another unit, and a hydrogen atom in the formula (H) is substituted with the bond in each unit. Such a compound is referred to as a bis-, tris-, or tetrakis-type compound.

The compound represented by (H) is preferably substituted by a dissociative group (such as a COOH group, a salt of a COOH group, an $SO_3H$ group, a salt of an $SO_3H$ group, a $PO_3H$ group, or a salt of a $PO_3H$ group); a group containing a quaternary nitrogen cation, such as an ammonium group or a pyridinium group; a polyethyleneoxy group; a hydroxyl group; or the like.

Specific examples of compounds represented by the formula (H) are shown below.

(H-1)

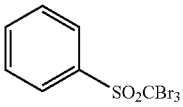

(H-2)

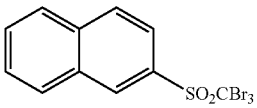

(H-3)

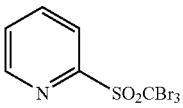

-continued (H-4)

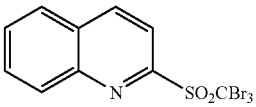

(H-5)

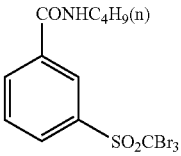

(H-6)

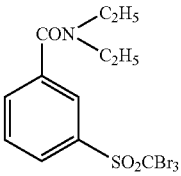

(H-7)

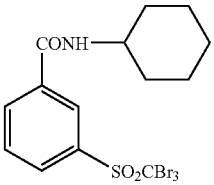

(H-8)

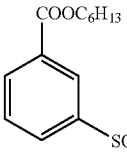

(H-9)

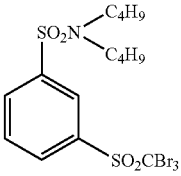

(H-10)

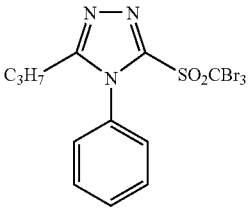

(H-11)

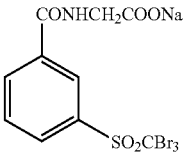

(H-12)

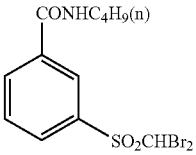

-continued (H-13)

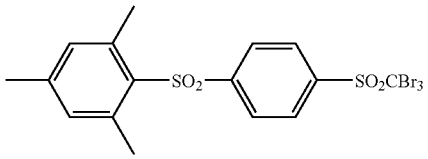

(H-14)

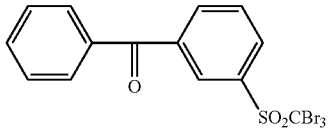

(H-15)

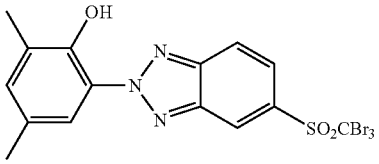

(H-16)

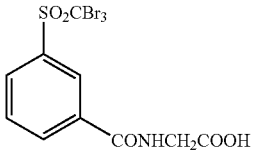

(H-17)

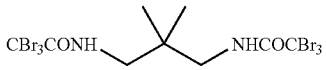

(H-18)

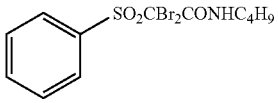

(H-19)

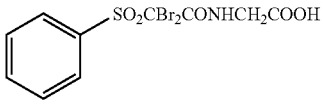

Examples of polyhalogen compounds usable in the invention include, in addition to the above compounds, compounds described in U.S. Pat. Nos. 3,874,946, 4,756,999, 5,340,712, 5,369,000, 5,464,737, and 6,506,548, and JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441, the disclosure of which are incorporated herein by reference. The compounds described in JP-A Nos. 7-2781, 2001-33911, and 2001-312027 are particularly preferred.

The amount of the polyhalogen compound is preferably $10^{-4}$ mol to 1 mol, more preferably $10^{-3}$ mol to 0.5 mol, further preferably mol $10^{-2}$ to 0.2 mol, per 1 mol of the non-photosensitive silver salt.

The antifoggant may be added to the photosensitive material in any of the manners described above as examples of the method of adding the reducing agent. The organic polyhalogen compound is preferably added in the state of a solid particle dispersion.

The polyhalogen compound may be added to any layers on the image-forming layer side. However, the polyhalogen compound is preferably contained in at least the image-forming layer, and more preferably it may be contained in the non-photosensitive layer S and the image-forming layer according to the invention. Because the amount of the polyhalogen compound to be added is determined by the amount of organic silver to be added, the ratio of the content of the polyhalogen compound per organic silver in the non-photosensitive layer S to that in the image-forming layer is preferably from 10 to 50 mass %, more preferably from 20 to 40 mass % when the polyhalogen compound is added to the non-photosensitive layer S according to the invention.

2) Other Anti-foggants

Examples of other antifoggants usable in the invention include mercury (II) salts described in JP-A No. 11-65021, Paragraph 0113; benzoic acid compounds described in JP-A No. 11-65021, Paragraph 0114; salicylic acid derivatives described in JP-A No. 2000-206642; formalin scavenger compounds represented by the formula (S) described in JP-A No. 2000-221634; triazine compounds disclosed in claim 9 of JP-A No. 11-352624; compounds represented by the formula (III) described in JP-A No. 6-11791; and 4-hydroxy-6ethyl-1,3,3a,7-tetrazaindene. The disclosures of the above patent documents are incorporated herein by reference.

The photothermographic materials of the invention may further include an azolium salt for the purpose of preventing the fogging. Examples of the azolium salt include compounds represented by the formula (XI) described in JP-A No. 59-193447; compounds described in JP-B No. 55-12581; and compounds represented by the formula (II) described in JP-A No. 60-153039. The disclosures of the above patent documents are incorporated herein by reference. In an embodiment, the azolium salt is added to a layer on the same side as the image-forming layer. The layer to which the azolium salt may be added is preferably the image-forming layer. However, the azolium salt may be added to any portion of the material. The azolium salt may be added in any step in the preparation of the coating liquid. When the azolium salt is added to the image-forming layer, the azolium salt may be added in any step between the preparation of the organic silver salt and the preparation of the coating liquid. In an embodiment, the azolium salt is added during the period after the preparation of the organic silver salt but before the application of the coating liquid. The azolium salt may be added in the form of powder, a solution, a fine particle dispersion, etc. Further, the azolium salt may be added in the form of a solution which further contains other additives such as sensitizing dyes, reducing agents, and toning agents. The amount of the azolium salt to be added per 1 mol of silver is not particularly limited, and is preferably $1\times10^{-6}$ mol to 2 mol, more preferably $1\times10^{-3}$ mol to 0.5 mol.

(Explanation of Development Accelerator)

The photothermographic material of the invention preferably includes a development accelerator, and preferred examples thereof include sulfonamidephenol compounds represented by the formula (A) described in JP-A Nos. 2000-267222 and 2000-330234; hindered phenol compounds represented by the formula (II) described in JP-A No. 2001-92075; hydrazine compounds represented by the formula (I) described in JP-A Nos. 10-62895 and 11-15116; hydrazine compounds represented by the formula (D) described in JP-A No. 2002-156727; hydrazine compounds represented by the formula (1) described in JP-A No. 2002-278017; phenol compounds and naphthol compounds represented by the formula (2) described in JP-A No. 2001-264929; phenol compounds described in JP-A Nos. 2002-

311533 and 2002-341484; and naphthol compounds described in JP-A No. 2003-66558. The disclosures of the above patent documents are incorporated herein by reference. Naphthol compounds described in JP-A No. 2003-66558 are preferable.

The mol ratio of the development accelerator to the reducing agent is 0.1 to 20 mol %, preferably 0.5 to 10 mol %, more preferably 1 to 5 mol %.

The development accelerator may be added to the photothermographic material in any of the manners described above as examples of the method of adding the reducing agent. The development accelerator is particularly preferably added in the form of a solid dispersion or an emulsion. The emulsion of the development accelerator is preferably a dispersion prepared by emulsifying the development accelerator in a high-boiling-point solvent that is solid at ordinary temperature and a low-boiling-point cosolvent, or a so-called oilless emulsion which includes no high-boiling-point solvents.

In the invention, the hydrazine compounds described in JP-A Nos. 2002-156727 and 2002-278017, and the naphthol compounds described in JP-A No. 2003-66558 are more preferable development accelerators.

In the invention, the development accelerator is particularly preferably a compound represented by the following formula (A-1) or (A-2).

Q1-NHNH-Q2 Formula (A-1);

In the formula (A-1), Q1 represents an aromatic group or a heterocyclic group each of which has a carbon atom bonded to the —NHNH-Q2 group. Q2 represents a carbamoyl group, an acyl group, an alkoxycarbonyl group, an aryloxycarbonyl group, a sulfonyl group, or a sulfamoyl group.

In the formula (A-1), the aromatic group or the heterocyclic group represented by Q1 preferably has a 5- to 7-membered unsaturated ring. Examples of the 5- to 7-membered unsaturated ring include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isoxazole ring, a thiophene ring, and condensed rings thereof.

The ring may have a substituent. When the ring has two or more substituents, they may be the same as each other or different from each other. Examples of the substituents include halogen atoms, alkyl groups, aryl groups, carbonamide groups, alkylsulfonamide groups, arylsulfonamide groups, alkoxy groups, aryloxy groups, alkylthio groups, arylthio groups, carbamoyl groups, sulfamoyl groups, a cyano group, alkylsulfonyl groups, arylsulfonyl groups, alkoxycarbonyl groups, aryloxycarbonyl groups, and acyl groups. These substituents may further have substituents, and preferred examples thereof include halogen atoms, alkyl groups, aryl groups, carbonamide groups, alkylsulfonamide groups, arylsulfonamide groups, alkoxy groups, aryloxy groups, alkylthio groups, arylthio groups, acyl groups, alkoxycarbonyl groups, aryloxycarbonyl groups, carbamoyl groups, a cyano group, sulfamoyl groups, alkylsulfonyl groups, arylsulfonyl groups, and acyloxy groups.

When Q2 represents a carbamoyl group, the carbamoyl group preferably has 1 to 50 carbon atoms, and more preferably has 6 to 40 carbon atoms. Examples of the carbamoyl group include unsubstituted carbamoyl, methylcarbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3(2,4-tert-pentylphenoxy)propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphtylcarbamoyl, N-3-pyridylcarbamoyl, and N-benzylcarbamoyl.

When Q2 represents an acyl group, the acyl group preferably has 1 to 50 carbon atoms, and more preferably has 6 to 40 carbon atoms. Examples of the acyl group include formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl.

When Q2 represents an alkoxycarbonyl group, the alkoxycarbonyl group preferably has 2 to 50 carbon atoms, and more preferably has 6 to 40 carbon atoms. Examples of the alkoxycarbonyl group include methoxycarbonyl, ethoxycarbonyl, isobutyloxycarbonyl, cyclohexyloxycarbonyl, dodecyloxycarbonyl, and benzyloxycarbonyl.

When Q2 represents an aryloxycarbonyl group, the aryloxycarbonyl group preferably has 7 to 50 carbon atoms, and more preferably has 7 to 40 carbon atoms. Examples of the aryloxycarbonyl group include phenoxycarbonyl, 4-octyloxyphenoxycarbonyl, 2-hydroxymethylphenoxycarbonyl, and 4-dodecyloxyphenoxycarbonyl.

When Q2 represents a sulfonyl group, the sulfonyl group preferably has 1 to 50 carbon atoms, and more preferably has 6 to 40 carbon atoms. Examples of the sulfonyl groups include methylsulfonyl, butylsulfonyl, octylsulfonyl, 2-hexadecylsulfonyl, 3-dodecyloxypropylsulfonyl, 2-octyloxy-5-tert-octylphenylsulfonyl, and 4-dodecyloxyphenylsulfonyl.

When Q2 represents a sulfamoyl group, the sulfamoyl group preferably has 0 to 50 carbon atoms, and more preferably has 6 to 40 carbon atoms. Examples of the sulfamoyl group include unsubstituted sulfamoyl, N-ethylsulfamoyl, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N2-tetradecyloxyphenyl)sulfamoyl.

The group represented by Q2 may have a substituent selected from the groups described above as examples of the substituent on the 5- to 7-membered unsaturated ring of Q1. When the group represented by Q2 has two or more substituents, the substituents may be the same as each other or different from each other.

The group represented by Q1 preferably has a 5- or 6-membered unsaturated ring, and more preferably has a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thiazole ring, an oxazole ring, an isothiazole ring, an isoxazole ring, or a condensed ring in which any of the above rings is fused with a benzene ring or an unsaturated heterocycle. Q2 represents preferably a carbamoyl group, particularly preferably a carbamoyl group having a hydrogen atom on the nitrogen atom.

Formula (A-2)

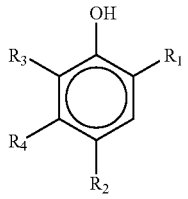

In the formula (A-2), $R_1$ represents an alkyl group, an acyl group, an acylamino group, a sulfonamide group, an alkoxycarbonyl group, or a carbamoyl group. $R_2$ represents a hydrogen atom, a halogen atom, an alkyl group, an alkoxy group, an aryloxy group, an alkylthio group, an arylthio group, an acyloxy group, or a carbonic acid ester group. $R_3$ and $R_4$ each independently represent a substituent which can be bonded to the benzene ring, which may be selected from the substituents described above in the explanation on the formula (A-1). $R_3$ and $R_4$ may combine to form a condensed ring.

$R_1$ represents preferably: an alkyl group having 1 to 20 carbon atoms such as a methyl group, an ethyl group, an isopropyl group, a butyl group, a tert-octyl group, or a cyclohexyl group; an acylamino group such as an acetylamino group, a benzoylamino group, a methylureido group, or a 4-cyanophenylureido group; or a carbamoyl group such as an n-butylcarbamoyl group, an N,N-diethylcarbamoyl group, a phenylcarbamoyl group, a 2-chlorophenylcarbamoyl group, or a 2,4-dichlorophenylcarbamoyl group. $R_1$ represents more preferably an acylamino group, which may be a ureido group or a urethane group. $R_2$ represents preferably: a halogen atom (more preferably a chlorine atom or a bromine atom); an alkoxy group such as a methoxy group, a butoxy group, an n-hexyloxy group, an n-decyloxy group, a cyclohexyloxy group, or a benzyloxy group; or an aryloxy group such as a phenoxy group or a naphthoxy group.

$R_3$ represents preferably a hydrogen atom, a halogen atom, or an alkyl group having 1 to 20 carbon atoms, most preferably a halogen atom. $R_4$ represents preferably a hydrogen atom, an alkyl group, or an acylamino group, more preferably an alkyl group or an acylamino group. Preferred examples of the group represented by $R_3$ or $R_4$ are equal to the above-described examples of the group represented by $R_1$. When $R_4$ represents an acylamino group, $R_4$ and $R_3$ may be bound to each other to form a carbostyryl ring.

When $R_3$ and $R_4$ combine with each other to form a condensed ring in the formula (A-2), the condensed ring is particularly preferably a naphthalene ring. The naphthalene ring may have a substituent selected from the above-described examples of the substituents on the ring of Q1 in the formula (A-1). When the compound represented by the formula (A-2) is a naphthol-based compound, $R_1$ represents preferably a carbamoyl group, particularly preferably a benzoyl group. $R_2$ represents preferably an alkoxy group or an aryloxy group, particularly preferably an alkoxy group.

Preferable examples of the development accelerator are illustrated below without intention of restricting the scope of the present invention.

(A-1)

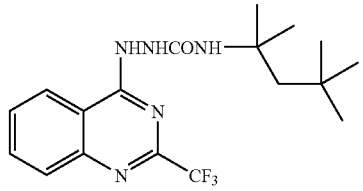

(A-2)

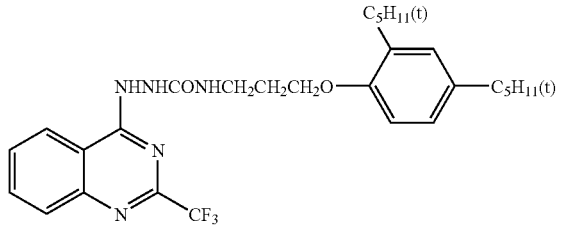

(A_3)

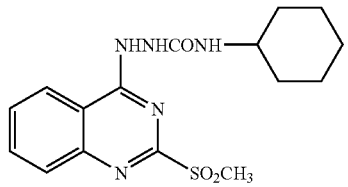

(A-4)

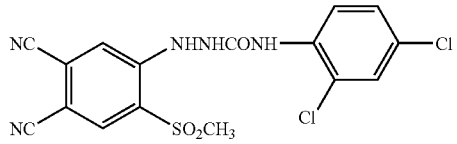

(A-5)

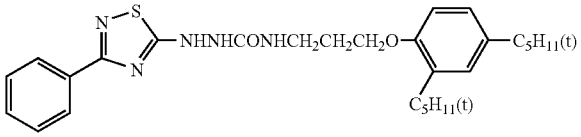

(A-6)

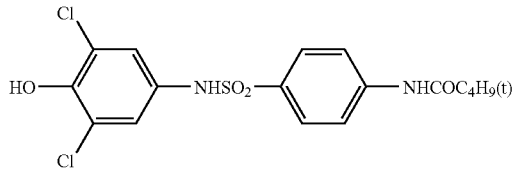

(A-7)

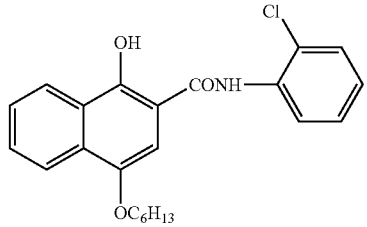

(A-8)

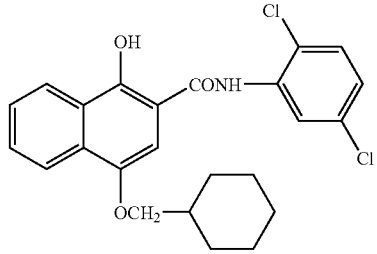

-continued (A-9)

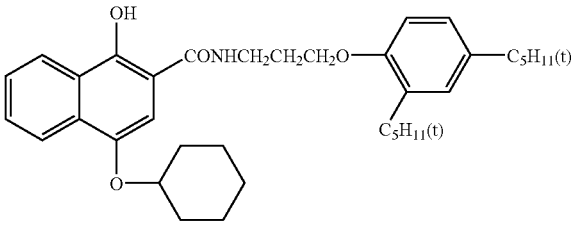

(A-10)

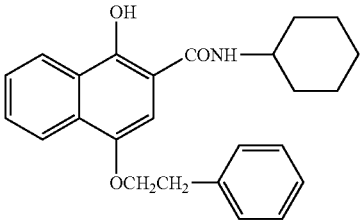

(A-11)

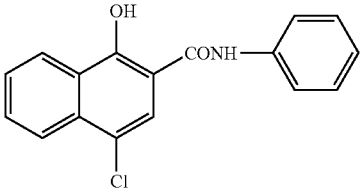

(A-12)

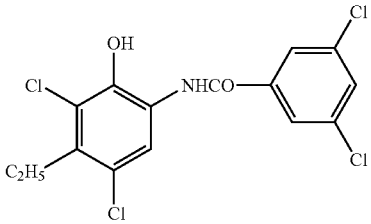

The development accelerator may be added to any layer on the image-forming layer side. In a preferable embodiment, the development acclerator is added to the image-forming layer and/or a layer adjacent to the image-forming layer which may be the non-photosensitive layer S of the invention. In a more preferable embodiment, the development acclerator is added to the image-forming layer.

(Explanation of Hydrogen Bonding Compound)

When the reducing agent has an aromatic hydroxyl group (—OH) or amino group (—NHR, in which R represents a hydrogen atom or an alkyl group), particularly when the reducing agent is the above-mentioned bisphenol compound, it is preferable to use a non-reducing, hydrogen-bonding compound having a group capable of forming a hydrogen bond with the hydroxyl or amino group.

Examples of the group capable of forming a hydrogen bond with the hydroxyl or amino group include phosphoryl groups, sulfoxide groups, sulfonyl groups, carbonyl groups, amide groups, ester groups, urethane groups, ureido groups, tertiary amino groups, and nitrogen-including aromatic groups. The group capable of forming a hydrogen bond with the hydroxyl or amino group is preferably a phosphoryl group; a sulfoxide group; an amide group having no >N—H groups, but the nitrogen atom being blocked as >N—Ra (in which Ra represents a substituent); an urethane group having no >N—H groups, the nitrogen atom being blocked as >N—Ra (in which Ra represents a substituent); and an ureido group having no >N—H group, but the nitrogen atom being blocked as >N—Ra (in which Ra represents a substituent).

The hydrogen-bonding compound used in the invention is particularly preferably a compound represented by the following formula (D):

Formula (D)

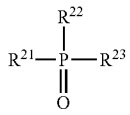

In the formula (D), $R^{21}$ to $R^{23}$ each independently represent an alkyl group, an aryl group, an alkoxy group, an aryloxy group, an amino group, or a heterocyclic group. These groups each may be unsubstituted or substituted.

When any of $R^{21}$ to $R^{23}$ has a substituent, examples of the substituent include halogen atoms, alkyl groups, aryl groups, alkoxy groups, amino groups, acyl groups, acylamino groups, alkylthio groups, arylthio groups, sulfonamide groups, acyloxy groups, oxycarbonyl groups, carbamoyl groups, sulfamoyl groups, sulfonyl groups, and phosphoryl groups. Preferred substituents are alkyl groups and aryl groups, and specific examples thereof include a methyl group, an ethyl group, an isopropyl group, a t-butyl group, a t-octyl group, a phenyl group, 4-alkoxyphenyl groups, and 4-acyloxyphenyl groups.

When any of $R^{21}$ to $R^{23}$ represents an alkyl group, examples thereof include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenethyl group, and a 2-phenoxypropyl group.

When any of $R^{21}$ to $R^{23}$ represents an aryl group, examples thereof include a phenyl group, a cresyl group, a xylyl group, a naphtyl group, a 4-t-butylphenyl group, a 4-t-octylphenyl group, a 4-anisidyl group, and a 3,5-dichlorophenyl group.

When any of $R^{21}$ to $R^{23}$ represents an alkoxy group, examples thereof include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, and a benzyloxy group.

When any of $R^{21}$ to $R^{23}$ represents an aryloxy group, examples thereof include a phenoxy group, a cresyloxy group, an isopropylphenoxy group, a 4-t-butylphenoxy group, a naphthoxy group, and a biphenyloxy group.

When any of $R^{21}$ to $R^{23}$ represents an amino group, examples thereof include a dimethylamino group, a diethylamino group, a dibutylamino group, a dioctylamino group, an N-methyl-N-hexylamino group, a dicyclohexylamino group, a diphenylamino group, and an N-methyl-phenylamino group.

$R^{21}$ to $R^{23}$ are each preferably an alkyl group, an aryl group, an alkoxy group, or an aryloxy group. In order to obtain the effects of the invention, in a preferable embodiment, at least one of $R^{21}$ to $R^{23}$ represents an alkyl group or an aryl group. In a more preferable embodiment, two or more of $R^{21}$ to $R^{23}$ represent groups selected from alkyl groups and aryl groups. Further, it is preferable to use a compound represented by the formula (D) in which $R^{21}$ to $R^{23}$ represent the same groups, from the viewpoint of reducing the cost.

Specific examples of the hydrogen-bonding compound (such as a compound represented by the formula (D)) are illustrated below without intention of restricting the scope of the present invention.
(D-1)
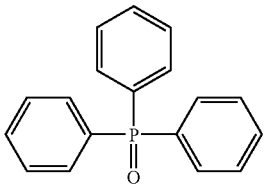
(D-2)
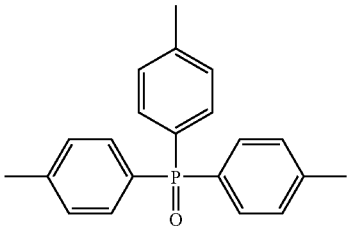
(D-3)
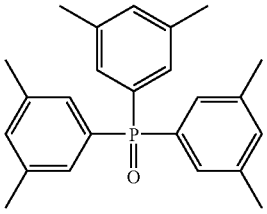
(D-4)
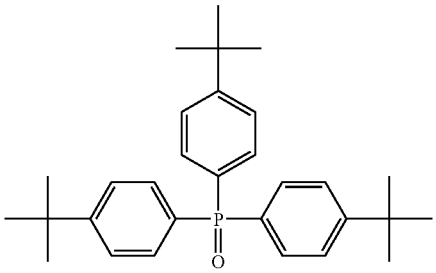
(D-5)
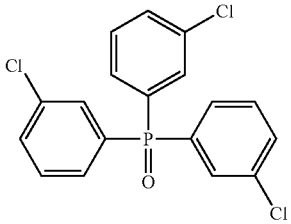
(D-6)
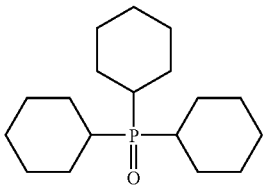
-continued
(D-7)
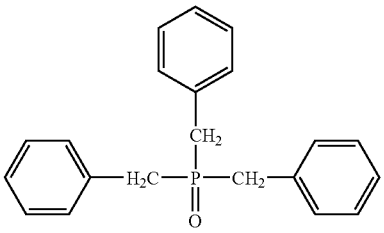
(D-8)
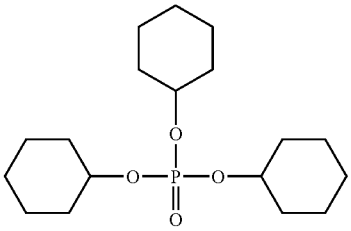
(D-9)
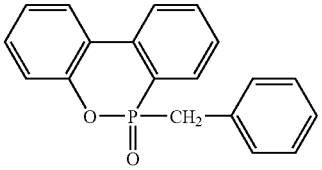
(D-10)
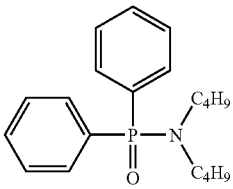
(D-11)
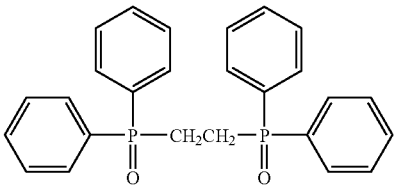
(D-12)
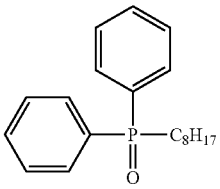
(D-13)
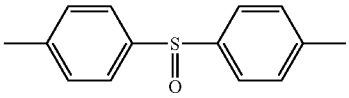
(D-14)
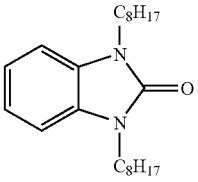

-continued (D-15)

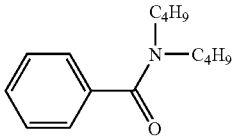

Specific examples of the hydrogen-bonding compound further include compounds disclosed in EP No. 1096310, and JP-A Nos. 2002-156727 and 2002-318431, the disclosures of which are incorporated by reference herein.

The compound of the formula (D) may be added to the coating liquid and used in the photothermographic material in the form of a solution, an emulsion, or a solid particle dispersion. The specific manner of producing the solution, emulsion, or solid particle dispersion may be the same as in the case of the reducing agent. The compound is preferably used in the form of a solid dispersion. The hydrogen-bonding compound forms a hydrogen-bond complex with the reducing agent having a phenolic hydroxyl group or an amino group in the solution. The complex can be isolated as a crystal depending on the combination of the reducing agent and the compound of the formula (D).

It is particularly preferable to use the powder of the isolated crystal to form a solid particle dispersion, from the viewpoint of achieving stable performances. In a preferable embodiment, powder of the reducing agent and powder of the compound of the formula (D) are mixed, and then the mixture is dispersed in the presence of a dispersing agent by a sand grinder mill, etc., thereby forming the complex in the dispersing process.

The mole ratio of the compound represented by the formula (D) to the reducing agent is preferably 1 to 200 mol %, more preferably 10 to 150 mol %, further preferably 20 to 100 mol %.

(Silver Halide)

1) Halogen Composition

The halogen composition of the photosensitive silver halide used in the invention is not particularly restricted, and may be silver chloride, silver chlorobromide, silver bromide, silver iodobromide, silver iodochlorobromide, or silver iodide. Among them, silver bromide, silver iodobromide, and silver iodide are preferable. In a grain of the photosensitive silver halide, the halogen composition may be uniform in the entire grain, or may vary stepwise or steplessly. In an embodiment, the photosensitive silver halide grain has a core-shell structure. The core-shell structure is preferably a 2- to 5-layered structure, more preferably a 2- to 4-layered structure. It is also preferable to employ techniques for localizing silver bromide or silver iodide on the surface of the grain of silver chloride, silver bromide, or silver chlorobromide.

In a photothermographic material having image forming layers on both sides, silver halide with a high silver iodide content is preferred. From the viewpoint of the image storage stability to light irradiation after develpoment, the silver iodide content in the silver halide is preferably 40 mol % to 100 mol %, more preferably 70 mol % to 100 mol %, further preferably 80 mol % to 100 mol %, particular preferably 90 mol % to 100 mol %.

2) Method of Forming a Photosensitive Silver Halide Grain

Methods of forming the photosensitive silver halide grain are well known in the field. For example, the methods described in *Research Disclosure*, No. 17029, June 1978 (the disclosure of which is incorporated by reference) and U.S. Pat. No. 3,700,458 (the disclosure of which is incorporated by reference) may be used in the invention. In an embodiment, the photosensitive silver halide grains are prepared by: adding a silver source and a halogen source to a solution of gelatin or another polymer to form a photosensitive silver halide; and then mixing the silver halide with an organic silver salt. The method disclosed in the following documents are also preferable: JP-A No. 11-119374, Paragraph 0217 to 0224, and JP-A Nos. 11-352627 and 2000-347335, the disclosure of which are incorporated by reference herein.

3) Grain Size

The grain size of the photosensitive silver halide grain is preferably small so as to suppress the clouding after image formation. Specifically, the grain size is preferably 0.20 μm or smaller, more preferably 0.01 μm to 0.15 μm, further preferably 0.02 μm to 0.12 μm. The grain size of the photosensitive silver halide grain is the average diameter of the circle having the same area as the projected area of the grain; in the case of tabular grain, the projected area refers to the projected area of the principal plane.

In the photothermographic material having image forming layers on both sides, the grain size may be sufficiently large so as to achieve high sensitivity. In this case, the average sphere equivalent diameter of silver halide is preferably 0.3 μm to 5.0 μm, and further preferably 0.35 Jim to 3.0 μm.

If the type of silver halide is the same, larger grains have higher sensitivity.

4) Shape of Photosensitive Silver Halide Grain

The photosensitive silver halide grain may be a cuboidal grain, an octahedral grain, a tabular grain, a spherical grain, a rod-shaped grain, a potato-like grain, etc. In the invention, the cuboidal grain is preferable. Silver halide grains with roundish corners are also preferable. The face index (Miller index) of the outer surface plane of the photosensitive silver halide grain is not particularly limited. In a preferable embodiment, the silver halide grains have a high proportion of {100} faces; a spectrally sensitizing dye adsorbed to the {100} faces exhibits a higher spectral sensitization efficiency. The proportion of the {100} faces is preferably 50% or higher, more preferably 65% or higher, further preferably 80% or higher. The proportion of the {100} faces according to the Miller indices can be determined by a method described in T. Tani, *J. Imaging Sci.*, 29, 165 (1985) (the disclosure of which is incorporated herein by reference) using adsorption dependency between {111} faces and {100} faces upon adsorption of a sensitizing dye.

A silver halide having a high silver iodide content, which may be preferably used for photothermographic materials each having image forming layers on both sides, can take complex forms. Examples of grains having preferable forms include combined grains shown in p. 164, FIG. 1 of R. L. JENKINS et al., *J. of Phot. Sci.* Vol. 28 (1980, the disclosure of which is incorporated herein by reference in its entirety), and tabular grains shown in FIG. 1 of the same journal. In a preferable embodiment, the proportion of tabular photosensitive silver halide grains with an aspect ratio of 2 or higher is 50% or higher in terms of the projection area. In another preferable embodiment, the proportion of tabular photosensitive silver halide grains with an aspect ratio of 3 to 20 is 50% or higher in terms of the projection area.

5) Heavy Metal

The photosensitive silver halide grain used in the invention may include a metal selected from the metals of Groups 8 to 10 of the Periodic Table of Elements (having Groups 1 to 18) or a complex thereof. When the photosensitive silver halide grain includes a metal selected from the metals of Groups 8 to 10 of the Periodic Table of Elements or a metal complex containing a metal selected from the metals of Groups 8 to 10 as the central metal, the metal or the central metal is preferably rhodium, ruthenium, or iridium. The metal complex may be used singly or in combination with another complex including the same or different metal. The amount of the metal or the metal complex is preferably $1\times10^{-9}$ mol to $1\times10^{-3}$ mol per 1 mol of silver. The heavy metals, the metal complexes, and methods of adding them are described, for example, in JP-A No. 7-225449, JP-A No. 11-65021, Paragraph 0018 to 0024, and JP-A No. 11-119374, Paragraph 0227 to 0240, the disclosures of which are incorporated by reference herein.

In the invention, the silver halide grain is preferably a silver halide grain having a hexacyano metal complex on its outer surface. Examples of the hexacyano metal complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. The hexacyano metal complex is preferably a hexacyano Fe complex.

The counter cation of the hexacyano metal complex is not important because the hexacyano metal complex exists as an ion in an aqueous solution. The counter cation is preferably a cation which is highly miscible with water and suitable for precipitating the silver halide emulsion; examples thereof include: alkaline metal ions such as a sodium ion, a potassium ion, a rubidium ion, a cesium ion, and a lithium ion; and ammonium and alkylammonium ions such as a tetramethylammonium ion, a tetraethylammonium ion, a tetrapropylammonium ion, and a tetra-(n-butyl)-ammonium ion.

The hexacyano metal complex may be added in the form of a solution in water, or in a mixed solvent of water and a water-miscible organic solvent (e.g. an alcohol, an ether, a glycol, a ketone, an ester, an amide, etc.), or in a gelatin.

The amount of the hexacyano metal complex to be added is preferably $1\times10^{-5}$ mol to $1\times10^{-2}$ mol per 1 mol of silver, more preferably $1\times10^{-4}$ mol to $1\times10^{-3}$ mol per 1 mol of silver.

In order to allow the hexacyano metal complex to exist on the outer surface of the silver halide grains, the hexacyano metal complex may be directly added to the silver halide grains after the completion of the addition of an aqueous silver nitrate solution for grain formation but before the chemical sensitization (which may be chalcogen sensitization such as sulfur sensitization, selenium sensitization, or tellurium sensitization or may be noble metal sensitization such as gold sensitization). Specifically, the hexacyano metal complex may be directly added to the silver halide grains before the completion of the preparation step, in the water-washing step, in the dispersion step, or before the chemical sensitization step. It is preferable to add the hexacyano metal complex immediately after grain formation but before the completion of the preparation step so as to prevent excess growth of the silver halide grains.

In an embodiment, the addition of the hexacyano metal complex is started after 96% by mass of the total amount of silver nitrate for the grain formation is added. In a preferable embodiment, the addition is started after 98% by mass of the total amount of silver nitrate is added. In a more preferable embodiment, the addition is started after 99% by mass of the total amount of silver nitrate is added.

When the hexacyano metal complex is added after the addition of the aqueous silver nitrate solution but immediately before the completion of the grain formation, the hexacyano metal complex is adsorbed onto the outer surface of the silver halide grain, and most of the adsorbed hexacyano metal complex forms a hardly-soluble salt with silver ion on the surface. The silver salt of hexacyano iron (II) is less soluble than AgI and thus preventing redissolution of the fine grains, whereby the silver halide grains with a smaller grain size can be produced.

The metal atoms and metal complexes such as $[Fe(CN)_6]^{4-}$ which may be added to the silver halide grains, and the desalination methods and the chemical sensitization methods for the silver halide emulsion are described in JP-A No. 11-84574, Paragraph 0046 to 0050, JP-A No. 11-65021, Paragraph 0025 to 0031, and JP-A No. 11-119374, Paragraph 0242 to 0250, the disclosures of which are incorporated herein by reference.

6) Gelatin

In the invention, the gelatin contained in the photosensitive silver halide emulsion may be selected from varios gelatins. The gelatin has a molecular weight of preferably 10,000 to 1,000,000 so as to maintain excellent dispersion state of the photosensitive silver halide emulsion in the coating liquid including the organic silver salt. Substituents on the gelatin are preferably phthalated. The gelatin may be added during the grain formation or during the dispersing process after the desalting treatment, and is preferably added during the grain formation.

7) Sensitizing Dye

The sensitizing dye used in the invention is a sensitizing dye which can spectrally sensitize the silver halide grains when adsorbed by the grains, so that the sensitivity of the silver halide is heightened in the desired wavelength range. The sensitizing dye may be selected from sensitizing dyes having spectral sensitivities which are suitable for spectral characteristics of the exposure light source. The sensitizing dyes and methods of adding them are described, for example, in JP-A No. 11-65021, Paragraph 0103 to 0109; JP-A No. 10-186572 (the compounds represented by the formula (II)); JP-A No. 11-119374 (the dyes represented by the formula (I) and Paragraph 0106); U.S. Pat. No. 5,510,236; U.S. Pat. No. 3,871,887 (the dyes described in Example 5); JP-A No. 2-96131; JP-A No. 59-48753 (the dyes disclosed therein); EP-A No. 0803764A1, Page 19, Line 38 to Page 20, Line 35; JP-A Nos. 2001-272747, 2001-290238, and 2002-23306, the disclosures of which are incorporated herein by reference. Only a single sensitizing dye may be used or two or more sensitizing dyes may be used. In an embodiment, the sensitizing dye is added to the silver halide emulsion after the desalination but before the coating. In a preferable embodiment, the sensitizing dye is added to the silver halide emulsion after the desalination but before the completion of the chemical ripening.

The amount of the sensitizing dye to be added may be selected in accordance with the sensitivity and the fogging properties, and is preferably $10^{-6}$ mol to 1 mol per 1 mol of the silver halide in the image-forming layer, more preferably $10^{-4}$ mol to $10^{-1}$ mol per 1 mol of the silver halide in the image-forming layer.

In the invention, a super-sensitizer may be used in order to increase the spectral sensitization efficiency. Examples of the super-sensitizer include compounds described in EP-A No. 587,338, U.S. Pat. Nos. 3,877,943 and 4,873,184, JP-A Nos. 5-341432, 11-109547, and 10-111543, the disclosures of which are incorporated herein by reference.

8) Chemical Sensitization

In a preferable embodiment, the photosensitive silver halide grains are chemically sensitized by methods selected from the sulfur sensitization method, the selenium sensitization method, and the tellurium sensitization method. Known compounds such as the compounds described in JP-A No. 7-128768 (the disclosure of which is incorporated herein by reference) may be used in the sulfur sensitization method, the selenium sensitization method, and the tellurium sensitization method. In the invention, the tellurium sensitization is preferred, and it is preferable to use a compound or compounds selected from the compounds described in JP-A No. 11-65021, Paragraph 0030 and compounds represented by the formula (II), (III), or (IV) described in JP-A No. 5-313284, the disclosures of which are incorporated by reference herein.

In a preferable embodiment, the photosensitive silver halide grains are chemically sensitized by the gold sensitization method, which may be conducted alone or in combination with the chalcogen sensitization. The gold sensitization method preferably uses a gold sensitizer having a gold atom with the valence of +1 or +3. The gold sensitizer is preferably a common gold compound. Typical examples of the gold sensitizer include chloroauric acid, bromoauric acid, potassium chloroaurate, potassium bromoaurate, auric trichloride, potassium auricthiocyanate, potassium iodoaurate, tetracyanoauric acid, ammonium aurothiocyanate, and pyridyltrichloro gold. Further, the gold sensitizers described in U.S. Pat. No. 5,858,637 and JP-A No. 2002-278016 (the disclosures of which are incorporated herein by reference) are also preferable in the invention.

In the invention, the chemical sensitization may be carried out at any time between grain formation and coating. The chemical sensitization may be carried out after desalination, for example, (1) before spectral sensitization, (2) during spectral sensitization, (3) after spectral sensitization, or (4) immediately before coating.

The amounts of the sulfur, selenium, or tellurium sensitizer may be changed in accordance with the kind of the silver halide grains, the chemical ripening condition, and the like, and is generally $10^{-8}$ mol to $10^{-2}$ mol per 1 mol of the silver halide, preferably $10^{-7}$ mol to $10^{-3}$ mol per 1 mol of the silver halide.

The amount of the gold sensitizer to be added may be selected in accordance with the conditions, and is preferably $10^{-7}$ mol to $10^{-3}$ mol per 1 mol of the silver halide, more preferably $10^{-6}$ mol to $5\times10^{-4}$ mol per 1 mol of the silver halide.

The conditions for the chemical sensitization are not particularly restricted and are generally conditions in which pH is 5 to 8, pAg is 6 to 11, and temperature is 40 to 95° C.

A thiosulfonic acid compound may be added to the silver halide emulsion by a method described in EP-A No. 293,917, the disclosure of which is incorporated by reference herein.

In the invention, the photosensitive silver halide grains may be subjected to reduction sensitization using a reduction sensitizer. The reduction sensitizer is preferably selected from ascorbic acid, aminoiminomethanesulfinic acid, stannous chloride, hydrazine derivatives, borane compounds, silane compounds, and polyamine compounds. The reduction sensitizer may be added at any time between crystal growth and coating in the preparation of the photosensitive emulsion. It is also preferable to ripen the emulsion while maintaining the pH value of the emulsion at 7 or higher and/or maintaining the pAg value at 8.3 or lower, so as to reduction sensitize the photosensitive emulsion. Further, it is also preferable to conduct reduction sensitization by introducing a single addition part of a silver ion during grain formation.

9) Compound Whose One-Electron Oxidized Form Formed by One-Electron Oxidation Can Release One or More Electron(s)

The photothermographic material of the invention preferably comprises a compound whose one-electron oxidized form formed by one-electron oxidation can release one or more electron(s). The compound may be used alone or in combination with the above-mentioned chemical sensitizers, thereby heightening the sensitivity of the silver halide.

The compound whose one-electron oxidized form formed by one-electron oxidation can release one or more electron(s) is the following compound of Type 1 or 2.

(Type 1) a compound whose one-electron oxidized form formed by one-electron oxidation can release one or more electron(s) through a subsequent bond cleavage reaction.

(Type 2) a compound whose one-electron oxidized form formed by one-electron oxidation can release one or more electron(s) through a subsequent bond formation.

The compound of Type 1 is described first.

Specific examples of the compound of Type 1 include compounds described as a one-photon two-electron sensitizer or a deprotonating electron donating sensitizer in JP-A No. 9-211769 (Compounds PMT-1 to S-37 described in Tables E and F in Pages 28 to 32); JP-A No. 9-211774; JP-A No. 11-95355 (Compounds INV 1 to 36); Japanese Patent Application National Publication Laid-Open No. 2001-500996 (Compounds 1 to 74, 80 to 87, and 92 to 122); U.S. Pat. Nos. 5,747,235, and 5,747,236; EP No. 786692A1 (Compounds INV 1 to 35); EP No. 893732A1; U.S. Pat. Nos. 6,054,260, and 5,994,051; the disclosures of which are incorporated by reference herein. Preferred embodiments of the compounds are also described in the patent documents.

Further, examples of the compounds of Type 1 include compounds represented by the following formula (1) (equivalent to the formula (1) described in JP-A No. 2003-114487); compounds represented by the following formula (2) (equivalent to the formula (2) described in JP-A No. 2003-114487); compounds represented by the following formula (3) (equivalent to the formula (1) described in JP-A No. 2003-114488); compounds represented by the following formula (4) (equivalent to the formula (2) described in JP-A No. 2003-114488); compounds represented by the following formula (5) (equivalent to the formula (3) described in JP-A No. 2003-114488); compounds represented by the following formula (6) (equivalent to the formula (1) described in JP-A No. 2003-75950); compounds represented by the following formula (7) (equivalent to the formula (2) described in JP-A No. 2003-75950); compounds represented by the following formula (8) (equivalent to the formula (1) described in JP-A No. 2004-239943); and compounds represented by the following formula (9) (equivalent to the formula (3) described in JP-A No. 2004-245929) which can undergo a reaction represented by the following chemical reaction formula (1) (equivalent to the chemical reaction formula (1) described in JP-A No. 2004-245929). The disclosures of the above patent documents are incorporated by reference herein. Preferred embodiments of the compounds are described in the patent documents.

Formula (1)

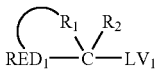

Formula (2)

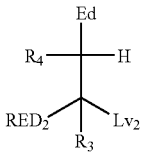

In formulae (1) and (2), $RED_1$ and $RED_2$ each independently represent a reducing group; $R_1$ represents a non-metal atomic group capable of forming, together with the carbon atom (C) and $RED_1$, a cyclic structure corresponding to a tetrahydro form or a hexahydro form of a 5-membered or 6-membered aromatic ring (including aromatic heterocyclic ring); $R_2$, $R_3$ and $R_4$ each independently represent a hydrogen atom or a substituent; $Lv_1$ and $Lv_2$ each independently represent a leaving group; and ED represents an electron donating group.

Formula (3)

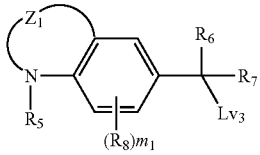

Formula (4)

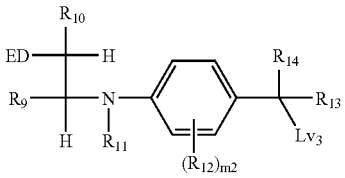

Formula (5)

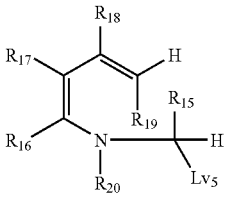

In formulae (3), (4) and (5), $Z_1$ represents an atomic group capable of forming a 6-membered ring together with a nitrogen atom and two carbon atoms of the benzene ring; $R_5$, $R_6$, $R_7$, $R_9$, $R_{10}$, $R_{11}$, $R_{13}$, $R_{14}$, $R_{15}$, $R_{16}$, $R_{17}$, $R_{18}$ and $R_{19}$ each independently represent a hydrogen atom or a substituent; $R_{20}$ represents a hydrogen atom or a substituent; $R_{16}$ and $R_{17}$ are joined to each other to form an aromatic ring or aromatic heterocyclic ring if $R_{20}$ represents a group other than an aryl group; $R_8$ and $R_{12}$ each independently represent a substituent which can be bonded to the benzene ring; m1 represents an integer of 0 to 3; m2 represents an integer of 0 to 4; and $Lv_3$, $Lv_4$ and $Lv_5$ each independently represent a leaving group.

Formula (6)

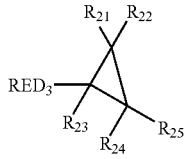

Formula (7)

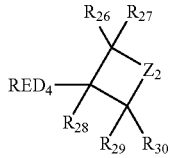

In formulae (6) and (7), $RED_3$ and $RED_4$ each independently represent a reducing group; $R_{21}$ to $R_{30}$ each independently represent a hydrogen atom or a substituent; $Z_2$ represents $—CR_{111}R_{112}—$, $—NR_{113}—$, or —O—; $R_{111}$ and $R_{112}$ each independently represent a hydrogen atom or a substituent; and $R_{113}$ represents a hydrogen atom, alkyl group, aryl group or heterocyclic group.

Formula (8)

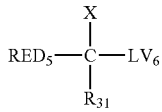

In formula (8), $RED_5$ is a reducing group which is an aryl amino group or a heterocyclic amino group; $R_{31}$ represents a hydrogen atom or a substituent; X represents an alkoxy group, an aryloxy group, a heterocyclyloxy group, an alkylthio group, an arylthio group, a heterocyclicthio group, an alkylamino group, an arylamino group, or a heterocyclic amino group. $Lv_6$ is a leaving group which is selected from a carboxyl group, salts thereof, and a hydrogen atom.

Chemical reaction formula (1)

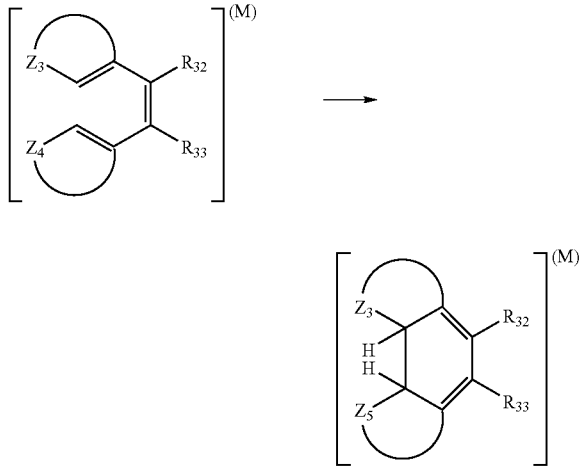

-continued

Formula (9)

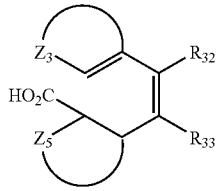

The compound represented by formula (9) is a compound undergoing bond formation reaction represented by the chemical reaction formula (1) by being further oxidized after 2-electron oxidation accompanied by decarbonation. In the chemical reaction formula (1), $R_{32}$ and $R_{33}$ each independently represent a hydrogen atom or a substituent; $Z_3$ represents a group forming a 5-membered or 6-membered heterocyclic ring together with C═C; $Z_4$ represents a group forming a 5-membered or 6-membered aryl or heterocyclic group together with C═C; and M represents a radical, a radical cation or a cation. In formula (9), $R_{32}$, $R_{33}$, and $Z_3$ have the same definitions as in the chemical reaction formula (1), $Z_5$ represents a group forming a 5-membered or 6-membered cycloaliphatic hydrocarbon or heterocyclic group, together with C—C.

Then the type 2 compound is to be described.

Examples of the compounds of Type 2 include compounds represented by the following formula (10) (equivalent to the formula (1) described in JP-A No. 2003-140287), and compounds represented by the following formula (11) (equivalent to the formula (2) described in JP-A No. 2004-245929) which can undergo a reaction represented by the following chemical reaction formula (1) (equivalent to the chemical reaction formula (1) described in JP-A No. 2004-245929). Preferred embodiments of the compounds are described in the patent documents.

$RED_6$-Q-Y Formula (10)

In formula (10), $RED_6$ represents a reducing group which is to be subjected to one-electron oxidation; Y represents a reaction group including a carbon-carbon double bond site, a carbon-carbon triple bond site, an aromatic group site, or a non-aromatic heterocyclic site condensed with a benzene ring; the reaction group represented by Y can react with a one-electron oxidized form generated by one-electron oxidation of $RED_6$ to form a new bond; and Q represents a connection group connecting $RED_6$ and Y.

Chemical reaction formula (1)

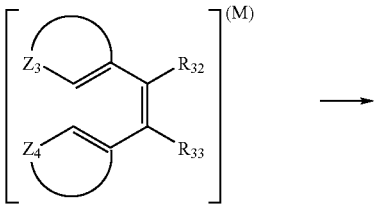

-continued

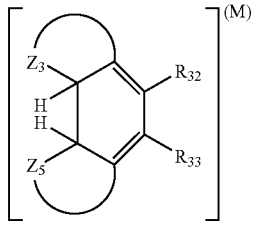

Formula (11)

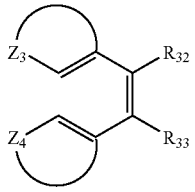

The compound represented by formula (11) is a compound causing a bond-formation reaction represented by the chemical reaction formula (1) upon oxidation. In the chemical reaction formula (1), $R_{32}$ and $R_{33}$ each independently represent a hydrogen atom or a substituent; $Z_3$ represents a group forming, together with C═C, a 5-membered or 6-membered heterocyclic group; $Z_4$ represents a group forming a 5-membered or 6-membered aryl or hetercyclic group together with C═C; $Z_5$ represents a group forming a 5-membered or 6-membered cycloaliphatic hydrocarbon or heterocyclic group together with C—C; and M represents a radical, a radical cation or a cation. In formula (11), $R_{32}$, $R_{33}$, $Z_3$, and $Z_4$ have the same definitions as in the chemical reaction (1).

The compound of Type 1 or 2 preferably has a group which can adsorb silver halide, or a spectrally sensitizing dye moiety. Typical examples of the group which can adsorb silver halide include groups described in JP-A No. 2003-156823, Page 16, Right column, Line 1 to Page 17, Right column, Line 12, disclosure of which is incorporated by reference herein. The spectrally sensitizing dye moiety has a structure described in JP-A No. 2003-156823, Page 17, Right column, Line 34 to Page 18, Left column, Line 6, disclosure of which is incorporated by reference herein.

The compound of Type 1 or 2 is more preferably a compound having a group which can adsorb silver halide, and furthermore preferably has a compound having two or more groups which can adsorb silver halide. When the compound has two or more groups which can adsorb silver halide, the groups may be the same as each other or different from each other.

Preferable examples of the group which can adsorb silver halide include mercapto-substituted, nitrogen-including, heterocyclic groups (e.g., a 2-mercaptothiadiazole group, a 3-mercapto-1,2,4-triazole group, a 5-mercaptotetrazole group, a 2mercapto-1,3,4-oxadiazole group, a 2-mercaptobenzoxazole group, a 2-mercaptobenzthiazole group, a 1,5-dimethyl-1,2,4-triazolium-3-thiolate group, etc.), and nitrogen including heterocyclic groups each having an —NH— group capable of forming a silver imide (>NAg) as a moiety of the heterocycle (e.g., a benzotriazole group, a benzimidazole group, an indazole group, etc.) Particularly preferred among them are a 5-mercaptotetrazole group, a 3-mercapto-1,2,4-triazole group, and a benzotriazole group, and most preferred are a 3-mercapto-1,2,4-triazole group and a 5-mercaptotetrazole group.

In a preferable embodiment, the compound of Type 1 or 2 is a compound having a group which can adsorb silver halide, the group having two or more mercapto groups. Each mercapto group (—SH) may be converted to a thione group when it can be tautomerized. The group which can adsorb silver halide and has two or more mercapto groups may be a dimercapto-substituted, nitrogen-including, heterocyclic group, etc., and preferred examples thereof include a 2,4-dimercaptopyrinmidine group, a 2,4-dimercaptotriazine group, and a 3,5-dimercapto-1,2,4triazole group.

The group which can adsorb silver may be a quaternary salt group of nitrogen or phosphorus. Specifically, the quaternary nitrogen salt group may comprise: an ammonio group such as a trialkylammonio group, a dialkyl-aryl (or heteroaryl)-ammonio group or an alkyl-diaryl (or diheteroaryl)-ammonio group; or a heterocyclic group containing a quaternary nitrogen. The quaternary phosphorus salt group may comprise a phosphonio group such as a trialkylphosphonio group, a dialkylaryl (or heteroaryl)-phosphonio group, an alkyl-diaryl (or diheteroaryl)-phosphonio group, or a triaryl (or triheteroaryl)-phosphonio group. The quaternary salt group is more preferably a quaternary nitrogen salt group, further preferably an aromatic, quaternary-nitrogen-containing, heterocyclic group having a 5- or 6-membered ring structure, particularly preferably a pyridinio group, a quinolinio group, or a isoquinolinio group. The quaternary-nitrogen-containing heterocyclic groups may have a substituent.

Examples of the counter anion of the quaternary salt group include halogen ions, a carboxylate ion, a sulfonate ion, a sulfate ion, a perchlorate ion, a carbonate ion, a nitrate ion, $BF_4^-$, $PF_6^-$, and $Ph_4B^-$. When the compound has a group with a negative charge such as a carboxylate group, the quaternary salt may be formed within the molecule. Examples of preferred counter anions other than the internal anions include a chlorine ion, a bromine ion, and a methanesulfonate ion.

When the compound of Type 1 or 2 has a quaternary nitrogen or phosphorus salt group as the group which can adsorb silver halide, the compound is preferably a compound represented by the following formula (X):

$$(P\text{-}Q1\text{-})_i\text{-}R(\text{-}Q2\text{-}S)_j. \qquad \text{Formula (X)}$$

In the formula (X), P and R each independently represent a quaternary nitrogen or phosphorus salt group which is not the sensitizing dye moiety. Q1 and Q2 each independently represent a linking group which may be selected from a single bond, an alkylene group, an arylene group, a heterocyclic group, —O—, —S—, —$NR_N$—, —C(=O)—, —$SO_2$—, —SO—, —P(=O)—, or a combination thereof. $R_N$ represents a hydrogen atom, an alkyl group, an aryl group, or a heterocyclic group. S represents a residue obtained by removing an atom from a compound of Type 1 or 2. i and j each independently represent an integer of 1 or larger, the sum of i and j being 2 to 6. In an embodiment, i represents 1 to 3 and j represents 1 to 2. In a preferable embodiment, i represents 1 or 2 and j represents 1. In a more preferable embodiment, i represents 1 and j represents 1. The compound represented by the formula (X) preferably has 10 to 100 carbon atoms. The carbon number of the compound is more preferably 10 to 70, further preferably 11 to 60, particularly preferably 12 to 50.

Specific examples for the compounds represented by type 1 and type 2 are set forth below but the invention is not restricted to them.

1

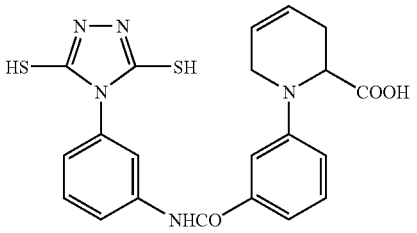

2

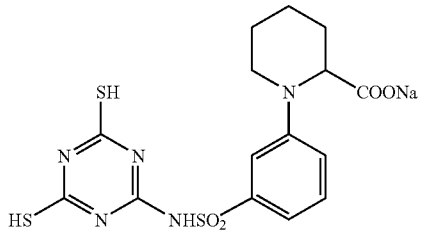

3

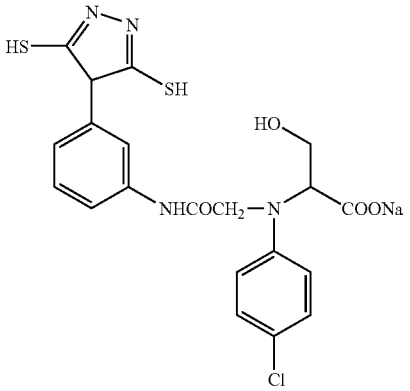

4

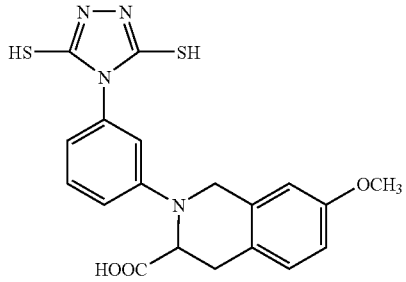

-continued
5
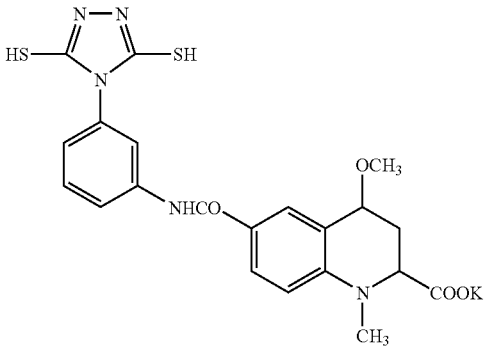
6
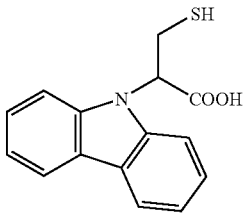
7
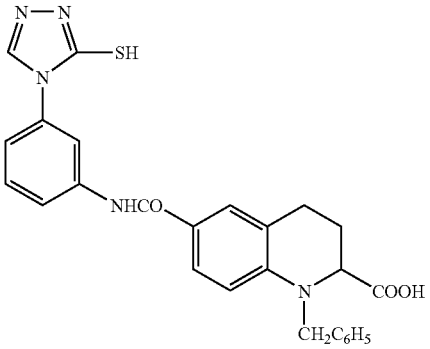
8
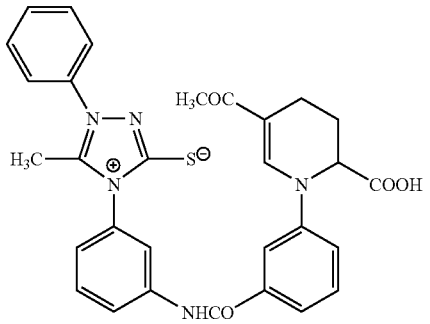
9
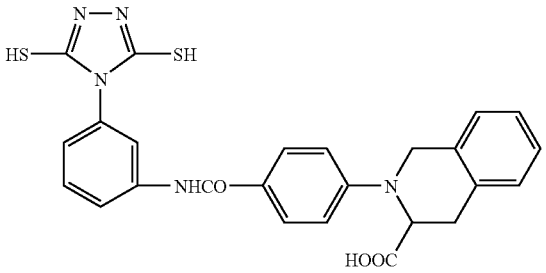
10
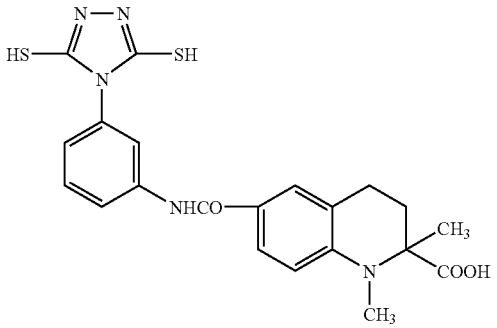
11
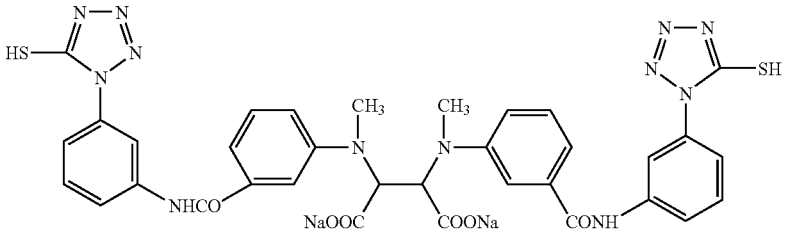
12
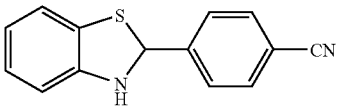
13
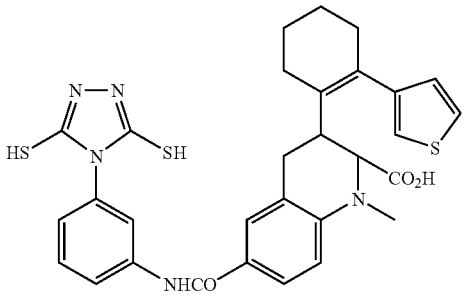

-continued
14
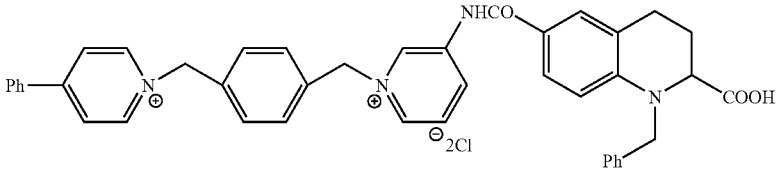
15
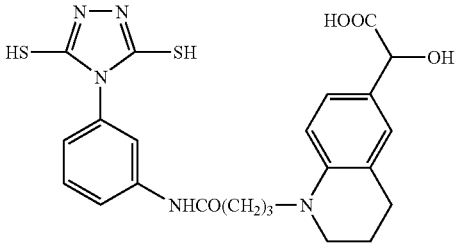
16
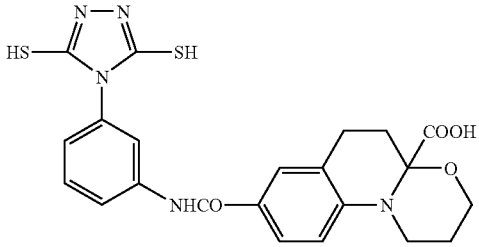
17
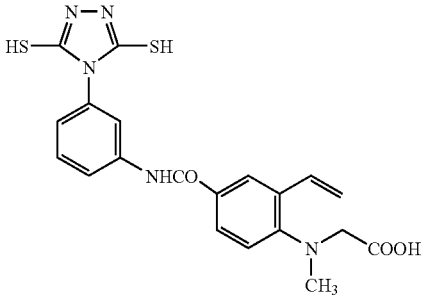
18
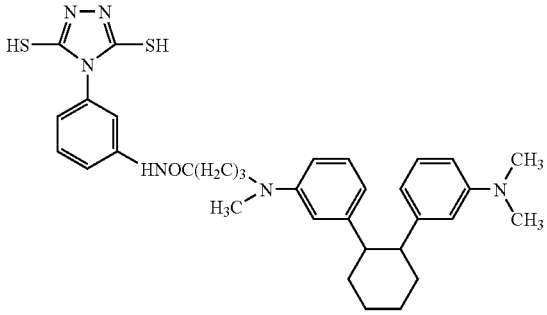
19
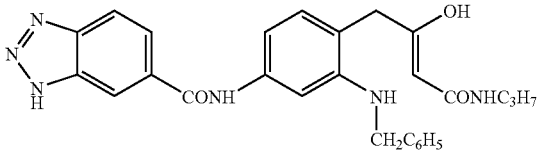
20
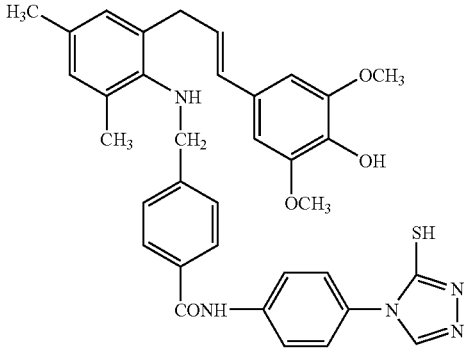
21
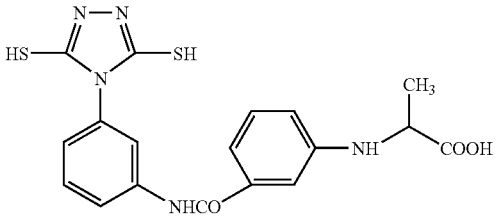
22
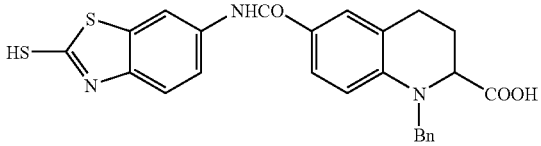

-continued
23
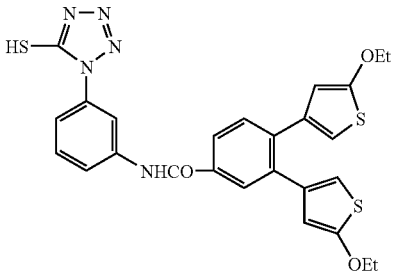
24
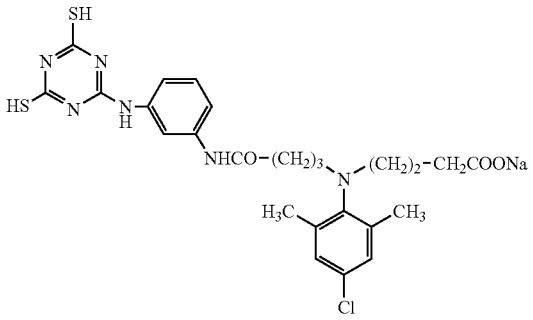
25
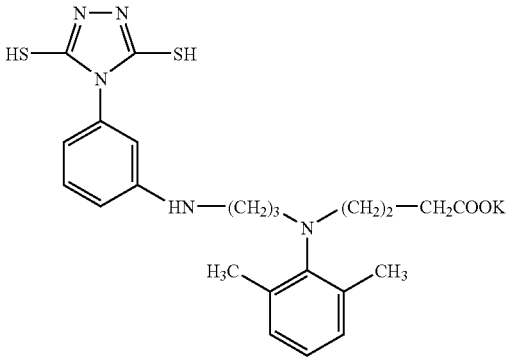
26
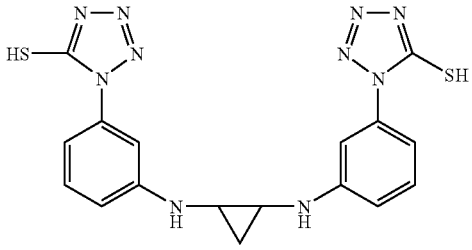
27
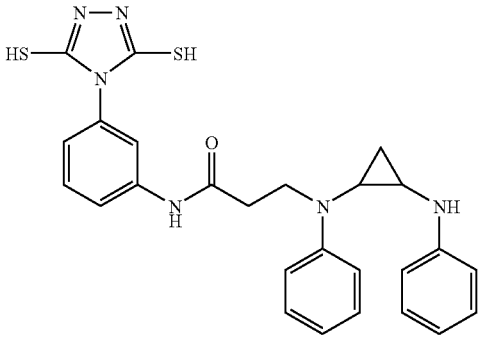
28
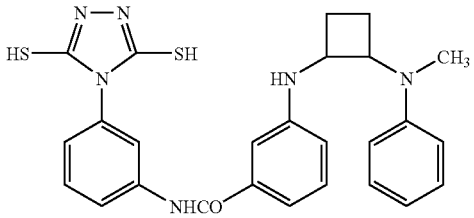
29
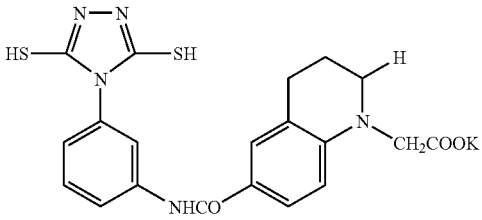
30
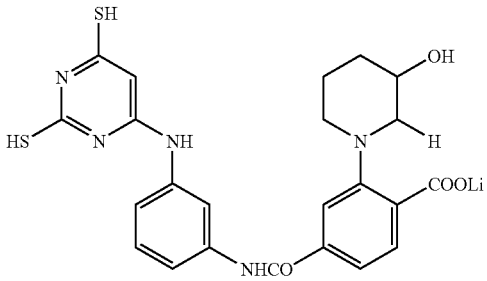

-continued
31
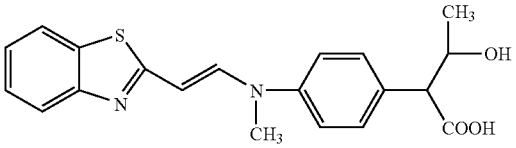
32
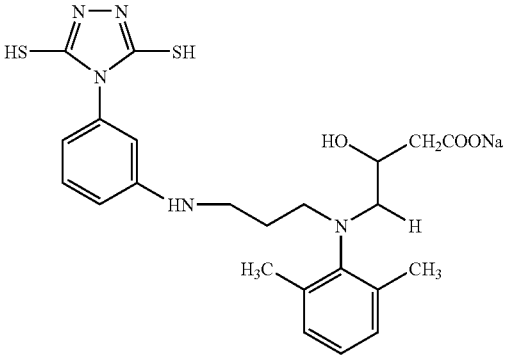
33
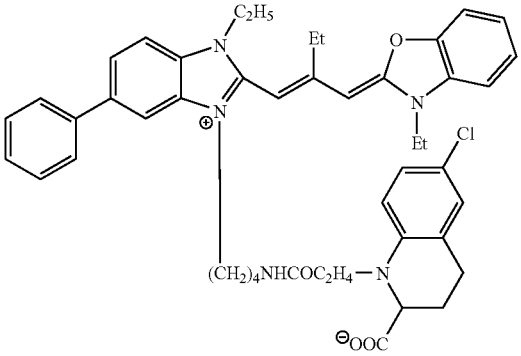
34
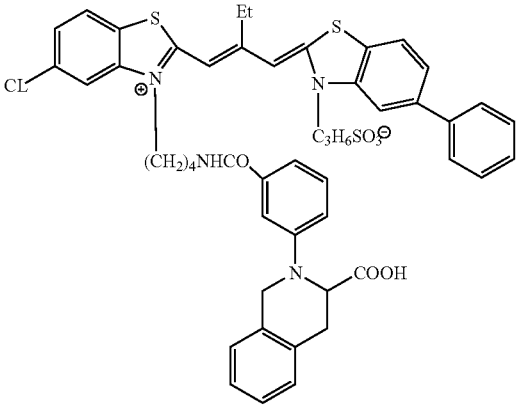
35
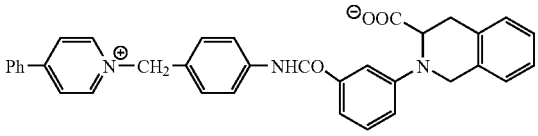
36
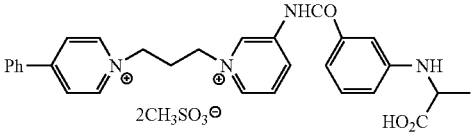
37
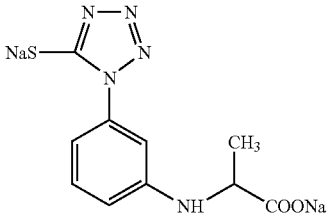
38
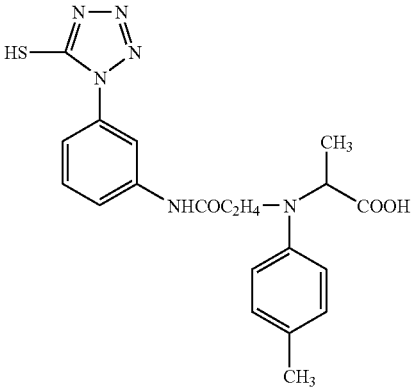

-continued
39
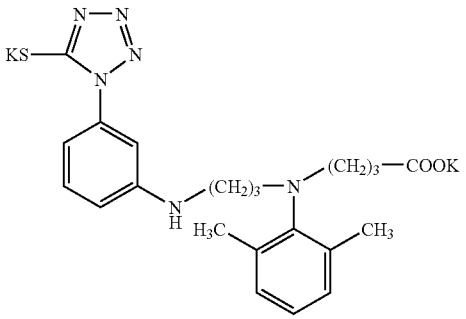
40
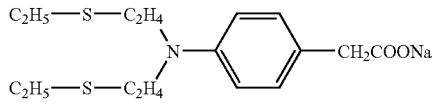
41
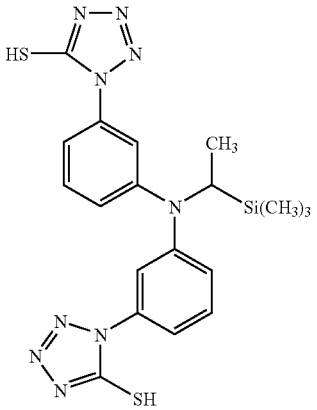
42
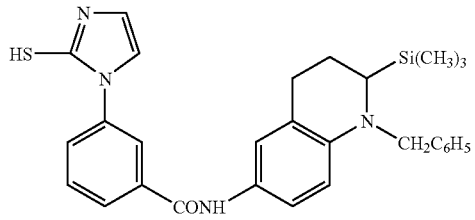
43
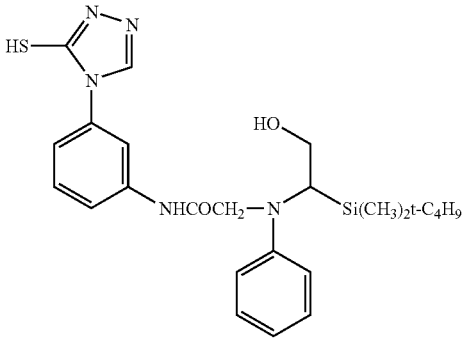
44
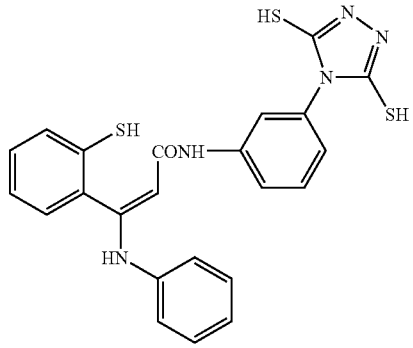
45
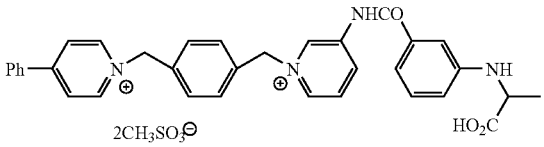
46
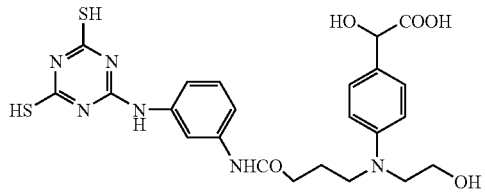
47
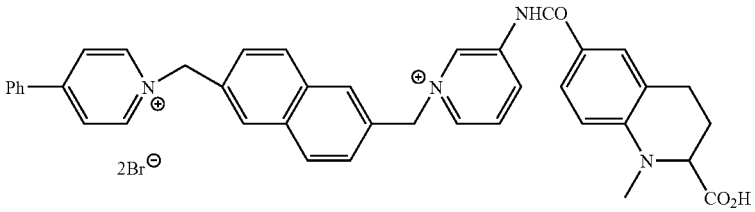
The compound of Type 1 or 2 may be added at any time in the preparation of the photothermographic material, for example, in the preparation of the photosensitive silver halide emulsion. For example, the compound may be added during the formation of the photosensitive silver halide grains, during the desalination, during the chemical sensitization, or before coating. The compound may be added two or more times. The compound may be added, preferably after the completion of the photosensitive silver halide grain formation but before desalination; or during the chemical sensitization Oust before the chemical sensitization to immediately after the chemical sensitization); or before coating. The compound may be added, more preferably during the period from the chemical sensitization to just before the mixing of the silver halide with the non-photosensitive organic silver salt.

The compound of Type 1 or 2 may be added preferably after dissolved in water, a water-soluble solvent such as methanol or ethanol, or a mixed solvent thereof. When the compound whose solubitity in water varies depending on pH is dissolved in water, the pH value of the solution may be appropriately adjusted so as to dissolve the compound well, before added to the silver halide.

It is preferable to incorporate the compound of Type 1 or 2 into the emulsion layer (the image-forming layer). It is also preferable to incorporate the compound of Type 1 or 2 into a protective layer, an intermediate layer, etc. as well as the image-forming layer, so that the compound diffuses during the coating. The compound may be added after or before or simultaneously with the addition of the sensitizing dye. In the silver halide emulsion layer (the image-forming layer), the amount of the compound is preferably $1\times10^{-9}$ mol to $5\times10^{-2}$ mol per 1 mol of silver halide, more preferably $1\times10^{-8}$ mol to $2\times10^{-3}$ mol, per 1 mol of silver halide.

10) Adsorbent Redox Compound Having Adsorbent Group and Reducing Group

The photothermographic material of the invention preferably includes an adsorbent redox compound having a reducing group and an adsorbent group which can adsorb silver halide. The adsorbent redox compound is preferably a compound represented by the following formula (I):

A-(W)n-B. Formula (I)

In the formula (I), A represents a group which can adsorb silver halide (hereinafter referred to as an adsorbent group), W represents a divalent linking group, n represents 0 or 1, B represents a reducing group.

In the formula (I), the adsorbent group represented by A is a group which can directly adsorb silver halide, or a group which fascilitates the adsorption of silver halide. Specifically, the adsorbent groups may be a mercapto group or a salt thereof; a thione group comprising —C(═S)—; a heterocyclic group including at least one atom selected from the group consisting of nitrogen atoms, sulfur atoms, selenium atoms, and tellurium atoms; a sulfide group; a disulfide group; a cationic group; or an ethynyl group.

The mercapto groups (or a salt thereof) used as the adsorbent group may be a mercapto group itself (or a salt thereof), and is more preferably a heterocyclic group, an aryl group, or an alkyl group, each of which has at least one mercapto group (or salt thereof). The heterocyclic group may be a 5- to 7-membered, aromatic or nonaromatic, heterocyclic group having a monocyclic or condensed ring structure, and examples thereof include imidazole ring groups, thiazole ring groups, oxazole ring groups, benzoimidazole ring groups, benzothiazole ring groups, benzoxazole ring groups, triazole ring groups, thiadiazole ring groups, oxadiazole ring groups, tetrazole ring groups, purine ring groups, pyridine ring groups, quinoline ring groups, isoquinoline ring groups, pyrimidine ring groups, and triazine ring groups. The heterocyclic group may include a quaternary nitrogen atom, and in this case, the mercapto group as the substituent may be dissociated to form a mesoion. When the mercapto group forms a salt, the counter ion thereof may be: a cation of an alkaline metal, an alkaline earth metal, a heavy metal, etc. such as $Li^+$, $Na^+$, $K^+$, $Mg^{2+}$, $Ag^+$ and $Zn^{2+}$; an ammonium ion; a heterocyclic group including a quaternary nitrogen atom; or a phosphonium ion.

The mercapto group as the adsorbent group may be tautomerized into a thione group.

The thione group as the adsorbent group may be, for example, a linear or cyclic, thioamide or thioureide or thiourethane or dithiocarbamic acid ester group.

The heterocyclic group including at least one atom selected from the group consisting of nitrogen atoms, sulfur atoms, selenium atoms, and tellurium atoms, used as the adsorbent group, is a nitrogen-containing heterocyclic group having —NH— capable of forming a silver imide (>NAg) as a moiety of the heterocycle, or a heterocyclic group having, as a moiety of the heterocycle, —S—, —Se—, —Te—, or ═N— capable of forming a coordinate bond with a silver ion. Examples of the former include benzotriazole groups, triazole groups, indazole groups, pyrazole groups, tetrazole groups, benzoimidazole groups, imidazole groups, and purine groups. Examples of the latter include thiophene groups, thiazole groups, oxazole groups, benzothiophene groups, benzothiazole groups, benzoxazole groups, thiadiazole groups, oxadiazole groups, triazine groups, selenazole groups, benzoselenazole groups, tellurazole groups, and benzotellurazole groups.

The sulfide group and the disulfide group used as the adsorbent group may be any group having an —S— or —S—S— moiety.

The cationic group used as the adsorbent group is a group including a quaternary nitrogen atom, and may be a group having a nitrogen-including heterocyclic group containing an ammonio group or a quaternary nitrogen atom. Examples of the quaternary-nitrogen-containing heterocyclic group include pyridinio groups, quinolinio groups, isoquinolinio groups, and imidazolio groups.

The ethynyl group used as the adsorbent group is a —C≡CH group, in which the hydrogen atom may be replaced with a substituent.

The above-described adsorbent groups may have any substituents.

Specific examples of the adsorbent group further include those described in JP-A No. 11-95355, Page 4 to 7, the disclosure of which is incorporated herein by reference.

In the formula (I), the adsorbent group represented by A is preferably a mercapto-substituted heterocyclic group (e.g. a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazolium-3-thiolate group, a 2,4-dimercaptopyrimidine group, a 2,4-dimercaptotriazine group, a 3,5-dimercapto-1,2,4-triazole group, 2,5-dimercapto-1,3-thiazole group, etc.) or a nitrogen-including heterocyclic group having —NH— capable of forming a silver imide (>NAg) in the heterocycle (e.g. a benzotriazole group, a benzimidazole group, an indazole group, etc.), more preferably a 2-mercaptobenzimidazole group or a 3,5-dimercapto-1,2,4-triazole group.

In the formula (I), W represents a divalent linking group. The linking group is not particularly limited as long as the linking group causes no adverse effects on the photographic properties. For example, the divalent linking group may be composed of an atom or atoms selected from carbon atoms, hydrogen atoms, oxygen atoms, nitrogen atoms, and sulfur atoms. Specific examples of the divalent linking group include: alkylene groups each having 1 to 20 carbon atoms such as a methylene group, an ethylene group, a trimethylene group, a tetramethylene group, and a hexamethylene group; alkenylene groups each having 2 to 20 carbon atoms; alkynylene groups each having 2 to 20 carbon atoms; arylene groups each having 6 to 20 carbon atoms such as a phenylene group and a naphthylene group; —CO—; —$SO_2$—; —O—; —S—; —NR1—; and combinations thereof. R1 represents a hydrogen atom, an alkyl group, a heterocyclic group, or an aryl group.

The linking group represented by W may have any substituent(s).

In the formula (I), the reducing group represented by B is a group capable of reducing a silver ion, and examples thereof include a formyl group, an amino group, triple bond groups such as an acetylene group and a propargyl group, a mercapto group, and residues obtained by removing one hydrogen atom from each of the following compounds: hydroxylamine compounds, hydroxamic acid compounds, hydroxyurea compounds, hydroxyurethane compounds, hydroxysericarbazide compounds, reductone compounds (including reductone derivatives), aniline compounds, phenol compounds (including chroman-6-ol compounds, 2,3-dihydrobenzofuran-5-ol compounds, aminophenol compounds, sulfonamidephenol compounds, and polyphenol compounds such as hydroquinone compounds, catechol compounds, resorcinol compounds, benzenetriol compounds, and bisphenol compounds), acylhydrazine compounds, carbamoylhydrazine compounds, and 3-pyrazolidone compounds. The above reducing groups may have any substituent(s).

The oxidation potential of the reducing group represented by B in the formula (I) can be measured by a method described in Akira Fujishima, *Denki Kagaku Sokutei-ho*, Page 150–208, Gihodo Shuppan Co., Ltd., or The Chemical Society of Japan, *Jikken Kagaku Koza*, *4th edition*, Vol. 9, Page 282–344, Maruzen, the disclosures of which are incorporated by reference herein. For example, the oxidation potential may be determined by a rotating disk voltammetry technique; specifically, in the technique, a sample is dissolved in a 10/90 (volume %) solvent of methanol/pH 6.5 Britton-Robinson buffer, and then the solution is subjected to bubbling with nitrogen gas for 10 minutes, and then the electric potential of the solution is measured at 25° C. at 1,000 round/minute at the sweep rate of 20 mV/second using a glassy carbon rotating disk electrode (RDE) as a working electrode, a platinum wire as a counter electrode, and a saturated calomel electrode as a reference electrode, thereby obtaining a voltammogram. The half wave potential (E1/2) can be obtained from the voltammogram.

The reducing group represented by B has an oxidation potential of preferably about −0.3 to about 1.0 V when measured by the above method. The oxidation potential is more preferably about −0.1 to about 0.8 V, particularly preferably about 0 to about 0.7 V.

The reducing group represented by B is preferably a residue provided by removing one hydrogen atom from a hydroxylamine compound, a hydroxamic acid compound, a hydroxyurea compound, a hydroxysemicarbazide compound, a reductone compound, a phenol compound, an acylhydrazine compound, a carbamoylhydrazine compound, or a 3-pyrazolidone compound.

The compound of the formula (I) may have a ballast group or a polymer chain each of which is commonly used in an immobile photographic additive such as a coupler. The polymer chain may be selected from the polymer chains described in JP-A No. 1-100530, the disclosure of which is incorporated by reference herein.

The compound of the formula (I) may be in the form of a dimer or a trimer. The molecular weight of the compound of the formula (I) is preferably 100 to 10,000, more preferably 120 to 1,000, particularly preferably 150 to 500.

Examples of the compound represented by the formula (I) are illustrated below without intention of restricting the scope of the invention.

(1)

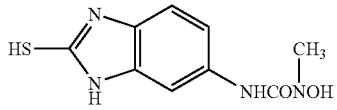

(2)

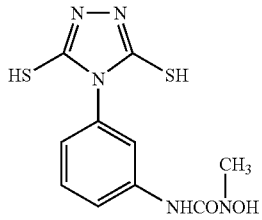

(3)

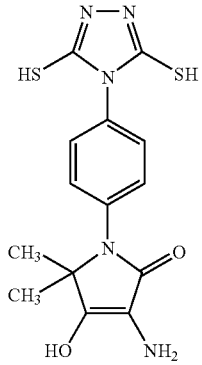

(4)

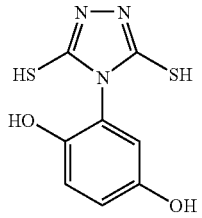

(5)

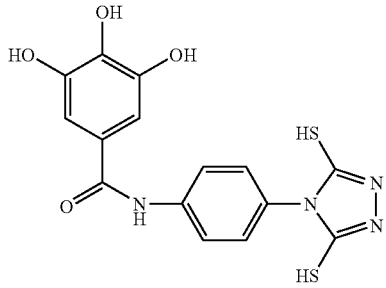

-continued (6)

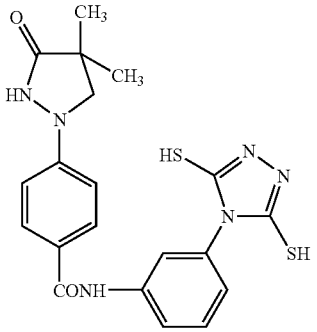

(7)

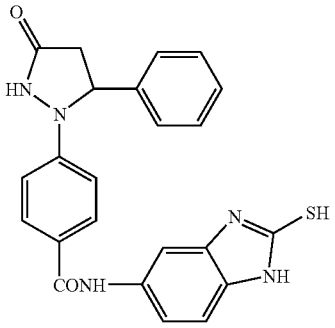

(8)

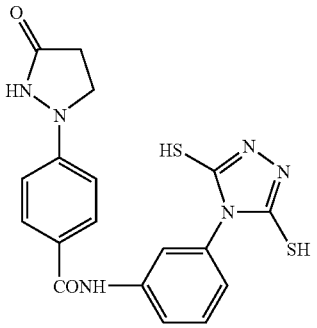

(9)

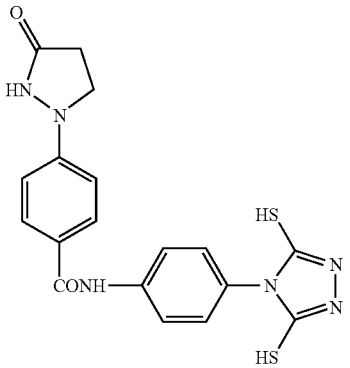

-continued (10)

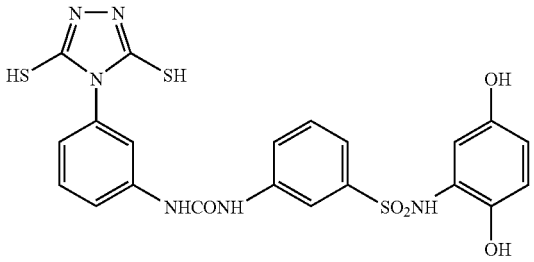

(11)

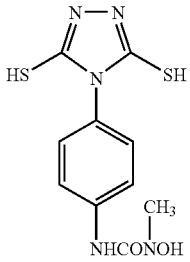

(12)

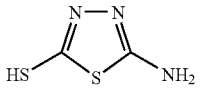

(13)

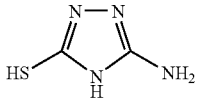

Further, Compounds 1 to 30 and 1"-1 to 1"-77 described in EP No. 1308776A2, Page 73 to 87 (the disclosure of which is incorporated herein by reference) may be preferably used as the compound having the adsorbent group and the reducing group.

These compounds can be easily synthesized by a known method. Only a single kind of a compound of the formula (I) may be used, or two or more kinds of compounds of the formula (I) may be used in combination. When two or more compounds of the formula (I) are used, they may be included in the same layer or in respectively different layers, and may be added by respectively different methods.

The compound of the formula (I) is preferably included in the silver halide emulsion layer. It is preferable to add the compound of the formula (I) during the preparation of the silver halide emulsion. The compound may be added at any time in the preparation of the emulsion. For example, the compound may be added (i) during the silver halide grain formation, (ii) before the desalination, (iii) during the desalination, (iv) before the chemical ripening, (v) during the chemical ripening, (vi) before the finishing. The compound may be added two or more times. The compound may be used preferably in the image-forming layer. In an embodiment, the compound is added to a protective layer, an intermediate layer, etc. as well as the image-forming layer, so that the compound diffuses during coating.

The preferred amount of the compound to be added depends largely on the adding method and the type of the compound. The amount of the compound is generally $1\times10^{-6}$ mol to 1 mol per 1 mol of the photosensitive silver halide, preferably $1\times10^{-5}$ mol to $5\times10^{-1}$ per 1 mol of the photosensitive silver halide, more preferably $1\times10^{-4}$ mol to $1\times10^{-1}$ mol per 1 mol of the photosensitive silver halide.

The compound of the formula (I) may be added in the form of a solution in water, a water-soluble solvent such as methanol or ethanol, or a mixed solvent thereof. The pH value of the solution may be appropriately adjusted by an acid or a base. A surfactant may be added to the solution. Further, the compound may be added in the form of an emulsion in an organic high boiling point solvent, or in the form of a solid dispersion.

11) Combination of Silver Halides

In an embodiment, only one kind of photosensitive silver halide emulsion is used in the photothermographic material of the invention. In another embodiment, two or more kinds of photosensitive silver halide emulsions are used in the photothermographic material; the photosensitive silver halide emulsions may be different from each other in characteristics such as average grain size, halogen composition, crystal habit, and chemical sensitization condition. The image gradation can be adjusted by using two or more kinds of photosensitive silver halide emulsions having different sensitivities. The related techniques are described, for example in JP-A Nos. 57-119341, 53-106125, 47-3929, 48-55730, 46-5187, 50-73627, and 57-150841, the disclosure of which are incorporated herein by reference. The difference in sensitivity between the emulsions is preferably 0.2 log E or larger.

12) Application Amount

The amount of the photosensitive silver halide to be applied is, in terms of the applied silver amount per 1 $m^2$ of photothermographic material, preferably 0.03 to 0.6 $g/m^2$, more preferably 0.05 to 0.4 $g/m^2$, still more preferably 0.07 to 0.3 $g/m^2$. Further, the amount of the photosensitive silver halide per 1 mol of the organic silver salt is preferably 0.01 to 0.5 mol, more preferably 0.02 to 0.3 mol, further preferably 0.03 to 0.2 mol.

13) Mixing of Photosensitive Silver Halide and Organic Silver Salt

The methods and conditions of mixing the photosensitive silver halide and the organic silver salt, which are separately prepared, are not particularly restricted as long as the advantageous effects of the invention can be sufficiently obtained. In an embodiment, the silver halide and the organic silver salt are separately prepared and then mixed by a high-speed stirrer, a ball mill, a sand mill, a colloid mill, a vibrating mill, a homogenizer, etc. In another embodiment, the prepared photosensitive silver halide is added to the organic silver salt during the preparation of the organic silver salt, and the preparation of the organic silver salt is then completed. It is preferable to mix two or more aqueous organic silver salt dispersion liquids and two or more aqueous photosensitive silver salt dispersion liquids so as to adjust the photographic properties.

14) Addition of Silver Halide to Coating Liquid

The silver halide is added to the coating liquid for the image-forming layer preferably between 180 minutes before coating and immediately before coating, more preferably between 60 minutes before coating and 10 seconds before coating. There are no particular restrictions on the methods and conditions of the coating as long as the advantageous effects of the invention can be sufficiently obtained. In an embodiment, the silver halide is mixed with the coating liquid in a tank while controlling the addition flow rate and the feeding amount to the coater, such that the average retention time calculated from the addition flow rate and the feeding amount to the coater is the desired time. In another embodiment, the silver halide is mixed with the coating liquid by a method using a static mixer described, for example, in N. Hamby, M. F. Edwards, and A. W. Nienow, translated by Koji Takahashi, *Ekitai Kongo Gijutsu*, Chapter 8 (Nikkan Kogyo Shimbun, Ltd., 1989), the disclosure of which is incorporated herein by reference.

(Compound for Substantially Reducing Absorption of Visible Light by Photosensitive Silver Halide After Heat Development)

In the case of a photothermographic material having image forming layers on both sides, the silver halide preferably has a high silver iodide content. It is preferable to use a silver halide having a high silver iodide content in combination with a compound which can substantially reduce the spectral absorption of lights in ultraviolet to visible region by photosensitive silver halide during heat development.

In the invention, the compound which can substantially reduce the spectral absorption is preferably a silver iodide complex forming agent.

(Explanation of the Silver Iodide Complex Forming Agent)

A silver iodide complex forming agent in the invention is capable of participating in a Lewis acid-base reaction in which at least one of the nitrogen atoms and sulfur atoms in the compound donates electrons to silver ions wherein the at least one atom functions as a coordinating atom (electron donor: Lewis base). The stability of the complex is defined by the stepwise stability constant or the overall stability constant, and depends on the combination of silver ion, iodine ion, and silver complex forming agent. As a general guideline, it is possible to obtain a large stability constant by a chelate effect resulting from intramolecular chelate ring formation, or an increase in acid-base dissociation constant of ligands.

The mechanism of action of the silver iodide complex forming agent of the invention has not been clearly elucidated. However, presumably, silver iodide is solubilized by formation of a stable complex including an iodine ion, a silver ion, and the silver iodide complex forming agent. The silver iodide complex forming agent of the invention is poor in capability of solubilizing silver bromide or silver chloride. However, the silver iodide complex forming agent of the invention acts specifically on silver iodide.

Details of how image storage stability is improved by the silver iodide complex forming agent of the invention are not apparent. Presumably, at least a part of photosensitive silver halide and the silver iodide complex forming agent of the invention react with each other during heat development, to form a complex, thereby reducing or eliminating the photosensitivity. Particularly, image storage stability under light irradiation can be remarkably improved. Further, it is also an important feature that the turbidity of the film caused by silver halide is reduced to give a clear high-quality image, when the silver iodide complex forming agent is used. The turbidity of the film can be confirmed by a reduction of absorption intensity in ultraviolet to visible region of the spectral absorption spectrum.

In the invention, the ultraviolet to visible absorption spectrum of photosensitive silver halide can be measured by a transmission method or a reflection method. When the absorption spectrum by another compound in the photothermographic material overlaps the absorption spectrum of the photosensitive silver halide, the ultraviolet to visible absorption spectrum of the photosensitive silver halide can be measured by difference spectrum, by removal of the compound with a solvent, or by a combination of such methods.

The silver iodide complex forming agent of the invention is clearly different from conventional silver ion complex forming agents in that the silver iodide complex forming agent of the invention requires an iodine ion for forming a stable complex. Conventional silver ion complex forming agents solubilize salts containing silver ions such as organic silver salts, silver bromide, silver chloride, or silver behenate. In contrast, the significant feature of the silver iodide complex forming agent of the invention is that the silver iodide complex forming agent of the invention does not perform its function in the absence of silver iodide.

The silver iodide complex forming agent of the invention is preferably a 5- to 7-membered heterocyclic compound containing at least one nitrogen atom. When the silver iodide complex forming agent of the invention is a compound not having a mercapto group, a sulfide group, or a thione group as a substituent, the 5- to 7-membered heterocyclic rings may be saturated or unsaturated, and may have other substituents. Further, the substituents on the heterocyclic rings may combine with each other to form a ring.

Preferred examples of the 5- to 7-membered heterocyclic compound include: pyrrole, pyridine, oxazole, isoxazole, thiazole, isothiazole, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, naphthyridine, purine, pteridine, carbazole, acridine, phenanthridine, phenanthroline, phenazine, phenoxazine, phenothiazine, benzothiazole, benzoxazole, benzimidazole, 1,2,4-triazine, 1,3,5-triazine, pyrrolidine, imidazolidine, pyrazolidine, piperidine, piperazine, morpholine, indoline, and isoindoline. More preferred examples thereof include: pyridine, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, 1,8-naphthyridine, 1,10-phenanthroline, benzimidazole, benztriazole, 1,2,4-triazine, and 1,3,5triazine. Particularly preferred examples thereof include: pyridine, imidazole, pyrazine, pyrimidine, pyridazine, phthalazine, triazine, 1,8-naphthyridine, and 1,10-phenanthroline.

These rings each may have a substituent. Any substituent can be used so long as the substituent does not adversely affect the photographic properties. Examples of the substituent include: halogen atoms such as a fluorine atom, a chlorine atom, a bromine atom, and an iodine atom; alkyl groups each of which may be linear, branched, or cyclic, wherein the scope of the alkyl groups include bicycloalkyl groups and active methine groups; alkenyl groups; alkynyl groups; aryl groups; heterocyclic groups (the position which is bonded to the main structure of Y is not limited); acyl groups; alkoxycarbonyl groups; aryloxycarbonyl groups; heterocyclyloxycarbonyl groups; carbamoyl groups; N-acylcarbamoyl groups; N-sulfonylcarbamoyl groups; N-carbamoylcarbamoyl groups; N-sulfamoylcarbamoyl groups; carbazoyl groups; a carboxy group and salts thereof; oxalyl groups; oxamoyl groups; a cyano group; carbonimidoyl groups; a formyl group; a hydroxy group; alkoxy groups which may include a plurality of ethyleneoxy or propyleneoxy groups as repetition units; aryloxy groups; heterocyclyloxy groups; acyloxy groups; alkoxycarbonyloxy groups; aryloxycarbonyloxy groups; carbamoyloxy groups; sulfonyloxy groups; amino groups; alkylamino groups; arylamino groups; heterocyclylamino groups; acylamino groups; sulfonamide groups; ureido groups; thioureide groups; imide groups; alkoxycarbonylamino groups; aryloxycarbonylamino groups; sulfamoylamino groups; semicarbazide groups; ammonio groups; oxamoylamino groups; Nalkyl-sulfonylureide groups; N-aryl-sulfonylureide groups; N-acylureide groups; N-acylsulfamoylamino groups; a nitro group; heterocyclic groups including quaternary nitrogen atoms, such as a pyridinio group, an imidazolio group, a quinolinio group, and an isoquinolinio group; an isocyano group; imino groups; alkylsulfonyl groups; arylsulfonyl groups; alkylsulfinyl groups; arylsulfinyl groups; a sulfo group and salts thereof; sulfamoyl groups; N-acylsulfamoyl groups; N-sulfonylsulfamoyl groups and salts thereof; phosphino groups; phosphinyl groups; phosphinyloxy groups; phosphinylamino groups; and silyl groups. The term "active methine group" refers to a methine group substituted by two electron-withdrawing groups. The electron-withdrawing group is selected from an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, and a carbonimidoyl group. The two electron-withdrawing groups may be bonded to each other to form a ring structure. Cations of the above salts each may be selected from metal cations such as alkaline metal ions, alkaline earth metal ions, and heavy metal ions, and organic cations such as ammonium ions and phosphonium ions. The above substituents may be further substituted by substituents selected from the above substituents.

These heterocyclic rings may be each further condensed with another ring. When the substituent is an anionic group (e.g., $—CO_2^-$, $—SO_3^-$, or $—S^-$), the nitrogen-containing heterocyclic ring of the invention may be a cation (e.g., pyridinium or 1,2,4-triazolium), so that an intramolecular salt is formed.

When the heterocyclic compound is a pyridine, pyrazine, pyrimidine, pyridazine, phthalazine, triazine, naphthyridine, or phenanthroline derivative, the acid dissociation constant (pKa) of the conjugate acid of the nitrogen-containing heterocyclic ring moiety at 25° C. in a tetrahydrofuran/water (3/2) mixture is preferably 3 to 8, more preferably 4 to 7.

Such a heterocyclic compound is preferably a pyridine, pyridazine, or phthalazine derivative, and more preferably a pyridine or phthalazine derivative.

When the heterocyclic compound has a mercapto group, a sulfide group, or a thione group as a substituent, the heterocyclic compound is preferably a pyridine, thiazole, isothiazole, oxazole, isoxazole, imidazole, pyrazole, pyrazine, pyrimidine, pyridazine, triazine, triazole, thiadiazole, or oxadiazole derivative, and particularly preferably a thiazole, imidazole, pyrazole, pyrazine, pyrimidine, pyridazine, triazine, or triazole derivative.

For example, a compound represented by the following formula (21) or formula (22) can be utilized as the silver iodide complex forming agent.

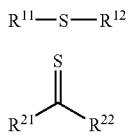

Formula (21)

Formula (22)

In formula (21), $R^{11}$ and $R^{12}$ each independently represent a hydrogen atom or a substituent. In formula (22), $R^{21}$ and $R^{22}$ each independently represent a hydrogen atom or a substituent, providing that at least one of $R^{11}$ and $R^{12}$ is not a hydrogen atom and at least one of $R^{21}$ and $R^{22}$ is not a hydrogen atom. The substituent may be selected from the examples of the substituent on the nitrogen containing 5 to 7-membered heterocyclic silver iodide complex forming agent described above.

Further, the silver iodide complex forming agent may be a compound represented by the following formula (23).

Formula (23)

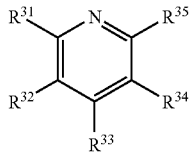

In formula (23), $R^{31}$ to $R^{35}$ each independently represent a hydrogen atom or a substituent. The substituent represented by any of $R^{31}$ to $R^{35}$ may be selected from the examples of the substituent on the nitrogen containing 5 to 7-membered heterocyclic silver iodide complex forming agent described above. When the compound represented by formula (23) has a substituent, a preferred substitution position is any of $R^{32}$ to $R^{34}$. $R^{31}$ to $R^{35}$ may combine with each other to form a saturated or unsaturated ring. $R^{31}$ to $R^{35}$ are preferably selected from halogen atoms, alkyl groups, aryl groups, carbamoyl groups, hydroxy groups, alkoxy groups, aryloxy groups, carbamoyloxy groups, amino groups, acylamino groups, ureido groups, alkoxy carbonylamino groups, and aryloxy carbonylamino groups.

The acid dissociation constant (pKa) of the conjugated acid of the pyridine ring portion of the compound represented by formula (23) in a mixture of tetrahydrofuran/water (3/2) at 25° C. is preferably 3 to 8, more preferably 4 to 7.

Another preferable silver iodide complex forming agent is a compound represented by formula (24).

Formula (24)

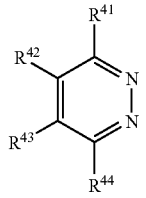

In formula (24), $R^{41}$ to $R^{44}$ each independently represent a hydrogen atom or a substituent. $R^{41}$ to $R^{44}$ may combine with each other to form a saturated or unsaturated ring. The substituent represented by any of $R^{41}$ to $R^{44}$ may be selected from the examples of the substituent on the nitrogen containing 5 to 7-membered heterocyclic silver iodide complex forming agent described above. $R^{41}$ to $R^{44}$ are each preferably an alkyl group, an alkenyl group, an alkynyl group, an aryl group, a hydroxy group, an alkoxy group, an aryloxy group, a heterocyclyloxy group, or a phthalazine ring formed by condensation with a benzene ring. When a hydroxyl group is substituted on a carbon atom adjacent to any of the nitrogen atoms of the compound represented by formula (24), the compound is in equilibrium between the shown form and a pyridazinone form.

The compound represented by formula (24) preferably has a phthalazine ring represented by the following formula (25) and, the phthalazine ring preferably has at least one substituent. The substituent represented by any of $R^{51}$ to $R^{56}$ may be selected from the examples of the substituent on the nitrogen containing 5 to 7-membered heterocyclic silver iodide complex forming agent described above. The substituent represented by any of $R^{51}$ to $R^{56}$ is preferably an alkyl group, an alkenyl group, an alkynyl group, an aryl group, a hydroxy group, an alkoxy group, or an aryloxy group, preferably an alkyl group, an alkenyl group, an aryl group, an alkoxy group, or an aryloxy group, more preferably an alkyl group, an alkoxy group, or an aryloxy group.

Formula (25)

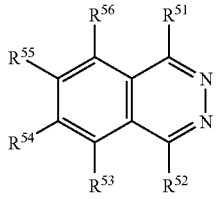

Another preferable silver iodide complex forming agent is a compound represented by formula (26).

Formula (26)

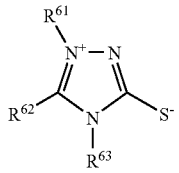

In formula (26), $R^{61}$ to $R^{63}$ each independently represent a hydrogen atom or a substituent. The substituent represented by $R^{62}$ may be selected from the examples of the substituent on the nitrogen containing 5 to 7-membered heterocyclic silver iodide complex forming agent described above.

Another preferable silver iodide complex forming agent is a compound represented by formula (27).

$$R^{71}\text{—S-(L)}_n\text{-S—}R^{72} \qquad \text{Formula (27)}$$

In formula (27), $R^{71}$ to $R^{72}$ each independently represent a hydrogen atom or a substituent, L represents a bivalent connection group, and n represents 0 or 1. Examples of the substituent represented by $R^{71}$ or $R^{72}$ include alkyl groups (including cycloalkyl groups), alkenyl group (including cycloalkenyl groups), alkynyl groups, aryl groups, heterocyclic groups, acyl groups, aryloxycarbonyl groups, alkoxycarbonyl groups, carbamoyl groups, imide groups, and composite substituents each containing some of the above substituents. The bivalent connection group represented by L is a connection group having a length of preferably 1 to 6 atoms, more preferably a length of 1 to 3 atoms. The bivalent connection group may have a further substituent.

Another preferable silver iodide complex forming agent is a compound represented by formula (28).

Formula (28)

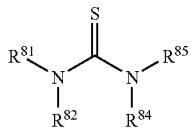

In formula (28), $R^{81}$ to $R^{85}$ each independently represent a hydrogen atom or a substituent. Examples of the substituent represented by $R^{81}$ to $R^{85}$ include alkyl groups (including cycloalkyl groups), alkenyl group (including cycloalkenyl groups), alkynyl groups, aryl groups, heterocyclic groups, acyl groups, aryloxycarbonyl groups, alkoxycarbonyl groups, carbamoyl groups, and imide groups.

The silver iodide complex forming agent is preferably a compound represented by formula (23), (24), (25), (26), or (27), more preferably a compound represented by formula (23) or (25).

Preferred examples of the silver iodide complex forming agent of the invention are shown below, but the invention is not restricted to them.

(1)

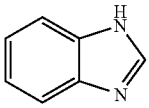

(2)

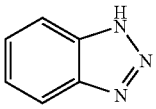

(3)

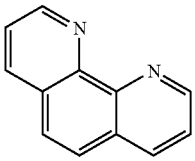

(4)

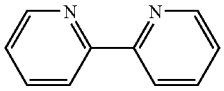

(5) $C_5H_{11}SC_5H_{11}$ (6) $C_4H_9SCH_2CH_2SC_4H_9$ (7)

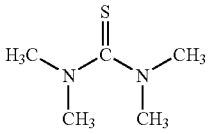

(8)

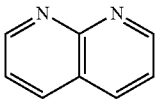

(9)

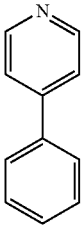

-continued (10)

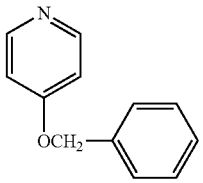

(11)

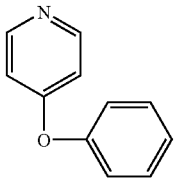

(12)

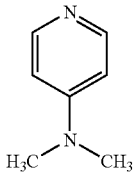

(13)

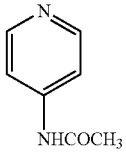

(14)

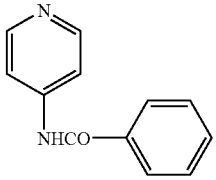

(15)

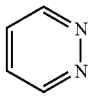

(16)

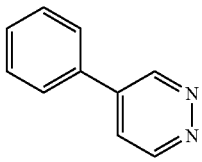

(17)

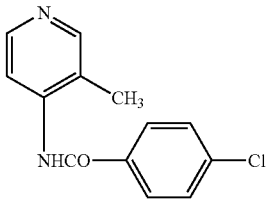

(18)

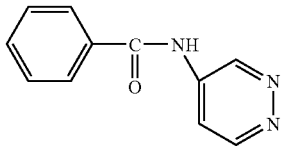

-continued
(19)
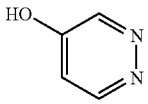
(20)
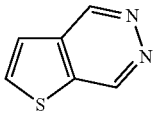
(21)
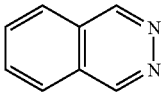
(22)
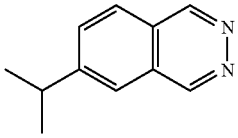
(23)
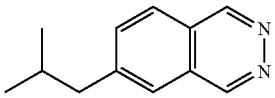
(24)
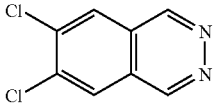
(25)
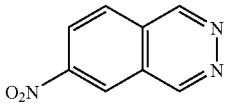
(26)
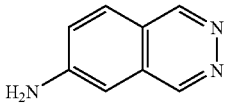
(27)
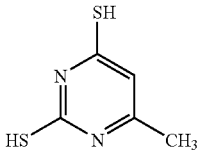
(28)
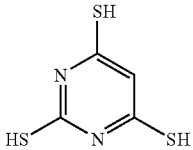
(29)
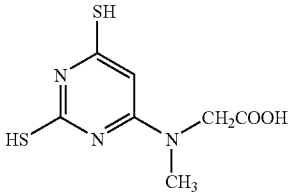
-continued
(30)
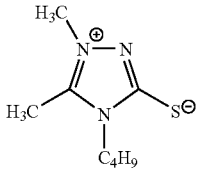
(31)
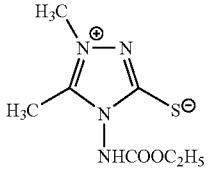
(32)
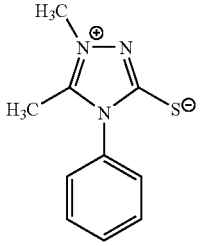
(33)
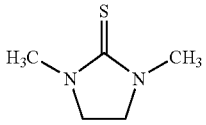
(34)
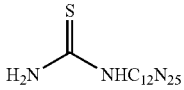
(35)
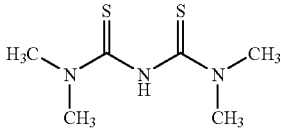
(36)
$HO(CH_2)_3S(CH_2)_2S(CH_2)_3OH$
(37)
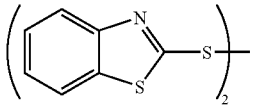
(38)
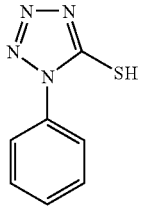
(39)
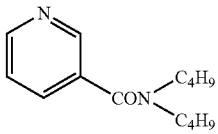

-continued (40)

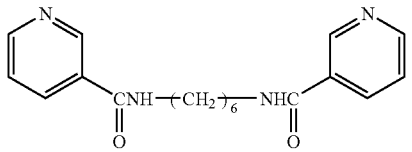

(41)

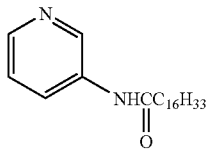

(42)

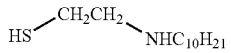

If a silver iodide complex forming agent of the invention has a function as a known toning agent, addition of other toning agents are unnecessary. In an embodiment, the silver iodide complex forming agent of the invention is used in combination with a toning agent. Two or more silver iodide complex forming agents may be used in combination.

In a preferable embodiment, silver iodide complex forming agent of the invention is present such that silver iodide complex forming agent is separated from photosensitive silver halide. For example, the silver iodide complex forming agent may be present in the solid state in the film. It is also preferable to add the agent to a layer adjacent to the image-forming layer. The silver iodide complex forming agent of the invention preferably has such a melting point that the agent is melted when heated to a heat development temperature.

In the invention, the absorption intensity by photosensitive silver halide in the UV to visible range after heat development is 80% or lower (preferably 40% or lower, more preferably 10% or lower) of the absorption intensity before heat development.

The silver iodide complex forming agent may be added to the coating liquid in any form such as a solution, an emulsion, or a solid particle dispersion.

In an exemplary emulsification method, the silver iodide complex forming agent is dissolved in an oil such as dibutyl phthalate, tricresyl phosphate, glyceryl triacetate, or diethyl phthalate, and/or a cosolvent such as ethyl acetate and cyclohexanone, and then mechanically emulsified.

In an embodiment, the solid particle dispersion is prepared by a method comprising dispersing powder of the silver iodide complex forming agent in an appropriate solvent such as water using a ball mill, a colloid mill, a vibration ball mill, a sand mill, a jet mill, a roll mill, or ultrasonic wave. A protective colloid (e.g. a polyvinyl alcohol) and/or a surfactant such as an anionic surfactant (e.g. a mixture of sodium triisopropylnaphthalenesulfonates each having a different combination of the substitution positions of the three isopropyl groups) may be used in the preparation. Beads of zirconia, etc. are commonly used as a dispersing medium in the above mills, and in some cases Zr, etc. is eluted from the beads and mixed with the dispersion. The amount of the eluted and mixed component depends on the dispersion conditions, and is generally within the range of 1 to 1,000 ppm. The eluted zirconia does not cause practical problems as long as the amount of Zr in the photothermographic material is 0.5 mg or smaller per 1 g of silver.

In a preferable embodiment, the aqueous dispersion includes an antiseptic agent such as a benzoisothiazolinone sodium salt. The silver iodide complex forming agent is particularly preferably used in the form of a solid particle dispersion.

The silver iodide complex forming agent of the invention is preferably used within a range of 1 mol % to 5,000 mol %, more preferably, within a range of 10 mol % to 1000 mol % and, further preferably, within a range of 50 mol % to 300 mol %, based on the amount of photosensitive silver halide.

(Explanation of Binder)

As the binder in the image forming layer in the invention, any polymer may be used. The polymer is preferably transparent or translucent, and generally colorless. The polymer may be a natural resin, polymer or copolymer, a synthetic resin, polymer or copolymer, or another film-forming medium, and specific examples thereof include gelatins, gums, polyvinyl alcohols, hydroxyethylcelluloses, cellulose acetates, cellulose acetate butyrates, polyvinylpyrrolidones, caseins, starches, polyacrylic acids, polymethylmethacrylic acids, polyvinyl chlorides, polymethacrylic acids, styrene-naleic anhydride copolymers, styreneacrylonitrile copolymers, styrene-butadiene copolymers, polyvinyl acetals (e.g. polyvinyl formals, polyvinyl butyrals, etc.), polyesters, polyurethanes, phenoxy resins, polyvinylidene chlorides, polyepoxides, polycarbonates, polyvinyl acetates, polyolefins, cellulose esters, and polyamides. In the coating liquid, the binder may be dissolved or dispersed in an aqueous solvent or an organic solvent, or may be in the form of an emulsion.

The glass-transition temperature of the binder in a layer containing non-photosensitive organic silver salt is preferably 0 to 80° C., more preferably 10 to 70° C., further preferably 15 to 60° C. A polymer having such a high glass-transition temperature is hereinafter referred to as "a high Tg binder" occasionally.

In the invention, Tg of a copolymer is calculated using the following equation:

$$1/Tg=\Sigma(Xi/Tgi).$$

Assuming the polymer is a copolymer comprised of n monomers which are designated by "monomer i" (i=1 to n). Xi is the weight fraction of the monomer i ($\Sigma Xi=1$), and Tgi is the glass-transition temperature (absolute temperature) of the homopolymer of the monomer i. $\Sigma(Xi/Tgi)$ is the sum of Xi/Tgi for i=1 to n. In the invention, the glass-transition temperature Tgi of the homopolymer of each monomer is a value described in J. Brandrup and E. H. Immergut, *Polymer Handbook*, 3*rd Edition* (Wiley-Interscience, 1989), the disclosure of which is incorporated by reference herein.

Two or more binders may be used in accordance with the necessity. In an embodiment, a binder with a glass transition temperature of 20° C. or higher and a binder with a glass transition temperature of lower than 20° C. are used in combination. When two or more polymers are used which have respectively different Tg values, the weight average Tg thereof is preferably within the range described above.

In the invention, it is prefererable to form the image-forming layer by applying and drying a coating liquid in which 30 mass % or more of the solvent is water.

In the invention, the performance can be improved when the image-forming layer is formed by applying and drying a coating liquid in which 30 mass % or more of the solvent is water, further when the binder in the image-forming layer is soluble or dispersible in an aqueous solvent (water solvent), particularly when the binder comprises a polymer latex with an equilibrium water content of 2 mass % or less at 25° C. and 60% RH. The latex preferably has an ionic conductivity of 2.5 mS/cm or lower, and such a latex can be prepared by purifying a synthesized polymer using a separation membrane.

The aqueous solvent in which the binder may be soluble or dispersible is water or a mixed solvent of water and a water-miscible organic solvent, the proportion of the water-miscible organic solvent to the mixed solvent being 70% by mass or lower. Examples of the watermiscible organic solvent include: alcohol solvents such as methyl alcohol, ethyl alcohol, and propyl alcohol; cellosolve solvents such as methyl cellosolve, ethyl cellosolve, and butyl cellosolve; ethyl acetate; and dimethylformamide.

The scope of the term "aqueous solvent" used herein includes a system in which the polymer is not dissolved thermodynamically but is present in a dispersed state.

The equilibrium moisture content at 25° C. 60% RH can be represented by the following equation:

$$\text{Equilibrium moisture content at 25° C. 60\% RH} = \{(W1-W0)/W0\} \times 100 \text{ (\% by mass)},$$

in which W1 is a weight of a polymer having an equilibrium moisture content in an atmosphere of 25° C. 60% RH, and W0 is a weight of the polymer in the bone-dry state at 25° C.

Definition and measuring methods of the moisture content is described in *Kobunshi Kogaku Koza* 14, *Kobunshi Zairyo Shikenho*, edited by The Society of Polymer Science, Japan, Chijin Shokan Co., Ltd., the disclosure of which is incorporated herein by reference.

In the invention, the equilibrium moisture content at 25° C. 60% RH of the binder polymer is preferably 2% by mass or lower, more preferably 0.01 to 1.5% by mass, furthermore preferably 0.02 to 1% by mass.

The polymer is preferably dispersible in an aqueous solvent. The dispersion state of the polymer in the coating liquid may be a latex in which fine particles of a water-insoluble hydrophobic polymer are dispersed, or a dispersion (or emulsion) liquid in which polymer molecules are dispersed in the molecular or micell state. The latex dispersion is more preferable. The average particle diameter of the dispersed particles is 1 to 50,000 nm, preferably 5 to 1,000 nm, more preferably 10 to 500 nm, and furthermore preferably 50 to 200 nm. The particle size distribution of the dispersed particles is not particularly restricted, and may be a wide or monodisperse distribution. It is preferable to use two or more kinds of particles each having a monodisperse distribution so as to adjust the physical properties of the coating liquid.

Preferred examples of the polymers dispersible in the aqueous solvents include hydrophobic polymers such as acrylic polymers, polyesters, rubbers (e.g. SBR resins), polyurethanes, polyvinyl chlorides, polyvinyl acetates, polyvinylidene chlorides, and polyolefins. The polymer may be linear, branched, or cross-linked, and may be a homopolymer derived form one monomer or a copolymer derived form two or more monomers. The copolymer may be a random copolymer or a block copolymer. The number-average molecular weight of the polymer is preferably 5,000 to 1,000,000, more preferably 10,000 to 200,000. When the number-average molecular weight is too small, the resultant image-forming layer tends to have insufficient strength. On the other hand, when the number-average molecular weight is too large, the polymer is poor in the film-forming properties. Further, cross-linkable polymer latexes are particularly preferable.

Specific examples of the polymer latexes are described below. In the examples, the polymers are represented by the starting monomers, the numerals in parentheses represent the mass ratios (% by mass) of the monomers, and the molecular weights are number-average molecular weights. The polymers using multifunctional monomers have cross-linked structures and the concept of the molecular weight cannot be implemented therefor, whereby such polymers are referred to as cross-linked polymers and explanation of the molecular weight is omitted. Tg represents the glass-transition temperature.

P-1; Latex of -MMA(70)-EA(27)MAA(3)-(Molecular weight 37,000, Tg 61° C.)

P-2; Latex of -MMA(70)-2EHA(20)-St(5)-AA(5)-(Molecular weight 40,000, Tg 59° C.)

P-3; Latex of -St(50)-Bu(47)MAA(3)-(Cross-linked polymer, Tg −17° C.)

P-4; Latex of -St(68)-Bu(29)-AA(3)-(Cross-linked polymer, Tg 17° C.)

P-5; Latex of -St(71)-Bu(26)-AA(3)-(Cross-linked polymer, Tg 24° C.)

P-6; Latex of -St(70)-Bu(27)-IA(3)-(Cross-linked polymer)

P-7; Latex of -St(75)-Bu(24)-AA(1)-(Cross-linked polymer, Tg 29° C.)

P-8; Latex of -St(60)-Bu(35)-DVB(3)-MAA(2)-(Cross-linked polymer)

P-9; Latex of -St(70)-Bu(25)-DVB(2)-AA(3)-(Cross-linked polymer)

P-10; Latex of -VC(50)-MMA(20)-EA(20)-AN(5)-AA(5)-(Molecular weight 80,000)

P-11; Latex of -VDC(85)-MMA(5)-EA(5)-MAA(5)-(molecular weight 67,000)

P-12; Latex of -Et(90)-MAA(10)-(Molecular weight 12,000)

P-13; Latex of -St(70)-2EHA(27)-AA(3)-(Molecular weight 130,000, Tg 43° C.)

P-14; Latex of -MMA(63)-EA(35)-AA(2)-(Molecular weight 33,000, Tg 47° C.)

P-15: Latex of -St(70.5)-Bu(26.5)-AA(3)-(crosslinking, Tg 23° C.),

P-16: Latex of -St(69.5)-Bu(27.5)-AA(3)-(crosslinking, Tg 20.5° C.).

The abbreviations in the above examples represent the following monomers.

MMA; Methyl methacrylate
EA; Ethyl acrylate
MAA; Methacrylic acid
2EHA; 2-Ethylhexyl acrylate
St; Styrene
Bu; Butadiene
AA; Acrylic acid
DVB; Divinylbenzene
VC; Vinyl chloride
AN; Acrylonitrile
VDC; Vinylidene chloride
Et; Ethylene
IA; Itaconic acid Commercially-available polymer latexes may be used in the invention, and examples thereof include: acrylic polymers such as CEBIAN A-4635, 4718, and 4601 (available from Daicel Chemical Industries, Ltd.) and Nipol LX811, 814, 821, 820, and 857 (available from Nippon Zeon Co., Ltd.); polyesters such as FINETEX ES650, 611, 675, and 850 (available from Dainippon Ink and Chemicals, Inc.) and WD-size and WMS (available from Eastman Chemical Co.); polyurethanes such as HYDRAN AP10, 20, 30, and 40 (available from Dainippon Ink and Chemicals, Inc.); rubbers such as LACSTAR 7310K, 3307B, 4700H, and 7132C (available from Dainippon Ink and Chemicals, Inc.) and Nipol LX416, 410, 438C, and 2507 (available from Nippon Zeon Co., Ltd.); polyvinyl chlorides such as G351 and G576 (available from Nippon Zeon Co., Ltd.); polyvinylidene chlorides such as L502 and L513 (available from Asahi Kasei Kogyo K. K.); and polyolefins such as CHEMIPEARL S120 and SA100 (available from Mitsui Chemicals, Inc.).

Only a single polymer latex may be used or a mixture of two or more polymer latexes may be used in accordance with the necessity.

Preferred Latex

As the polymer latex used in the invention, latex of styrene—butadiene copolymer is particularly preferred. The ratio between the weight of styrene monomer units and the weight of butadiene monomer units in the styrene—butadiene copolymer is preferably in the range of 40:60 to 95:5. Further, the proportion of the total mass of styrene monomer units and the butadiene monomer units to the mass of the copolymer is preferably 60 mass % to 99 mass %. Further, the polymer latex may contain acrylic acid and/or methacrylic acid in an amount of preferably 1 mass % to 6 mass %, more preferably 2 mass % to 5 mass %, based on the total mass of the styrene monomer units and butadiene monomer units. The polymer latex preferably contains acrylic acid. A preferred range of the molecular weight is the same as described above.

The latex of the styrene—butadiene copolymer preferably used in the invention may be, for example, any of P-3 to P-8 and P-15 described above, or a commercially available product such as LACSTAR-3307B or 7132C, or Nipol LX416.

A hydrophilic polymer such as gelatin, polyvinyl alcohol, methylcellulose, hydroxypropylcellulose, and carboxymethylcellulose may be added to the image-forming layer of the photosensitive material of the invention if necessary. The amount of the hydrophilic polymer is preferably 30% by mass or less, more preferably 20% by mass or less, based on the total amount of the binder in the image-forming layer.

The organic silver salt containing layer (that is, image-forming layer) preferably includes a polymer latex. In the image-forming layer, the weight ratio of the binder to the organic silver salt is preferably in the range of 1/10 to 10/1, more preferably in the range of 1/3 to 5/1, furthermore preferably in the range of 1/1 to 3/1.

The layer containing the organic silver salt is generally the photosensitive layer (the image-forming layer) containing the photosensitive silver halide (the photosensitive silver salt). In this case, the weight ratio of the binder to the silver halide is preferably in the range of 400 to 5, more preferably in the range of 200 to 10.

In the invention, the total amount of the binder in the image-forming layer is preferably 0.2 to 30 g/m$^2$, more preferably 1 to 15 g/m$^2$, further preferably 2 to 10 g/m$^2$. In the image-forming layer of the invention, a crosslinker for closslinking and a surfactant for improvement of coatability may also be added.

Solvent for Preferred Coating Liquid

In the invention, the solvent of the coating liquid for the image-forming layer is preferably an aqueous solvent including 30% by mass or more of water. The term "solvent" used herein means a solvent or a dispersion medium. The aqueous solvent may include any water-miscible organic solvent such as methyl alcohol, ethyl alcohol, isopropyl alcohol, methyl cellosolve, ethyl cellosolve, dimethylformamide, and ethyl acetate. The water content of the solvent for the coating liquid is preferably 50% by mass or higher, more preferably 70% by mass or higher. Examples of preferred solvents include water, 90/10 mixture of water/methyl alcohol, 70/30 mixture of water/methyl alcohol, 80/15/5 mixture of water/methyl alcohol/dimethylformamide, 85/10/5 mixture of water/methyl alcohol/ethyl cellosolve, and 85/10/5 mixture of water/methyl alcohol/isopropyl alcohol, the numerals representing the mass ratios (% by mass).

(Other Additives)

1) Mercapto Compound, Disulfide Compound, and Thione Compound

Substances selected from mercapto compounds, disulfide compounds, and thione compounds may be used in the photothermographic material of the invention in order to control (inhibit or accelerate) the development, to heighten the spectral sensitization efficiency, or to improve the storability before or after the development, etc. Examples of the compounds are described in JP-A No. 10-62899, Paragraph 0067 to 0069; JP-A No. 10-186572, the compounds represented by the formula (I) and specific examples thereof described in Paragraph 0033 to 0052; EP-A No. 0803764A1, Page 20, Line 36–56; the disclosures of which are incorporated herein by reference. Mercapto-substituted heteroaromatic compounds described, for example, in JP-A Nos. 9-297367, 9-304875, 2001-100358, 2002-303954, and 2002-303951, (the disclosures of which are incorporated herein by reference) are particularly preferred in the invention.

2) Toning Agent

The photothermographic material of the invention preferably includes a toning agent and examples of toning agents are described in JP-A No. 10-62899, in column Nos. 0054 to 0055; EP-A No. 0803764A1, in page 21, lines 23–48; JP-A Nos. 2000-356317; and 2000-187298, the disclosur which are incorporated herein by reference. Examples of preferred toning agents include: phthalazinones (phthalazinone, phthalazinone derivatives and metal salts thereof; for example, 4-(1-naphthyl) phthalazinone, 6-chlorophthalazinone, 5,7-dimetoxyphthalazinone and 2,3-dihydro-1,4-phthalazione); combinations of phthalazinones and phthalic acids (for example, phthalic acid, 4-methyl phthalic acid, 4-nitro phthalic acid, diammonium phthalate, sodium phthalate, potassium phthalate, and tetrachloro phthalic acid anhydride); phthalazines (phthalazine, phthalazine derivative, and metal salts thereof; for example, 4-(1-naphthyl)phthalazine, 6-isopropyl phthalazine, 6-t-butyl phthalazine, 6-chlorophthalazine, 5,7-dimethoxyphthalazine and 2,3-dihydrophthalazine); and, combinations of phthalazines and phthalic acids. The toning agent is preferably a combination of a phthalazine and a phthalic acid, more preferably a combination of 6-isopropyl phthalazine and phthalic acid or 4-methylphthalic acid.

3) Plasticizer and Lubricant

In the invention, known platicizers and lubricants can be used for improving the film property. Particularly, in order to improve handlability during production and scratch resistance upon heat development, a lubricant such as liquid paraffin, a long chained fatty acid, a fatty acid amide, or a fatty acid ester may be used. The lubricant is preferably a liquid paraffin from which low boiling point ingredients have been removed or a fatty acid ester having a molecular weight of 1000 or higher and a branched structure.

Examples of the plasticizer and the lubricant usable in the image-forming layer and the non-photosensitive layer are described in JP-A No. 11-65021, in column No. 0117, JP-A Nos. 2000-5137, 2004-219794, and 2004-219802, the disclosures of which are incorporated herein by reference.

4) Dye and Pigment

Various kinds of dyes and pigments such as C.I. Pigment Blues 60, 64, and 15:6 may be used in the image-forming layer for the purpose of improving the color tone, preventing generation of interference fringe upon laser exposure, and preventing irradiation. The dyes and pigments are described in detail, for example, in WO 98/36322, JP-A Nos. 10-268465 and 11-338098, the disclosures of which are incorporated by reference herein.

6) Ulltra-high Contrast Agent

It is preferable to incorporate an ultra-high contrast agent into the image-forming layer when a ultra-high contrast image suitable for printing is needed. Examples of the ultra-high contrast agents, examples of the methods for adding them, and examples of the amount thereof are described in JP-A No. 11-65021, Paragraph 0118; JP-A No. 11-223898, Paragraph 0136 to 0193; JP-A No. 2000-284399 (the compounds each represented by any one of the formulae (H), (1) to (3), (A), and (B)); etc. Further, examples of ultra-high contrast agents are described in JP-A No. 11-65021, Paragraph 0102, and JP-A No. 11-223898, Paragraph 0194 and 0195. The disclosures of the above patent documents are incorporated herein by reference.

Formic acid or a formate salt may be used as a strong fogging agent. The amount of the formic acid or the formate salt per 1 mol of silver is preferably 5 mmol or smaller, more preferably 1 mmol or smaller, on the the image-forming layer side.

In the photothermographic material of the invention, the ultra-high contrast agent is preferably used in combination with an acid generated by hydration of diphosphorus pentaoxide or a salt thereof. Examples of the acid and the salt include metaphosphoric acid, pyrophosphoric acid, orthophosphoric acid, triphosphoric acid, tetraphosphoric acid, hexametaphosphoric acid, and salts thereof. Particularly preferred are orthophosphoric acid, hexametaphosphoric acid, and salts thereof. Specific examples of the salts include sodium orthophosphate, sodium dihydrogen orthophospate, sodium hexametaphosphate, and ammonium hexametaphosphate.

The amount of the acid generated by the hydration of diphosphorus pentaoxide or the salt thereof may be selected depending on the sensitivity, the fogging properties, etc. The amount of the acid or the salt to be applied per 1 $m^2$ of the photosensitive material is preferably 0.1 to 500 $mg/m^2$, more preferably 0.5 to 100 $mg/m^2$.

In the invention, the reducing agent, the hydrogen bonding compound, the development accelerator, and the polyhalogen compound each may be used preferably in the form of a solid dispersion. Examples of preferable manufacturing methods of the solid dispersion are described in JP-A No. 2002-55405, the disclosure of which is incorporated herein by reference.

(Preparation and Application of Coating Liquid)

The coating liquid for the image-forming layer is prepared preferably at a preparation temperature of 30 to 65° C., more preferably 35 to 60° C., furthermore preferably 35 to 55° C. The temperature of the coating liquid immediately after addition of polymer latex is preferably 30 to 65° C.

(Other Layer Structure and Constituent Components)

1) Surface Protective Layer

The photothermographic material of the invention may be provided with a surface protective layer for the purpose of, for example, preventing adhesion of the image forming layer. The surface protective layer may have a monolayered structure or a multilayered structure.

The surface protective layer is described, for example, in paragraph Nos. 0119 to 0120 of JP-A No. 11-65021, and JP-A No. 2000-171936, the disclosures of which are incorporated herein by reference.

As the binder for the surface protective layer, gelatin is preferred. It is also preferable to use polyvinyl alcohol (PVA) singly or in combination with gelatin. Examples of usable gelatins include inert gelatin (e.g., Nitta gelatin 750) and phthalated gelatin (e.g., Nitta gelatin 801). PVA may be selected from ones described in paragraph Nos. 0009 to 0020 of JP-A 2000-171936, preferably from PVA-105, which is a completely saponified product, PVA-205, which is a partially saponified product, PVA-335, which is a partially saponified product, or MP-203, which is a modified polyvinyl alcohol (all are manufactured by Kuraray Co., Ltd.), and the like. The coating amount (per square meter of the support) of polyvinyl alcohol of the protective layer (per one layer) is preferably 0.3 $g/m^2$ to 4.0 $g/m^2$, and more preferably 0.3 $g/m^2$ to 2.0 $g/m^2$.

The coating amount (per square meter of the support) of the total binder (including water-soluble polymers and latex polymers) of the protective layer (per one layer) is preferably 0.3 $g/m^2$ to 5.0 $g/m^2$, more preferably 0.3 $g/m^2$ to 2.0 $g/m^2$.

The surface protective layer preferably includes a lubricant such as liquid paraffin or an aliphatic ester. The lubricant is used in an amount of 1 $mg/m^2$ to 200 $mg/m^2$, preferably 10 $mg/m^2$ to 150 $mg/m^2$, more preferably 20 $mg/m^2$ to 100 $mg/m^2$.

2) Antihalation Layer

In the photothermographic material of the invention, an antihalation layer may be disposed such that the antihalation layer is farther from the exposure light source than the image-forming layer is.

The antihalation layer is described, for example, in JP-A No. 11-65021, Paragraph 0123 to 0124, JP-A Nos. 11-223898, 9-230531, 10-36695, 10-104779, 11-231457, 11-352625, and 11-352626, the disclosures of which are incorporated herein by reference.

The antihalation layer includes an antihalation dye having absorption in the exposure wavelength range. When the exposure wavelength is within the infrared range, an infrared-absorbing dye may be used as the antihalation dye, and the infrared-absorbing dye is preferably a dye which does not absorb visible light.

When a dye having absorption in the visible light range is used to prevent the halation, in a preferable embodiment, the color of the dye does not substantially remain after image formation. It is preferable to achromatize the dye by heat at the heat development. In a more preferable embodiment, a base precursor and a thermally-achromatizable dye are added to a non-photosensitive layer so as to impart the antihalation function to the non-photosensitive layer. These techniques are described, for example in JP-A No. 11-231457, the disclosure of which is incorporated by reference herein.

The amount of the achromatizable dye to be applied may be determined depending on the purpose. Generally, the amount of the achromatizable dye is selected such that the optical density (the absorbance) exceeds 0.1 at the desired wavelength. The optical density is preferably 0.15 to 2, more preferably 0.2 to 1. The amount of the dye required for obtaining such an optical density is generally 0.001 to 1 $g/m^2$.

When the dye is achromatized in this manner, the optical density after the heat development can be lowered to 0.1 or lower. In an embodiment, two or more achromatizable dyes are used in combination in a thermally achromatizable recording material or a photothermographic material. Similarly, two or more base precursors may be used in combination.

In the thermal achromatization, it is preferable to use an achromatizable dye, a base precursor, and a substance which can lower the melting point of the base precursor by 3° C. or more when mixed with the base precursor, in view of the thermal achromatizability, as described in JP-A No. 11-352626, the disclosure of which is incorporated by reference herein. Examples of the substance include diphenylsulfone, 4-chlorophenyl(phenyl)sulfone, and 2-naphtyl benzoate.

3) Back Layer

Examples of the back layer usable in the invention are described in JP-A No. 11-65021, Paragraph 0128 to 0130, the disclosure of which is incorporated herein by reference.

In the invention, a coloring agent having an absorption peak within the wavelength range of 300 to 450 nm may be added to the photosensitive material so as to improve the color tone of silver and to suppress the image deterioration with time. Examples of the coloring agent are described in JP-A Nos. 62-210458, 63-104046, 63-103235, 63-208846, 63-306436, 63-314535, 01-61745, and 2001-100363, the disclosures of which are incorporated by refernce herein.

Such a coloring agent is generally added in an amount in the range of 0.1 $mg/m^2$ to 1 $g/m^2$. In an embodiment, a coloring agent is added to a back layer disposed on the opposite side to the image forming layer.

It is preferable to use a dye having an absorption peak at 580 to 680 nm in order to control base color tone. Preferable examples of the dye include azomethine type oil-soluble dyes described in JP-A Nos. 4-359967 and 4-359968, and phthalocyanine type water-soluble dyes described in JP-A No. 2003-295388, which each have a small absorption intensity in the shorter wavelength range. The disclosures of the above patent documents are incorporated herein by reference. The dye for this purpose may be added to any layer, preferably to a non-photosensitive layer on the image forming layer side or on the back side.

The photothermographic material of the invention is preferably a so-called single-sided photosensitive material, which comprises at least one image-forming layer including the silver halide emulsion on one side of the support, and a back layer on the other side of the support.

4) Matting Agent

In the invention, a matting agent is preferably added to improve the conveyability. The matting agent is described in JP-A No. 11-65021, Paragraph 0126 and 0127, the disclosure of which is incorporated herein by reference. The amount of the matting agent to be applied per 1 $m^2$ of the photosensitive material is preferably 1 to 400 $mg/m^2$, more preferably 5 to 300 $mg/M^2$.

The matting agent may be delomorphous or amorphous, and is preferably delomorphous. The matting agent is preferably in a sphere shape.

The volume-weighted average equivalent sphere diameter of the matting agent provided on the emulsion surface is preferably 0.3 to 10 μm, more preferably 0.5 to 7 μm. The variation coefficient of the particle size distribution of the matting agent is preferably 5 to 80%, more preferably 20 to 80%. The variation coefficient is obtained according to the equation:

$$\text{variation coefficient}=(\text{standard deviation of particle diameter})/(\text{average particle diameter})\times 100.$$

Further, two or more types of the matting agents having different average particle sizes may be provided on the emulsion surface. In this case, the difference of the average particle sizes between the smallest matting agent and the largest matting agent is preferably 2 to 8 μm, more preferably 2 to 6 μm.

The volume-weighted average equivalent sphere diameter of the matting agent provided on the back surface is preferably 1 to 15 μm, more preferably 3 to 10 μm. The variation coefficient of the particle size distribution of the matting agent is preferably 3 to 50%, more preferably 5 to 30%. Further, two or more types of the matting agents having different average particle sizes may be provided on the back surface. In this case, the difference of the average particle sizes between the smallest matting agent and the largest matting agent is preferably 2 to 14 μm, more preferably 2 to 9 μm.

The mattness of the emulsion surface is not limited as long as star defects are not caused. The Beck smoothness of the surface is preferably 30 to 2,000 seconds, particularly preferably 40 to 1,500 seconds. The Beck smoothness can be easily obtained by *Method for testing smoothness of paper and paperboard* by Beck tester according to JIS P8119, or TAPPI standard method T479, the disclosures of which are incorporated by reference herein.

The mattness of the back layer is preferably such that the Beck smoothness is 10 to 1,200 seconds. The Beck smoothness is more preferably 20 to 800 seconds, further preferably 40 to 500 seconds.

In the invention, the matting agent is preferably included in a layer or layers selected from the outermost layer, layers functioning as the outermost layer, and layers near the outermost layer. In an embodiment, the matting agent is included in a layer functioning as a protective layer.

5) Polymer Latex

When the photothermographic material of the invention is used for printing, in which dimensional change is problematic, it is preferable to use a polymer latex in a surface protective layer and/or a back layer. Such a polymer latex is described, for example, in *Gosei Jushi Emlulsion*, (compiled by Taira Okuda and Hiroshi Inagaki, issued by Kobunshi Kanko Kai (1978)); *Gosei Latex no Oyo*, (compiled by Takaaki Sugimura, Yasuo Kataoka, Souichi Suzuki, and Keishi Kasahara, issued by Kobunshi Kanko Kai (1993); *Gosei Latekkusu no Kagaku* (written by Soichi Muroi, issued by Kobunshi Kanko Kai (1970)), the disclosures of which are incorporated herein by reference. Specific examples thereof include latex of methyl methacrylate (33.5 mass %)—ethyl acrylate (50 mass %)—methacrylic acid (16.5 mass %) copolymer, latex of methyl methacrylate (47.5 mass %)—butadiene (47.5 mass %)—itaconic acid (5 mass %) copolymer, latex of ethyl acrylate-methacrylic acid copolymer, latex of methyl methacrylate (58.9 mass %)—2-ethylhexyl acrylate (25.4 mass %)—styrene (8.6 mass %)—2-hydroxyethyl methacrylate (5.1 mass %)—acrylic acid (2.0 mass %) copolymer, and latex of methyl methacrylate (64.0 mass %)—styrene (9.0 mass %)—butyl acrylate (20.0 mass %)—2-hydroxyethyl methacrylate (5.0 mass %)—acrylic acid (2.0 mass %) copolymer. Further, regarding the binder for the surface protective layer, the technique described in paragraph Nos. 0021 to 0025 of JP-A No. 2000-267226 and the technique described in paragraph Nos. 0023 to 0041 of JP-A No. 2000-19678 may also be applied. The proportion of amount of the polymer latex to the total amount of binder in the surface protective layer is preferably 10 mass % to 90 mass %, more preferably 20 mass % to 80 mass %.

6) Film Surface pH

The photothermographic material of the invention before heat development preferably has a surface pH of 7.0 or lower. The surface pH is more preferably 6.6 or lower. The lower limit of the surface pH may be approximately 3, though it is not particularly restricted. The surface pH is still more preferably 4 to 6.2. It is preferable to adjust the surface pH using an organic acid such as a phthalic acid derivative, a nonvolatile acid such as sulfuric acid, or a volatile base such as ammonia, from the viewpoint of lowering the surface pH. In order to achieve a low surface pH, it is preferable to use ammonia since ammonia is high in volatility and can be removed during coating or before heat development. It is also preferable to use ammonia in combination with a nonvolatile base such as sodium hydroxide, potassium hydroxide, or lithium hydroxide. Methods for measuring the surface pH are described in JP-A No. 2000-284399, Paragraph 0123, the disclosure of which is incorporated herein by reference.

7) Film Hardener

A film hardener may be included in layers such as the image-forming layer, the protective layer, and the back layer. Examples of the film hardeners are described in T. H. James, *The Theory of the Photographic Process, Fourth Edition*, Page 77 to 87 (Macmillan Publishing Co., Inc., 1977), the disclosure of which is incorporated by reference herein. Preferred examples of the film hardeners include: chromium alums; 2,4-dichloro-6-hydroxy-s-triazine sodium salt; N,N-ethylenebis(vinylsulfonacetamide); N,N-propylenebis(vinylsulfonacetamide); polyvalent metal ions described in Page 78 of the above reference; polyisocyanates described in U.S. Pat. No. 4,281,060, JP-A No. 6-208193, etc.; epoxy compounds described in U.S. Pat. No. 4,791,042, etc.; and vinylsulfone compounds described in JP-A No. 62-89048, etc. The disclosures of the above patent documents are incorporated herein by reference.

The film hardener is added in the form of a solution, and the solution is added to the coating liquid for the protective layer preferably in the period of 180 minutes before coating to immediately before coating, more preferably in the period of 60 minutes before coating to 10 seconds before coating. The method and conditions of mixing the film hardener into the coating liquid are not particularly limited as long as the advantageous effects of the invention can be sufficiently obtained. In an embodiment, the film hardner is mixed with the coating liquid in a tank while controlling the addition flow rate and the feeding amount to the coater, such that the average retention time calculated from the addition flow rate and the feeding amount to the coater is the desired time. In another embodiment, the film hardner is mixed with the coating liquid by a method using a static mixer described, for example, in N. Hamnby, M. F. Edwards, and A. W. Nienow, translated by Koji Takahashi, *Ekitai Kougo Gijutsu*, Chapter 8 (Nikkan Kogyo Shimbun, Ltd., 1989), the disclosure of which is incorporated herein by reference.

8) Surfactant

Surfactants described in JP-A No. 11-65021 (the disclosure of which is incorporated herein by reference in its entirety), Paragraph 0132, solvents described in ibid, Paragraph 0133, supports described in ibid, Paragraph 0134, antistatic layers and conductive layers described in ibid, Paragraph 0135, methods for forming color images described in ibid, Paragraph 0136, and slipping agents described in JP-A No. 11-84573 (the disclosure of which is incorporated herein by reference in its entirety), Paragraph 0061 to 0064 and JP-A No. 2001-83679 (the disclosure of which is incorporated herein by reference in its entirety) Paragraph 0049 to 0062, can be used in the invention.

In the invention, it is preferable to use a fluorochemical surfactants. Specific examples of the fluorochemical surfactants include compounds described in JP-A Nos. 10-197985, 2000-19680, and 2000-214554, the disclosures of which are incorporated herein by reference. Further, fluorine-containing polymer surfactants described in JP-A No. 9-281636 (the disclosure of which is incorporated herein by reference) are also preferable in the invention. In an embodiment, the fluorochemical surfactants described in JP-A Nos. 2002-82411, 2003-057780, and 2003-149766 (the disclosures of which are incorporated herein by reference) are used in the photothermographic material of the invention. The fluorochemical surfactants described in JP-A Nos. 2003-057780 are particularly preferred from the viewpoints of the electrification control, the stability of the coating surface, and the slipping properties in the case of using an aqueous coating liquid. The fluorochemical surfactants described in JP-A No. 2003-149766 are most preferred because they are high in the electrification control ability and are effective even when used in a small amount.

In the invention, the fluorochemical surfactant may be used in the emulsion surface and/or the back surface, and is preferably used in both the emulsion surface and/or the back surface. It is particularly preferable to use a combination of the fluorochemical surfactant and the above-described conductive layer including a metal oxide. In this case, sufficient performance can be achieved even if the fluorochemical surfactant in the electrically conductive layer side is reduced or removed.

The amount of the fluorochemical surfactant used in each of the image-forming layer side and the back side is preferably 0.1 to 100 mg/m$^2$, more preferably 0.3 to 30 mg/m$^2$, further preferably 1 to 10 mg/m$^2$.

9) Antistatic Agent

The photothermographic material of the invention preferably comprises an electrically conducting layer including an electrically conductive material such as a metal oxide or an electrically conductive polymer. The electrically conducting layer (antistatic layer) may be the same layer as a layer selected from the undercoat layer, the back layer, the surface protective layer, and the like, or may be provided as a separate layer which is different from those layers.

In a preferable embodiment, the conductive substance in the electrically conducting layer is a metal oxide whose conductivity has been heightened by incorporation of oxigen defects or heterometal atom. The metal oxide is preferably ZnO, $TiO_2$, or $SnO_2$. It is preferable to add Al, In, or the like to ZnO. It is preferable to add Sb, Nb, P, a halogen atom, or the like to $SnO_2$. It is preferable to add Nb, Ta, or the like to $TiO_2$. $SnO_2$ to which Sb has been added is particularly preferable conductive substance for the electrically conducting layer. The amount of the hetero atom is preferably 0.01 to 30 mol %, more preferably 0.1 to 10 mol %. The particles of the metal oxide may be in a spherical shape, in a needle shape, or in a plate shape. The metal oxide particles are preferably needle-shaped particles with the ratio of the major axis to the minor axis of 2.0 or higher in view of the conductivity, and the ratio is more preferably 3.0 to 50. The amount of the metal oxide is preferably 1 to 1,000 mg/m$^2$, more preferably 10 to 500 mg/m$^2$, furthermore preferably 20 to 200 mg/m$^2$. The antistatic layer may be provided on the image-forming layer side or on the back side. In a preferable embodiment, the antistatic layer is provided between the support and the back layer. Specific examples of the antistatic layer are described in JP-A No. 11-65021, Paragraph 0135; JP-A Nos. 56-143430, 56-143431, 58-62646, and 56-120519; JP-A No. 11-84573, Paragraph 0040 to 0051; U.S. Pat. No. 5,575,957; and JP-A No. 11-223898, Paragraph 0078 to 0084; the disclosures of which are incorporated herein by reference.

10) Support

The support comprises preferably a heat-treated polyester, particularly a polyethylene terephthalate, which is subjected to a heat treatment at 130 to 185° C. so as to relax the internal strains of the film generated during biaxial stretching, thereby eliminating the heat shrinkage strains during heat development. In the case of a photothermographic material for medical use, the support may be colored with a blue dye (e.g., Dye-1 described in Examples of JP-A No. 8-240877, the disclosure of which is incorporated herein by reference) or uncolored. The support is preferably undercoated, for example, with a water-soluble polyester described in JP-A No. 11-84574, a styrene-butadiene copolymer described in JP-A No. 10-186565, or a vinylidene chloride copolymer described in JP-A No. 2000-39684, the disclosures of which are incorporated herein by reference. When the support is coated with the image-forming layer or the back layer, the support preferably has a moisture content of 0.5% by mass or lower.

11) Other Additives

The photothermographic material of the invention may further include additives such as antioxidants, stabilizing agents, plasticizers, UV absorbers, and coating aids. The additives may be added to any one of the image-forming layer and the non-photosensitive layers. The additives may be used with reference to WO 98/36322, EP 803764A1, JP-A Nos. 10-186567 and 10-18568, the disclosures of which are incorporated herein by reference.

12) Coating Method

The photothermographic material of the invention may be formed by any coating method. Specific examples of the coating method include extrusion coating methods, slide coating methods, curtain coating methods, dip coating methods, knife coating methods, flow coating methods, extrusion coating methods using a hopper described in U.S. Pat. No. 2,681,294, the disclosure of which is incorporated herein by reference. The coating method is preferably an extrusion coating method described in Stephen F. Kistler and Petert M. Schweizer, *Liquid Film Coating*, Page 399 to 536 (CHAPMAN & HALL, 1997) (the disclosure of which is incorporated herein by reference), or a slide coating method, more preferably a slide coating method. Examples of slide coaters for the slide coating methods are described in the above reference, Page 427, FIG. 11b.1. Two or more layers may be simultaneously formed by any of methods described in the above reference, Page 399 to 536, and methods described in U.S. Pat. No. 2,761,791 and British Patent No. 837,095, the disclosures of which are incorporated herein by reference. Particularly preferred coating methods used in the invention include those described in JP-A Nos. 2001-194748, 2002-153808, 2002-153803, and 2002-182333, the disclosures of which are incorporated herein by reference.

In the invention, the coating liquid for the image-forming layer is preferably a so-called thixotropy fluid. The thixotropy fluid may be used with reference to JP-A No. 11-52509, the disclosure of which is incorporated herein by reference. The viscosity of the coating liquid for the image-forming layer is preferably 400 to 100,000 mPa.s at a shear rate of 0.1 $S^{-1}$, more preferably 500 to 20,000 mPa.s at a shear rate of 0.1 $S^{-1}$. Further, the viscosity of the coating liquid is preferably 1 to 200 mPa.s at a shear rate of 1,000 $S^{-1}$, more preferably 5 to 80 mPa.s at the shear rate of 1,000 $S^{-1}$.

In the preparation of the coating liquid, it is preferable to use a known in-line mixing apparatus or a known in-plant mixing apparatus when two or more liquids are mixed. An in-line mixing apparatus described in JP-A No. 2002-85948 and an in-plant mixing apparatus described in JP-A No. 2002-90940 can be preferably used in the invention. The disclosures of the above patent documents are incorporated by reference herein. The coating liquid is preferably subjected to a defoaming treatment to obtain an excellent coating surface. Preferred methods for the defoaming treatment are described in JP-A No. 2002-66431, the disclosure of which is incorporated herein by reference.

In or before the application of the coating liquid, the support is preferably subjected to electrical neutralization so as to prevent adhesion of dusts, dirts, etc. caused by the electrification of the support. Preferred examples of the neutralizing methods are described in JP-A No. 2002-143747, the disclosure of which is incorporated herein by reference.

When a non-setting type coating liquid for the image-forming layer is dried, it is important to precisely control drying air and drying temperature. Preferred drying methods are described in detail in JP-A Nos. 2001-194749 and 2002-139814, the disclosures of which are incorporated herein by reference.

The photothermographic material of the invention is preferably heat-treated immediately after coating and drying, so as to increase the film properties. In a preferable embodiment, the heating temperature of the heat treatment is controlled such that the film surface temperature is 60 to 100° C. The heating time is preferably 1 to 60 seconds. The film surface temperature in the heat treatment is more preferably 70 to 90° C., and the heating time is more preferably 2 to 10 seconds. Preferred examples of the heat treatments are described in JP-A No. 2002-107872, the disclosure of which is incorporated herein by reference.

Further, the production methods described in JP-A Nos. 2002-156728 and 2002-182333 (the disclosures of which are incorporated herein by reference) can be preferably used to stably produce the photothermographic material of the invention continuously. The photothermographic material of the invention is preferably a monosheet type material, which can form an image on the material without using another sheet such as an image-receiving material.

13) Packaging Material

It is preferable to seal the photosensitive material of the invention by a packaging material having a low oxygen permeability and/or a low water permeability so as to prevent deterioration of the photographic properties during storage or to prevent curling. The oxygen permeability is preferably 50 ml/atm·m$^2$·day or lower at 25° C., more preferably 10 ml/atm·m$^2$·day or lower at 25° C., furthermore preferably 1.0 ml/atm·m$^2$·day or lower at 25° C. The water permeability is preferably 10 g/atm·m$^2$·day or lower, more preferably 5 g/atm·m$^2$·day or lower, furthermore preferably 1 g/atm·m$^2$·day or lower.

Specific examples of the packaging material having a low oxygen permeability and/or a low water permeability include materials described in JP-A Nos. 8-254793 and 2000-206653, the disclosures of which are incorporated herein by reference.

14) Other Utilizable Technique

Other technologies usable for the photothermographic material of the invention include those described in EP 803764A1, EP 883022A1, WO 98/36322, and JP-A Nos. 56-62648, 58-62644, 943766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-11-352627, 11-305377, 11-305378, 11-305384, 11-305380, 11-316435, 11-327076, 11-338096, 11-338098, 11-338099, 11-343420, 2001-200414, 2001-234635, 2002-020699, 2001-275471, 2001-275461, 2000-313204, 2001-292844, 2000-324888, 2001-293864, 2001-348546, and 2000-187298, the disclosures of which are incorporated herein by reference.

In the case a multi-color photothermographic material, the image-forming layers are generally separated from each other by providing functional or nonfunctional barrier layers between them as described in U.S. Pat. No. 4,460,681, the disclosure of which is incorporated herein by reference.

The multicolor photothermographic material may comprise an arbitrary combination of two or more layers for each color or a single layer including all the components as described in U.S. Pat. No. 4,708,928, the disclosure of which is incorporated herein by reference.

The photothermographic material of the invention may be exposed by using an X-ray intensifying screen 1, or may be exposed by the following method.

(Image Forming Method)

1) Exposure

The exposure light source may be a red to infrared emission laser such as an He—Ne laser and a red semiconductor laser, or a blue to greed emission laser such as an $Ar^+$ laser, an He—Ne laser, an He—Cd laser, and a blue semiconductor laser. The laser is preferably a red to infrared emission semiconductor laser, and the peak wavelength of the laser is 600 to 900 nm, preferably 620 to 850 nm.

In recent years, a blue semiconductor laser and a module comprising an SHG (Second Harmonic Generator) and a semiconductor laser have been developed, and thus laser output units with short wavelength ranges have attracted much attention. The blue semiconductor lasers can form a highly fine image, can increase recording density, is long-lived, and has stable output, whereby the demand therefor is expected to be increased. The peak wavelength of the blue laser is preferably 300 to 500 nm, more preferably 400 to 500 nm.

In a preferable embodiment, the laser light is emitted in vertical multimode by high frequency superposition, etc.

2) Heat Development

The photothermographic material of the invention may be developed by any method, but is generally exposed image-wise and then heat-developed. The development temperature is preferably 80 to 250° C., more preferably 100 to 140° C., further preferably 110 to 130° C. The development time is preferably 1 to 60 seconds, more preferably 3 to 30 seconds, furthermore preferably 5 to 25 seconds, particularly preferably 7 to 16 seconds.

The heater used in heat development may be a drum heater or a plate heater, preferably a plate heater. A heat development method using a heat development apparatus comprising a plate heater described in JP-A No. 11-133572 (the disclosure of which is incorporated herein by reference) can be preferably used in the invention. The heat development apparatus comprises a heat developing section, and a visible image is formed by: forming a latent image on a photothermographic material, and bringing the material into contact with a heating unit in the heat developing section. In the heat development apparatus, the heating unit comprises the plate heater, a plurality of press rollers facing each other are arranged along one surface of the plate heater, and the photothermographic material is passed between the press rollers and the plate heater to be heat-developed. In a preferable embodiment, the plate heater is divided into two to six stages and the temperature of the end part is lowered by approximately 1 to 10° C. For example, four plate heaters may be independently controlled at 112° C., 119° C., 121° C., and 120° C. Such a method is described also in JP-A No. 54-30032, the disclosure of which is incorporated by reference herein. In the method, water and organic solvents included in the photothermographic material can be removed, and deformation of the support caused by rapid heating can be prevented.

To reduce the size of the heat development apparatus and the heat development time, more stable control of the heater is preferred. In an embodiment, the heat development of the leading end of the photothermographic material is started before the rear end is exposed. Rapid processing type imagers preferred for the invention are described in JP-A Nos. 2003-285455, the disclosure of which is incorporated herein by reference. When such an imager is used, for example, the photothermographic material can be heat-developed in 14 seconds by a plate heater having three stages controlled at 107° C., 121° C., and 121° C. respectively, and the first sheet of the material can be outputted in about 60 seconds. In such rapid development, it is preferable to use the photothermographic material 2 of the invention, which is high in the sensitivity and hardly affected by ambient temperature.

3) System

Fuji Medical Dry Laser Imager FM-DPL and DRYPIX 7000 are known as laser imagers for medical use comprising an exposure region and a heat developing region. FM-DPL is described in *Fuji Medical Review*, No. 8, Page 39 to 55 (the disclosure of which is incorporated herein by reference), and the technologies disclosed therein can be applied to the invention. The photothermographic material of the invention can be used for the laser imager in AD Network, proposed by Fuji Film Medical Co., Ltd. as a network system according to DICOM Standards.

(Intended Purposes of the Invention)

The photothermographic material according to the invention is preferably used for forming a black and white image of silver, and is preferably used for medical diagnoses, industrial photographs, printings, or COM.

EXAMPLES

The present invention will be described below with reference to Examples without intention The present invention will be described below with reference to Examples without intention of restricting the scope of the invention.

Example 1

(Preparation of PET Support)

1) Film Formation

A PET having an intrinsic viscosity IV of 0.66, which was measured in a 6/4 mixture (weight ratio) of phenol/tetrachloroethane at 25° C., was prepared from terephthalic acid and ethylene glycol by a common procedure. The PET was converted to a pellet, dried at 130° C. for 4 hours, melted at 300° C., extruded from a T-die, and rapidly cooled to prepare an unstretched film.

The film was stretched 3.3 times in the longitudinal direction at 110° C. by rollers with different peripheral speeds, and then stretched 4.5 times in the horizontal direction at 130° C. by a tenter. The stretched film was subjected to thermal fixation at 240° C. for 20 seconds, and relaxed by 4% in the horizontal direction at this temperature. Then, the chuck of the tenter was slit, the both ends of the film were knurled, and the film was rolled up into 4 kg/cm$^2$, to obtain a roll having a thickness of 175 μm.

2) Surface Corona Treatment

Both surfaces of the support were treated at the room temperature at 20 n/minute using a solid state corona treatment machine Model 6KVA manufactured by Piller Inc. The electric current and voltage were read in the treatment, whereby it was found that the support was treated under the condition of 0.375 kV·A·minute/m$^2$. The discharging frequency of the treatment was 9.6 kHz, and the gap clearance between the electrode and the dielectric roll was 1.6 mm.

3) Undercoating

Prescription (1) for an undercoat layer on the image-forming layer side

- 46.8 g of PESRESIN A-520 (30% by mass solution) available from Takamatsu Oil & Fat Co., Ltd.
- 10.4 g of VYLONAL MD-1200 available from Toyobo Co., Ltd.
- 11.0 g of a 1% by mass solution of polyethylene glycol monononyl phenyl ether (average ethylene oxide number 8.5)
- 0.91 g of MP-1000 (fine PMMA polymer grains, average grain diameter 0.4 μm) available from Soken Chemical & Engineering Co., Ltd.
- 931 ml of distilled water Prescription (2) for a first back undercoat layer

- 130.8 g of a styrene-butadiene copolymer latex (solid content 40% by mass, styrene/butadiene weight ratio 68/32)
- 5.2 g of an 8% by mass aqueous solution of 2,4-Dichloro-6-hdroxy-S-triazine sodium salt
- 10 ml of a 1% by mass aqueous solution of sodium laurylbenzenesulfonate
- 0.5 g of a polystyrene grain dispersion (average grain diameter 2 μm, 20% by mass)
- 854 ml of distilled water Prescription (3) for a second back undercoat layer

- 84 g of a 17% by mass dispersion of $SnO_2$/SbO (9/1 mass ratio, average grain diameter 0.5 μm)
- 7.9 g of gelatin
- 10 g of METOLOSE TC-5 (2% by mass aqueous solution) available from Shin-Etsu Chemical Co., Ltd.
- 10 ml of a 1% by mass aqueous solution of sodium dodecylbenzenesulfonate
- 7 g of a 1% by mass NaOH
- 0.5 g of PROXEL available from Avecia Ltd.
- 881 ml of distilled water After subjecting the both surfaces of the biaxially stretched polyethylene terephthalate support having a thickness of 175 μm to the corona treatment, the undercoating liquid of Prescription (1) was applied to one surface (the image-forming side) of the support by a wire bar in a wet amount of 6.6 ml/m$^2$, and dried at 180° C. for 5 minutes. Then, the undercoating liquid of Prescription (2) was applied to the other surface (back surface) by a wire bar in a wet amount of 5.7 ml/m$^2$, and dried at 180° C. for 5 minutes. Further, the undercoating liquid of Prescription (3) was applied to the back surface by a wire bar in a wet amount of 8.4 ml/m$^2$, and dried at 180° C. for 6 minutes, to prepare an undercoated support.

(Back Layer)

1) Preparation of Coating Liquid for Back Layer (Preparation of Base Precursor Solid Particle Dispersion Liquid (a))

2.5 kg of the base precursor 1 to be hereinafter illustrated, 300 g of a surfactant DEMOL N (trade name, available from Kao Corporation), 800 g of diphenyl sulfone, and 1.0 g of benzoisothiazolinone sodium salt were mixed with distilled water into the total amount of 8.0 kg. The mixture liquid was fed by a diaphragm pump to a horizontal-type sand mill UVM-2 manufactured by Imex Co., which was packed with zirconia beads having the average diameter of 0.5 mm, and bead-dispersed in the mill under an inner pressure of 50 hPa or higher until the desired average particle diameter was obtained.

The dispersion process was carried out while conducting an optical absorption measurement until the ratio of the absorbencies at 450 nm and 650 nm (D450/D650) became 3.0. The obtained dispersion was diluted with distilled water until the base precursor concentration became 25% by weight, and filtrated by a polypropylene filter having an average pore diameter of 3 μm to remove extraneous substances.

2) Preparation of Dye Solid Particle Dispersion Liquid 6.0 kg of the cyanine dye 1 to be hereinafter illustrated, 3.0 kg of sodium p-dodecylbenzenesulfonate, 0.6 kg of a surfactant DEMOL SNB available from Kao Corporation, and 0.15 kg of an antifoaming agent SURFYNOL 104E (trade name, available from Nissin Chemical Industry Co., Ltd.) were mixed with distilled water into the total amount of 60 kg. The mixture liquid was dispersed in the presence of 0.5 mm zirconia beads by using a horizontal-type sand mill UVM-2 manufactured by Imex Co.

The dispersion process was carried out while conducting an optical absorption measurement until the ratio of the absorbencies at 650 nm and 750 nm (D650/D750) became 5.0 or more. The obtained dispersion was diluted with distilled water until the cyanine dye concentration became 6% by mass, and filtrated by a filter having an average pore diameter of 1 μm to remove extraneous substances.

3) Preparation of Coating Liquid for Antihalation Layer 40 g of gelatin, 0.1 g of benzoisothiazolinone, and 490 mi of water were added to a vessel to dissolve the gelatin while keeping the temperature of the vessel at 40° C. Further, to this were added 2.3 ml of a 1 mol/l aqueous sodium hydroxide solution, 40 g of the above dye solid particle dispersion liquid, 90 g of the above base precursor solid particle dispersion liquid (a), 12 ml of a 3% by mass aqueous solution of sodium polystyrene sulfonate, and 180 g an 10% by mass SBR latex. 80 ml of a 4% by mass aqueous solution of N,N-ethylenebis(vinylsulfoneacetamide) was added to the resultant mixture immediately before coating, to give an antihalation layer coating liquid.

4) Preparation of Coating Liquid for Back Protective Layer

<<Preparation of Back Protective Layer Coating Liquid 1>>

40 g of gelatin, 35 mg of benzoisothiazolinone, and 840 ml of water were added to a vessel to dissolve the gelatin while keeping the temperature of the vessel at 40° C. Further, to this were added 5.8 ml of a 1 mol/l aqueous sodium hydroxide solution, 5 g of a 10% by mass emulsion of a liquid paraffin, 5 g of a 10% by mass emulsion of triisostearic acid trimethylolpropane, 10 ml of a 5% by mass aqueous solution of sodium di(2-ethylhexyl)sulfosuccinate, 20 ml of a 3% by mass aqueous solution of sodium polystyrenesulfonate, 2.4 ml of a 2% by mass solution of a fluorochemical surfactant (F-1), 2.4 ml of a 2% by mass solution of a fluorochemical surfactant (F-2), and 32 g of a 19% by mass latex liquid of a methyl methacrylate/styrene/butyl acrylate/hydroxyethyl methacrylate/acrylic acid copolymer (copolymerization weight ratio 57/8/28/5/2). 25 ml of a 4% by mass aqueous solution of N,N-ethylenebis(vinylsulfoneacetamide) was added to the resultant mixture immediately before coating, to give a back protective layer coating liquid.

5) Application of Back Layer

The back surface of the undercoated support was subjected to simultaneous multilayer coating with the antihalation layer coating liquid and the back protective layer coating liquid, and the applied liquids were dried to form a back layer. The antihalation layer coating liquid was applied such that the application amount of the gelatin was 0.52 g/m$^2$, and the back protective layer coating liquid was applied such that the application amount of the gelatin was 1.7 g/m$^2$.

(Image-forming Layer, Intermediate Layers, and Surface Protective Layer)

1. Preparation of Coating Materials

1) Silver Halide Emulsion

<<Preparation of Silver Halide Emulsion 1>>

3.1 ml of a 1% by mass potassium bromide solution was added to 1421 ml of distilled water, and 3.5 ml of a 0.5 mol/l sulfuric acid solution and 31.7 g of phthalated gelatin were further added thereto. While stirring the resulting liquid in a stainless reaction pot at 30° C., a solution A prepared by diluting 22.22 g of silver nitrate with distilled water into 95.4 ml and a solution B prepared by diluting 15.3 g of potassium bromide and 0.8 g of potassium iodide with distilled water into 97.4 ml were added to the liquid at the constant flow rate over 45 seconds. Then, 10 ml of a 3.5% by mass aqueous hydrogen peroxide solution was added to the resultant mixture, and 10.8 ml of 10% by mass aqueous benzoimidazole solution was further added. Further, a solution C prepared by diluting 51.86 g of silver nitrate with distilled water to 317.5 ml and a solution D prepared by diluting 44.2 g of potassium bromide and 2.2 g of potassium iodide with distilled water to 400 ml were added to the mixture. The solution C was added over 20 minutes at a constant flow rate, and the solution D was added by a controlled double jet method while adjusting the pAg value to 8.1. 10 minutes after starting the addition of the solutions C and D, potassium hexachloroiridate (III) was added to the mixture in an amount of $1\times10^{-4}$ mol per 1 mol of silver. Further, 5 seconds after completing the addition of the solution C, an aqueous solution of potassium iron (II) hexacyanide was added to the mixture in an amount of $3\times10^{-4}$ mol per 1 mol of silver. The pH value of the resulting mixture was adjusted to 3.8 using a 0.5 mol/l sulfuric acid, then the stirring was stopped, and the mixture was subjected to precipitation, desalination, and water-washing. The pH value of the mixture was adjusted to 5.9 using a 1 mol/l sodium hydroxide to prepare a silver halide dispersion 1 with pAg of 8.0.

5 ml of a 0.34% by mass methanol solution of 1,2-benzoisothiazoline-3-one was added to the silver halide dispersion 1 while stirring the dispersion at 38° C., and 40 minutes after the addition, the resulting mixture was heated to 47° C. 20 minutes after the heating, a methanol solution of sodium benzenethiosulfonate was added to the mixture in an amount of $7.6\times10^{-5}$ mol per 1 mol of silver. Further, 5 minutes after the addition, a methanol solution of the tellurium sensitizer C hereinafter illustrated was added to the mixture in an amount of $2.9\times10^{-4}$ mol per 1 mol of silver, and the mixture was ripened for 91 minutes. A methanol solution of a 3/1 mole ratio mixture of the spectrally sensitizing dyes A and B was added to the mixture such that the total amount of the dyes A and B was $1.2\times10^{-3}$ mol per 1 mol of silver. 1 minute after the addition, 1.3 ml of a 0.8% by mass methanol solution of N,N'-dihydroxy-N"-diethylmelamine was added to the mixture, and 4 minutes after the addition, a methanol solution of 5-methyl-2-mercaptobenzoimidazole, a methanol solution of 1-phenyl-2-heptyl-5-mercapto-1,3,4-triazole, and an aqueous solution of 1-(3-methylureidophenyl)-5-mercaptotetrazole were added thereto to prepare a silver halide emulsion 1. The amounts of 5-methyl-2-mercaptobenzoimidazole, 1-phenyl-2-heptyl-5-mercapto-1,3,4-triazole, and 1-3-methylureidophenyl)-5-mercaptotetrazole were $4.8\times10^{-3}$ mol, $5.4\times10^{-3}$ mol, and $8.5\times10^{-3}$ mol, per 1 mol of silver, respectively.

The prepared silver halide emulsion comprised silver iodobromide grains, which had an average equivalent sphere diameter of 0.042 μm and an equivalent sphere diameter variation coefficient of 20%, and included 3.5 mol % of iodo uniformly. The grain diameter, etc. was an average value of 1,000 grains obtained using an electron microscope. The grains had a {100} face proportion of 80%, obtained by the Kubelka-Munk method.

<<Preparation of Silver Halide Emulsion 2>>

A silver halide dispersion 2 was prepared in the same manner as the silver halide dispersion 1 except that the liquid temperature was changed from 30° C. to 47° C. in the grain formation, the solution B was prepared by diluting 15.9 g of potassium bromide with distilled water to 97.4 ml, the solution D was prepared by diluting 45.8 g of potassium bromide with distilled water to 400 ml, the solution C was added over 30 minutes, and potassium iron (II) hexacyanide was not used. The precipitation, desalination, water-washing, and dispersion were carried out in the same manner as the preparation of the silver halide dispersion 1. Further, the silver halide dispersion 2 was subjected to the steps of the spectral sensitization, the chemical sensitization, and the addition of 5-methyl-2-mercaptobenzoimidazole and 1-phenyl-2-heptyl-5-mercapto-1,3,4-triazole in the same manner as the preparation of the silver halide emulsion 1 except that the amount of the tellurium sensitizer C was $1.1\times10^{-4}$ mol, methanol solution of a 3/1 mol ratio mixture of the spectrally sensitizing dyes A and B was added such that the total amount of the sensitizing dyes A and B was $7.0\times10^{-4}$ mol, the amount of 1-phenyl-2-heptyl-5mercapto-1,3,4-triazole was $3.3\times10^{-3}$ mol, and the amount of 1-(3-methylureidophenyl)-5-mercaptotetrazole was $4.7\times10^{-3}$ mol, per 1 mol of silver, to prepare a silver halide emulsion 2. The silver halide emulsion 2 comprised cuboidal pure silver bromide grains having an average equivalent sphere diameter of 0.080 μm and an equivalent sphere diameter variation coefficient of 20%.

<<Preparation of Silver Halide Emulsion 3>>

A silver halide dispersion 3 was prepared in the same manner as the silver halide dispersion 1 except that the liquid temperature was changed from 30° C. to 27° C. in the grain formation. The precipitation, desalination, water-washing, and dispersion were carried out in the same manner as the preparation of the silver halide dispersion 1. Then, a silver halide emulsion 3 was prepared from the silver halide dispersion 3 in the same manner as the preparation of the silver halide emulsion 1 except that a solid dispersion (an aqueous gelatin solution) of a 1/1 mole ratio mixture of the spectrally sensitizing dyes A and B was added such that the total amount of the dyes A and B was $6\times10^{-3}$ mol per 1 mol of silver, the amount of the tellurium sensitizer C was $5.2\times10^{-4}$ mol per 1 mol of silver, and 3 minutes after the addition of the tellurium sensitizer, $5\times10^{-4}$ mol of bromoauric acid and $2\times10^{-3}$ mol of potassium thiocyanate were added per 1 mol of silver. The prepared silver halide emulsion 3 comprised silver iodobromide grains, which had an average equivalent sphere diameter of 0.034 μm and an equivalent sphere diameter variation coefficient of 20%, and included 3.5 mol % of iodo uniformly.

<<Preparation of Mixed Emulsion A for Coating Liquid>>

70% by mass of the silver halide emulsion 1, 15% by mass of the silver halide emulsion 2, and 15% by mass of the silver halide emulsion 3 were mixed, and a 1% by mass aqueous solution of benzothiazolium iodide was added to the mixed emulsion such that the amount of benzothiazolium iodide was $7\times10^{-3}$ mol per 1 mol of silver. The above "% by mass" is based on the mass of the resultant mixed emulstion.

Further, to the mixed emulsion was added the compounds 1, 2, and 3, whoes one-electron oxidized form can release 1 or more electron(s). The amount of each of the compounds 1, 2, and 3 was $2\times10^{-3}$ mol per 1 mol of silver in the silver halide.

Then the adsorbent redox compounds 1 and 2 having an adsorbent group and a reducing group were added to the mixed emulsion. The amount of each of adsorbent redox compounds 1 and 2 was $5\times10^{-3}$ mol per 1 mol of the silver halide.

Water was added to the mixed emulsion for the coating liquid such that the silver amount of the silver halide was 38.2 g per 1 kg of the mixed emulsion. Further, 1-3-methylureidophenyl)-5-mercaptotetrazole was added such that the amount thereof was 0.34 g per 1 kg of the mixed emulsion.

2) Preparation of Fatty Acid Silver Salt Dispersion

<<Preparation of Fatty acid Silver Salt Dispersion A>>

87.6 kg of behenate (trade name: EDENOR C22-85R, manufactured by Cognis), 423 L of distilled water, 49.2 L of a 5 mol/L aqueous solution of NaOH and 120 L of t-butyl alcohol were mixed and allowed to react at 75° C. for one hour with stirring to obtain a sodium behenate solution A. Separately, 206.2 L of an aqueous solution (pH 4.0) containing 40.4 kg of silver nitrate was prepared and kept at 10° C. To a mixture of 635 L of distilled water and 30 L of t-butyl alcohol contained in a reaction vessel kept at 30° C. were added the entire volume of the above-mentioned sodium behenate solution A and the entire volume of the aqueous silver nitrate solution with sufficient stirring at constant flow rates over the periods of 93 minutes and 15 seconds, and 90 minutes, respectively; in this operation, only the aqueous silver nitrate solution was added during a period within 11 minutes from the initiation of the addition of the aqueous silver nitrate solution, and then the addition of the sodium behenate solution A was started, and then the addition of the aqueous silver nitrate solution was completed, so that only the sodium behenate solution A was added during a period within 14 minutes and 15 seconds from the completion of the addition of the aqueous silver nitrate solution. In this operation, the outside temperature was controlled so that the temperature in the reaction vessel was maintained at 30° C. and the liquid temperature was kept constant. The pipe of the addition system for the sodium behenate solution A was warmed by circulating warmed water in the space between the outer pipe and the inner pipe of a double pipe, and temperature was controlled such that the liquid temperature at the outlet orifice of the addition nozzle was 75° C. The pipe of the addition system for the aqueous silver nitrate solution was maintained at a constant temperature by circulating cold water in the space between the outer pipe and the inner pipe of a double pipe. The addition position of the sodium behenate solution A and the addition position of the aqueous silver nitrate solution were arranged symmetrically with respect to the stirring axis as a center, and the positions had such heights as not to contact with the reaction solution.

After finishing the addition of the sodium behenate solution A, the mixture was left with stirring for 20 minutes at the same temperature, and then the temperature was increased to 35° C. over 30 minutes, followed by aging for 210 minutes. After finishing the aging, the solid content was immediately separated by centrifugal filtration and washed with water until an electric conductivity of the filtrate became 30 μS/cm. Thus, a fatty acid silver salt was obtained. The obtained solid content was stored as a wet cake without being dried.

When the shape of the obtained silver behenate grains was evaluated by electron microscopic photography, the grains were crystals with flaky shape having a=0.14 μm, b=0.4 μm, and c=0.6 μm in average values, an average aspect ratio of 5.2, of 0.52 μm, and an average equivalent-sphere diameter variation coefficient of 15% (a, b and c have the meanings defined above).

In addition, when the obtained fatty acid silver salt grains were analyzed, behenate content was found to be 88 mol % and, in addition to the behenic acid, 2 mol % of lignoceric acid, 6 mol % of arachidic acid, 3 mol % of stearic acid, 0.3 mol % of erucic acid were contained therein.

To the wet cake corresponding to 260 kg of the dry solid content were added 19.3 kg of polyvinyl alcohol (trade name: PVA-217) and water to make the total amount 1000 kg, and the mixture was made into slurry by a dissolver fin and further pre-dispersed by a pipeline mixer (PM-10 type, manufactured by Mizuho Industrial Co., Ltd.).

Then, the pre-dispersed stock solution was dispersed three times by using a disperser (trade name: Microfluidizer M-610, manufactured by Microfluidex International Corporation, using Z type interaction chamber) with a pressure controlled at 1260 kg/cm$^2$ to obtain a silver behenate dispersion. A dispersion temperature of 18° C. was achieved by providing coiled heat exchangers fixed in front of and behind the interaction chamber and controlling the temperature of refrigerant.

<<Preparation of Fatty acid Silver Salt Dispersion B>>

<Preparation of Recrystallized Behenic Acid>

100 kg of behenic acid (trade name: EDENOR C22-85R, manufactured by Cognis) was added to 1200 kg of isopropyl alcohol, dissolved at 60° C., filtered through a filter of 10 μm and cooled to 20° C. for recrystallization. The cooling rate for the recrystallization was controlled at 5° C./hour. The obtained crystals were filtered by centrifugation and washed with 100 kg of flowing isopropyl alcohol, and further the recrystallization was twice repeated. Then, an initial precipitate of the recrystallization was filtered to remove lignoceric acid and dried. The composition was analyzed by the measurement based on the GC-FID method after the obtained crystals were esterified, and the composition was found to have a behenate content of 96 mol %, a lignoceric acid content of 2 mol %, an arachidic acid content of 2 mol %, and an erucic acid content of 0.001 mol %.

<Preparation of Fatty acid Silver Salt Dispersion B>

88 kg of the recrystallized behenic acid, 422 L of distilled water, 49.2 L of 5 mol/L aqueous solution of NaOH and 120 L of t-butyl alcohol were mixed and allowed to react at 75° C. for one hour with stirring to obtain a sodium behenate solution B. Separately, 206.2 L of an aqueous solution (pH 4.0) containing 40.4 kg of silver nitrate was prepared and kept at 10° C. To a mixture of 635 L of distilled water and 30 L of t-butyl alcohol contained in a reaction vessel kept at 30° C. were added the entire volume of the aforementioned sodium behenate solution B and the entire volume of the aqueous silver nitrate solution with sufficient stirring at constant flow rates over the periods of 93 minutes and 15 seconds, and 90 minutes, respectively; in this operation, only the aqueous silver nitrate solution was added during a period within 11 minutes from the initiation of the addition of the aqueous silver nitrate solution, and then the addition of the sodium behenate solution B was started, and then the addition of the aqueous silver nitrate solution was completed, so that only the sodium behenate solution B was added during a period within 14 minutes and 15 seconds from the completion of the addition of the aqueous silver nitrate solution. In this operation, the outside temperature was controlled so that the temperature in the reaction vessel was maintained at 30° C. and the liquid temperature was kept constant. The pipe of the addition system for the sodium behenate solution B was warmed by circulating warmed water in the space between the outer pipe and the inner pipe of a double pipe, and temperature was controlled such that the liquid temperature at the outlet orifice of the addition nozzle was 75° C. The pipe of the addition system for the aqueous silver nitrate solution was maintained at a constant temperature by circulating cold water in the space between the outer pipe and the inner pipe of a double pipe. The addition position of the sodium behenate solution B and the addition position of the aqueous silver nitrate solution were arranged symmetrically with respect to the stirring axis as a center, and the positions had such heights as not to contact with the reaction solution.

After finishing the addition of the sodium behenate solution B, the mixture was left with stirring for 20 minutes at the same temperature and then the temperature was increased to 35° C. over 30 minutes, followed by aging for 210 minutes. After finishing the aging, the solid content was immediately separated by centrifugal filtration and washed with water until an electric conductivity of the filtrate became 30 μS/cm. Thus, a fatty acid silver salt was obtained. The obtained solid content was stored as a wet cake without being dried.

When the shape of the obtained silver behenate grains was evaluated by electron microscopic photography, the grains were crystals having a=0.21 μm, b=0.4 μm and c=0.4 μm in average values, an average aspect ratio of 2.1, and an average equivalent-sphere diameter variation coefficient of 11% (a, b and c have the meanings defined above).

To the wet cake corresponding to 260 kg of the dry solid content was added with 19.3 kg of polyvinyl alcohol (trade name: PVA-217) and water to make the total amount 1000 kg, and the mixture was made into slurry by a dissolver fin and further pre-dispersed by a pipeline mixer (PM-10 type, manufactured by Mizuho Industrial Co., Ltd.).

Then, the pre-dispersed stock solution was treated three times by using a disperser (trade name: Microfluidizer M-610, manufactured by Microfluidex International Corporation, using a Z type interaction chamber) with a pressure controlled at 1150 kg/cm$^2$ to obtain a silver behenate dispersion. A dispersion temperature of 18° C. was achieved by providing coiled heat exchangers fixed in front of and behind the interaction chamber and controlling the temperature of refrigerant.

<<Preparation of Fatty acid Silver Salt Dispersions C and D>>

<Preparation of Recrystallized Stearic Acid>

100 kg of stearic acid (manufactured by Tokyo Kasei Co., Ltd.) was added to 1200 kg of isopropyl alcohol, dissolved at 60° C., filtered through a filter of 10 μm and cooled to 20° C. for recrystallization. The cooling rate for the recrystallization was controlled at 5° C./hour. The obtained crystals were filtered by centrifugation and washed with 100 kg of flowing isopropyl alcohol, and further the recrystallization was twice repeated. Then, an initial precipitate of the recrystallization was filtered to remove carboxylic acid having chain length longer than that of stearic acid and was dried. The composition was analyzed by the measurement based on the GC-FID method after the obtained crystals were esterified, and the composition was found to have a stearic acid content of 99.6 mol % and an oleic acid content of 0.01 mol % or less.

(Preparation of Fatty acid Silver Salt Dispersion C)

A mixture of 64.2 g of the recrystallized behenic acid, 19.9 g of the recrystallized stearic acid, and 500 ml of water was stirred at 90° C. for 15 minutes. 187 ml of 1N-NaOH was added to the mixture over 15 minutes and 61 ml of an aqueous 1 N nitric acid solution was further added thereto, and the temperature of the resultant mixture was decreased to 50° C. Then, 124 ml of an aqueous 1 N silver nitrate solution was added to the mixture over 2 minutes and the resultant mixture was stirred at the same temperature for 30 minutes. Then, the solid content was separated by suction filtration and washed with water until an electric conductivity of the filtrate became 30 μS/cm. Thus obtained solid content was stored as a wet cake without being dried.

The obtained crystals had a behenate content of 70 mol % of and a stearic acid content of 27 mol % of.

To the wet cake corresponding to 34.8 g of the dry solid content were added 12 g of polyvinyl alcohol and 150 ml of water, and mixed sufficiently to form slurry. Then, 840 g of zirconia beads having an average particle size of 0.5 mm were placed in a vessel together with the slurry, and the slurry was dispersed by using a disperser (1/4 G Sand Grinder Mill, manufactured by IMEX Co., Ltd.) for 5 hours to thus obtain an fatty acid silver salt dispersion C, which was found to contain needle-shaped grains having an average length of the shorter axis of 0.04 μm, an average length of the longer axis of 0.8 μm and a projection area variation coefficient of 30% when observed by an electron microscope.

(Preparation of Fatty Acid Silver Salt Dispersion D)

Preparation of the fatty acid silver salt dispersion D was conducted in the same manner as the preparation of the fatty acid silver salt dispersion C except that the amount of the recrystallized behenate was changed to 55.0 g and that the amount of the recrystallized stearic acid was changed to 27.6 g.

The obtained crystals had a behenate content of 60 mol % of and a stearic acid content of 37 mol %.

3) Preparation of Dispersion of Reducing Agent

<<Preparation of Dispersion of Reducing Agent R1>>

10 kg of water was sufficiently mixed with 10 kg of the reducing agent R1 (6,6'-di-t-butyl-4,4'-dimethyl-2,2'-butylidenediphenol) and 16 kg of a 10% by mass aqueous solution of a modified polyvinyl alcohol POVAL MP203 available from Kuraray Co., Ltd., to obtain a slurry. The slurry was transported by a diaphragm pump to a horizontal-type sand mill UVM-2 manufactured by Imex Co., which was packed with zirconia beads having the average diameter of 0.5 mm, and dispersed therein for 3.5 hours. Then, 0.2 g of benzoisothiazolinone sodium salt and water were added to the dispersed slurry such that the content of the reducing agent was 25% by mass. Thus-obtained dispersion liquid was maintained at 40° C. for 1 hour, and maintained at 80° C. for 1 hour to obtain a reducing agent R1 dispersion. The reducing agent 1 dispersion included reducing agent particles having a median size of 0.50 μm and a maximum particle size of 1.6 μm or less. The reducing agent 1 dispersion was filtrated by a polypropylene filter having a pore diameter of 3.0 μm to remove extraneous substances such as dust, and then stored.

<<Preparation of Dispersion of Reducing Agents R2 to R6>>

A dispersion of a reducing agent R2 was prepared in the same manner as in the preparation of the dispersion of the reducing agent R1 except that the reducing agent R2 (2,2'-methylenebis-(4-ethyl-6-tert-butylphenol)) was used in place of the reducing agent R1. Similarly, the reducing agents R3 to R6 were used to prepare dispersions of reducing agents R3 to R6.

4) Preparation of Dispersion of Hydrogen Bonding Compound 1

10 kg of water was sufficiently mixed with 10 kg of the hydrogen-bonding compound 1 (tri(4-t -butylphenyl)phosphine oxide) and 16 kg of a 10% by mass aqueous solution of a modified polyvinyl alcohol POVAL MP203 available from Kuraray Co., Ltd., to obtain a slurry. The slurry was transported by a diaphragm pump to a horizontal-type sand mill UVM-2 manufactured by Imex Co., which was packed with zirconia beads having an average diameter of 0.5 mm, and dispersed therein for 4 hours. Then, 0.2 g of benzoisothiazolinone sodium salt and water were added to the dispersed slurry such that the content of the hydrogen-bonding compound was 25% by mass. Thus-obtained dispersion liquid was maintained at 40° C. for 1 hour, and further maintained at 80° C. for 1 hour to obtain a hydrogen-bonding compound 1 dispersion. The hydrogen-bonding compound 1 dispersion included hydrogen-bonding compound particles having a median size of 0.45 μm and a maximum particle size of 1.3 μm or smaller. The hydrogen-bonding compound 1 dispersion was filtrated by a polypropylene filter having a pore diameter of 3.0 μm to remove extraneous substances such as dust, and then stored.

5) Preparation of Dispersion of Development Accelerator 1

10 kg of water was sufficiently mixed with 10 kg of the development accelerator 1 and 20 kg of a 10% by mass aqueous solution of a modified polyvinyl alcohol POVAL MP203 available from Kuraray Co., Ltd., to obtain a slurry. The slurry was transported by a diaphragm pump to a horizontal-type sand mill UVM-2 manufactured by Imex Co., which was packed with zirconia beads having an average diameter of 0.5 mm, and dispersed therein for 3.5 hours. Then, 0.2 g of benzoisothiazolinone sodium salt and water were added to the dispersed slurry such that the content of the development accelerator was 20% by mass, to obtain a development accelerator 1 dispersion. The development accelerator 1 dispersion included development accelerator particles having a median size of 0.48 μm and a maximum particle size of 1.4 μm or less. The development accelerator 1 dispersion was filtrated by a polypropylene filter having a pore diameter of 3.0 μm to remove extraneous substances such as dust, and then stored.

6) Preparation of Dispersions of Development Accelerator 2 and Color Tone Controlling agent 1

A 20% by mass solid dispersion of the development accelerator 2 and a 15% by mass solid dispersion of the color tone controlling agent 1 were prepared in the same manner as the development accelerator 1 dispersion, respectively.

7) Preparation of Polyhalogen Compound

<<Preparation of Dispersion of Organic Polyhalogen Compound 1>>

10 kg of the organic polyhalogen compound 1 (tribromomethanesulfonylbenzene), 10 kg of a 20% by mass aqueous solution of a modified polyvinyl alcohol POVAL MP203 available from Kuraray Co., Ltd., 0.4 kg of a 20% by mass aqueous solution of sodium triisopropylnaphthalenesulfonate, and 14 kg of water were sufficiently mixed to obtain a slurry. The slurry was transported by a diaphragm pump to a horizontal-type sand mill UVM-2 manufactured by Imex Co. which was packed with zirconia beads having an average diameter of 0.5 mm, and dispersed therein for 5 hours. Then, 0.2 g of benzoisothiazolinone sodium salt and water were added to the dispersed slurry such that the content of the organic polyhalogen compound was 26% by mass, to obtain an organic polyhalogen compound 1 dispersion. The organic polyhalogen compound 1 dispersion included organic polyhalogen compound particles having a median size of 0.41 μm and a maximum particle size of 2.0 μm or less. The organic polyhalogen compound 1 dispersion was filtrated by a polypropylene filter having a pore diameter of 10.0 μm to remove extraneous substances such as dust, and then stored.

<<Preparation of Dispersion of Organic Polyhalogen Compound2 >>

10 kg of the organic polyhalogen compound 2 (N-butyl-3-tribromomethanesulfonylbenzoamide), 20 kg of a 10% by mass aqueous solution of a modified polyvinyl alcohol POVAL MP203 available from Kuraray Co., Ltd., and 0.4 kg of a 20% by mass aqueous solution of sodium triisopropylnaphthalenesulfonate were sufficiently mixed to obtain a slurry. The slurry was transported by a diaphragm pump to a horizontal-type sand mill UVM-2 manufactured by Imex Co. which was packed with zirconia beads having an average diameter of 0.5 mm, and dispersed therein for 5 hours. Then, 0.2 g of benzoisothiazolinone sodium salt and water were added to the dispersed slurry such that the content of the organic polyhalogen compound was 30% by mass, and the liquid was maintained at 40° C. for 5 hours to obtain an organic polyhalogen compound 2 dispersion. The organic polyhalogen compound 2 dispersion included organic polyhalogen compound particles having a median size of 0.40 μm and a maximum particle size of 1.3 μm or smaller. The organic polyhalogen compound 2 dispersion was filtrated by a polypropylene filter having a pore diameter of 3.0 μm to remove extraneous substances such as dust, and then stored.

<<Preparation of Solution of Phthalazine Compound 1>>

8 kg of a modified polyvinyl alcohol MP203 available from Kuraray Co., Ltd. was dissolved in 174.57 kg of water. To the solution were added 3.15 kg of a 20% by mass aqueous solution of sodium triisopropylnaphthalenesulfonate and 14.28 kg of a 70% by mass aqueous solution of the phthalazine compound 1 (6-isopropylphthalazine), to prepare a 5% by mass phthalazine compound 1 solution.

9) Preparation of Mercapto Compound

<<Preparation of Aqueous Solution of Mercapto Compound 2>>

20 g of the mercapto compound 2 (1-(3-methylureidophenyl)-5-mercaptotetrazole) was dissolved in 980 g of water to obtain a 2.0% by mass aqueous solution of the mercapto compound 2.

10) Preparation of Dispersion of Pigment-1

250 g of water was sufficiently mixed with 64 g of C. I. Pigment Blue 60 and 6.4 g of DEMOL N available from Kao Corporation, to obtain a slurry. The slurry was placed in a vessel together with 800 g of zirconia beads having an average diameter of 0.5 mm, and dispersed for 25 hours by a dispersion apparatus 1/4G sand grinder mill manufactured by Imex Co. The pigment content of the dispersed slurry was adjusted to 5% by mass by addition of water, to prepare a pigment 1 dispersion. The pigment 1 dispersion comprised pigment particles having an average particle diameter of 0.21 μm.

11) Preparation of SBR Latex

An SBR latex was prepared in the following manner.

287 g of distilled water, 7.73 g of a surfactant PIONINE A-43-S available from Takemoto Oil & Fat Co., Ltd. (solid content 48.5% by mass), 14.06 ml of a 1 mol/l NaOH solution, 0.15 g of tetrasodium ethylenediaminetetraacetate, 255 g of styrene, 11.25 g of acrylic acid, and 3.0 g of tert-dodecylmercaptan were placed in a polymerization kettle of a gas monomer reactor TAS-2J manufactured by Taiatsu Techno Corporation. The polymerization kettle was closed and the contents were stirred at a stirring rate of 200 rpm. The resultant mixture was degassed by a vacuum pump, the inner atmosphere of the kettle was replaced with nitrogen gas several times, 108.75 g of 1,3-butadiene was added to the mixture, and the inner temperature was raised to 60° C. Then, a solution prepared by dissolving 1.875 g of ammonium persulfate in 50 ml of water was added to the mixture and stirred for 5 hours. The mixture was heated to 90° C. and further stirred for 3 hours, and the inner temperature was reduced to the room temperature after the reaction. To the resultant mixture were added 1 mol/l solution of NaOH and 1 mol/l solution of $NH_4OH$ such that the mole ratio of $Na^+$ ion/$NH_4^+$ ion was 1/5.3, whereby the pH value of the mixture was adjusted to 8.4. Then, the mixture was filtrated by a polypropylene filter having a pore diameter of 1.0 μm to remove extraneous substances such as dust, whereby 774.7 g of an SBR latex was obtained. As a result of measuring the halogen ion content of the SBR latex by an ion chromatography, the chloride ion content was found to be 3 ppm. As a result of measuring the chelating agent content of the SBR latex by a high performance liquid chromatography, the chelating agent content was found to be 145 ppm.

The latex had an average particle diameter of 90 nm, Tg of 17° C., a solid content of 44% by mass, an equilibrium moisture content of 0.6% by mass under the conditions of 25° C. and 60% RH, and an ionic conductivity of 4.80 mS/cm. The ionic conductivity was obtained by measuring the ionic conductivity of the undiluted latex liquid (44% by mass) at 25° C. by a conductivity meter CM-30S available from DKK-TOA Co.

SBR latexes having different Tg's can be prepared in the same manner by appropriately altering the styrene/butadiene ratio.

2. Preparation of Coating Liquid

1) Preparation of Coating Liquid 1 for Photosensitive Layer

<<Preparation of Coating Liquid 1 for Photosensitive Layer>>

900 g of the fatty acid silver salt dispersion B, 135 ml of water, 36 g of the dispersion of the pigment-1, 25 g of the dispersion of the organic polyhalogen compound 1, 39 g of the dispersion of the organic polyhalogen compound 2, 171 g of the solution of the phthalazine compound 1, 1060 g of the SBR latex (Tg: 17° C.), 46 g of the dispersion of the reducing agent R1, 107 g of the dispersion of the reducing agent R2 (the mass ratio of reducing agent R1/reducing agent R2 is 30/70), 55 g of the dispersion of the hydrogen bonding compound 1, 4.8 g of the dispersion of the development accelerator 1, 5.2 g of the dispersion of the development accelerator 2, 2.1 g of the dispersion of the color tone controlling agent 1 and 8 ml of the aqueous solution of the mercapto compound 2, were successively mixed sufficiently and the silver halide mixed emulsion A was added to the mixture and well mixed immediately before the application. The amount of the silver halide mixed emulion A will be explained below. The thus obtained coating liquid for a photosensitive layer was fed to a coating die and was coated.

The coating liquid for a photosensitive layer had a viscosity of 40 mPa.s, measured by a B-type viscometer available from Tokyo Keiki Co,. Ltd. at 40° C. (No. 1 rotor, 60 rpm).

The viscosity of the coating liquid for a photosensitive layer, obtained by RheoStress RS150 manufactured by Haake at 38° C., was 30, 43, 41, 28, and 20 [mPa.s] at a shear rate of 0.1, 1, 10, 100, and 1000 [1/second], respectively.

The zirconium content of the coating liquid for a photosensitive layer was 0.30 mg per 1 g of silver.

<<Preparation of Coating Liquid 2 for Photosensitive Layer>>

Preparation of a coating liquid 2 for a photosensitive layer was carried out in the same manner as in the preparation of the coating liquid 1 for a photosensitive layer except that the fatty acid silver salt dispersion A was used in place of the fatty acid silver salt dispersion B.

<<Preparation of Coating Liquids 3 to 6 for Photosensitive Layer>>

Preparation of each of coating liquids 3 to 6 for photosensitive layers was carried out in the same manner as in the preparation of the coating liquid 1 for a photosensitive layer except that 153 g of the dispersion of the reducing agent shown in Table 1 (selected from the reducing agents R2 to R6) was used in place of the combination of 46 g of the dispersion of the reducing agent R1 and 107 g of the dispersion of the reducing agent R2 (the mass ratio of R1/R2 is 30/70).

<<Preparation of Coating Liquid 7 for Photosensitive Layer>>

Preparation of a coating liquid 7 for a photosensitive layer was carried out in the same manner as in the preparation of the coating liquid 1 for a photosensitive layer except that 76.5 g of the dispersion of the reducing agent R1 and 76.5 g of the dispersion of the reducing agent R2 (the mass ratio of R1/R2 is 50/50) were used instead of the combination of 46 g of the dispersion of the reducing agent R1 and 107 g of the dispersion of the reducing agent R2 (the mass ratio of R1/R2 is 30/70).

2) Preparation of Coating Liquid for Non-photosensitive Layer S

<<Preparation of Coating Liquid 1 for Non-photosensitive Layer S>>

Preparation of a coating liquid 1 for a non-photosensitive layer S was carried out in the same manner as in the preparation of the coating liquid 1 for a photosensitive layer, except that the amount of the dispersion of the organic polyhalogen compound 1 was changed from 25 g to 5 g and that the amount of the dispersion of the organic polyhalogen compound 2 was changed from 39 g to 7.8 g (20 mass % of each polyhalogen compound content in the coating liquid 1 for a photosensitive layer) and that 107 g of the dispersion of the reducing agent R1 and 46 g of the dispersion of the reducing agent R2 (the mass ratio of R1/R2 is 70/30) were used instead of the combination of 46 g of the dispersion of the reducing agent R1 and 107 g of the dispersion of the reducing agent R2 (the mass ratio of R1/R2 is 30/70), and that the addition of 100 g of the silver halide mixing emulsion A was omitted.

(<Preparation of Coating Liquids 2 to 4 Each for a Non-photosensitive Layer S>>

Preparation of each of coating liquids 2 to 4 for a non-photosensitive layer S was carried out in the same manner as in the preparation of the coating liquid 1 for a non-photosensitive layer S except that the fatty acid silver salt dispersions A, C or D was used in place of the fatty acid silver salt dispersion B.

<<Preparation of Coating Liquids 5 and 6 Each for a Non-photosensitive Layer S>>

Preparation of each of coating liquids 5 and 6 for a non-photosensitive layer S was carried out in the same manner as in the preparation of the coating liquid 1 for a non-photosensitive layer S except that the fatty acid silver salt dispersion A was used in place of the fatty acid silver salt dispersion B, and 153 g of one of the reducing agents R1 and R3, as shown in Table 1, was used in place of the combination of 107 g of the dispersion of the reducing agent R1 and 46 g of the dispersion of the reducing agent R2 (the mass ratio of R1/R2 is 70/30).

<<Preparation of Coating Liquid 7 for a Non-photosensitive Layer S>>

Preparation of a coating liquid 7 for a non-photosensitive layer S was carried out in the same manner as in the preparation of the coating liquid 1 for a non-photosensitive layer S except that 76.5 g of the dispersion of the reducing agent R1 and 76.5 g of the dispersion of the reducing agent R2 (the mass ratio of R1/R2 is 50/50) were used instead of the combination of 107 g of the dispersion of the reducing agent R1 and 46 g of the dispersion of the reducing agent R2 (the mass ratio of R1/R2 is 70/30).

3) Preparation of Coating Liquid for Intermediate Layer

<<Preparation of Coating Liquid 1 for Intermediate Layer>>

To a mixture of 1,000 g of polyvinyl alcohol PVA-205 available from Kuraray Co., Ltd., 163 g of the pigment 1 dispersion, 33 g of a 18.5% by mass aqueous solution of the blue dye 1 (KAYAFECT TURQUOISE RN LIQUID 150 available from Nippon Kayaku Co., Ltd.), 27 ml of a 5% by mass aqueous solution of sodium di(2-ethylhexyl)sulfosuccinate, and 4,200 ml of a 19% by mass latex liquid of a methyl methacrylate-styrene-butyl acrylate-hydroxyethyl methacrylate-acrylic acid copolymer (copolymerization weight ratio 57/8/28/5/2) were added 27 ml of a 5% by mass aqueous solution of AEROSOL OT available from American Cyanamid Co., 135 ml of a 20% by mass aqueous solution of diammonium phthalate, and water such that the total amount was 10,000 g. The pH value of the resultant mixture was adjusted to 7.5 with NaOH to obtain an intermediate layer coating liquid 1. The intermediate layer coating liquid 1 was transported to a coating die such that the amount of the liquid is 8.9 ml/m$^2$.

The intermediate layer coating liquid 1 had a viscosity of 58 mPa.s, measured by a B-type viscometer at 40° C. (No. 1 rotor, 60 rpm).

<<Preparation of Coating Liquid 1 for First Layer of Surface Protective Layer>>

100 g of inert gelatin and 10 mg of benzisothiazolinone were dissolved in 840 ml of water. Then, 180 g of a 19 mass % latex solution of a methyl methacrylate-styrene-butyl acrylate-hydroxyethyl methacrylateacrylic acid copolymer (copolymerization weight ratio: 57/8/28/5/2), 46 ml of a 15 mass % solution of phthalic acid in methanol and 5.4 ml of a 5 mass % aqueous solution of sodium di(2-ethylhexyl) sulfosuccinate were added thereto and mixed. Immediately before coating, 40 ml of 4 mass % chrome alum was mixed with the above mixture by a static mixer and the resultant mixture was fed into a coating die to give a dose of 26.1 ml/m$^2$.

The coating liquid had a viscosity of 20 [mPa.s] at 40° C., measured by a B-type viscometer at 40° C. (No. 1 rotor, 60 rpm).

5) Preparation of Coating Liquid 1 for Second Layer of Surface Protective Layer 100 g of inert gelatin and 10 mg of benzisothiazolinone were dissolved in 800 ml of water. Then, 40 g of a 10 mass % emulsion of liquid paraffin, 40 g of a 10 mass % emulsion of dipentaerythrityl hexaisostearate, 180 g of a 19 mass % latex solution of a methyl methacrylate-styrenebutyl acrylate-hydroxyethyl methacrylate-acrylic acid copolymer (copolymerization weight ratio: 57/8/28/5/2), 40 ml of a 15 mass % solution of phthalic acid in methanol, 5.5 ml of a 1 mass % solution of the fluorine-based surfactant (F-1), 5.5 ml of a 1 mass % aqueous solution of the fluorine-based surfactant (F-2), 28 ml of a 5 mass % aqueous solution of sodium di(2-ethylhexyl)sulfosuccinate, 4 g of polymethyl methacrylate particles (average particle size: 0.7 μm, the average particle size corresponding to 30% point on the cumulative volume-weighted size distribution) and 21 g of polymethyl methacrylate grains (average particle size: 3.6 μm, the average particle size corresponding to 60% point on the cumulative volume-weighted size distribution) were added thereto to give a coating liquid for a surface protective layer. The obtained coating liquid was fed into a coating die to give a dose of 8.3 ml/$m^2$.

The coating liquid had a viscosity of 19 [mPa.s] at 40° C., measured by a B-type viscometer at 40° C. (No. 1 rotor, 60 rpm).

3. Production of Photothermographic Material

1) Production of Photothermographic Material 1

The coating liquid 1 for a photosensitive layer was mixed sufficiently with 100 g of the silver halide mixed emulsion A by stirring immediately before coating. The coating liquid 1 for a photosensitive layer, the coating liquid 1 for an intermediate layer, the coating liquid 1 for a first layer of a surface protective layer, and the coating liquid 1 for a second layer of a surface protective layer were applied in this order onto the surface opposite to the back surface of the support by simultaneous multilayer coating using a slide-bead application method, to produce a photothermographic material. At coating, the coating liquid 1 for a photosensitive layer and the coating liquid 1 for an intermediate layer were controlled at 31° C., the coating liquid for a first layer of a surface protective layer was controlled at 36° C., and the coating liquid for a second layer of a surface protective layer was controlled at 37° C.

The coating amounts (g/$m^2$) of the compounds contained in the photosensitive layer were as follows.

| | |
|---|---|
| Fatty acid silver salt | 4.74 |
| Pigment (C.I. Pigment Blue 60) | 0.036 |
| Polyhalogen compound 1 | 0.14 |
| Polyhalogen compound 2 | 0.28 |
| Phthalazine compound 1 | 0.18 |
| SBR latex | 9.43 |
| Reducing agent R1 | 0.23 |
| Reducing agent R2 | 0.54 |
| Hydrogen bonding compound 1 | 0.28 |
| Development accelerator 1 | 0.019 |
| Development accelerator 2 | 0.016 |
| Color tone controlling agent 1 | 0.006 |
| Mercapto compound 2 | 0.003 |
| Silver halide (in terms of Ag amount) | 0.10 |

The conditions for coating and drying were as follows:

The coating was carried out at the rate of 160 m/min. The distance between the support and the tip of the coating die was 0.10 to 0.30 mm. The inner pressure of the decompression chamber was 196 to 882 Pa-lower than the atmospheric pressure. The support was subjected to electrical neutralization by an ionic wind before the application.

The coating liquid was cooled by a wind having a dry-bulb temperature of 10 to 20° C. in the chilling zone. Then the coating liquid was contactless-transported and dried by a helical type contactless drying apparatus using a drying wind having the dry-bulb temperature of 23 to 45° C. and the wet-bulb temperature of 15 to 21° C.

After the drying, the moisture content was controlled by leaving the photothermographic material in a condition of 25° C., 40 to 60% RH. Then, the dried layer was heated to 70 to 90° C. and cooled to 25° C.

2) Production of Photothermographic Materials 2 to 13

Each of photothermographic materials 2 to 13 were produced in the same manner as the preparation of the photothermographic material 1, except that one of the coating liquids 2 to 7 for photosensitive layers is used in place of the coating liquid 1 for a photosensitive layer and that one of the coating liquids 1 to 7 each for a non-photosensitive layer S shown in Table 1 is coated. In the coating, the coating liquids respectively for a photosensitive layer and for a non-photosensitive layer S were coated by simultaneous multi-layer coating and their amounts were as shown in Table 1 (the ratio of the amount of the coating liquid for a photosensitive layer to the amount of the coating liquid for a non-photosensitive layer S fell within the range of 90 mass %: 10 mass % to 50 mass %: 50 mass % in each case). The amounts of coating liquids for photosensitive layers and amounts of coating liquids for non-photosensitive layers S shown in Table 1 are based on the amount of the coating liquid for a photosensitive layer in the photothermographic material 1. Immediately before the coating, the silver halide mixed emulsion A was added to the coating liquid for a photosensitive layer such that the resultant photothermographic material contains the same silver halide amount as that of the photothermographic material 1.

The total coating amounts (g/$m^2$) of the compounds contained in the photosensitive layer and the non-photosensitive layer S of the photothermographic material 3 (wherein the ratio of the amount of the photosensitive layer to the amount of the non-photosensitive layer S is 70/30) were as follows.

| | |
|---|---|
| Fatty acid silver salt | 4.74 |
| Pigment (C.I. Pigment Blue 60) | 0.036 |
| Polyhalogen compound 1 | 0.11 |
| Polyhalogen compound 2 | 0.21 |
| Phthalazine compound 1 | 0.18 |
| SBR latex | 9.43 |
| Reducing agent R1 | 0.23 |
| Reducing agent R2 | 0.54 |
| Hydrogen bonding compound 1 | 0.28 |
| Development accelerator 1 | 0.019 |
| Development accelerator 2 | 0.016 |
| Color tone controlling agent 1 | 0.006 |
| Mercapto compound 2 | 0.003 |
| Silver halide (in terms of Ag amount) | 0.10 |

In the following, the chemical structures of the compounds used in the examples of the present invention are shown.

Spectral sensitizing dye A

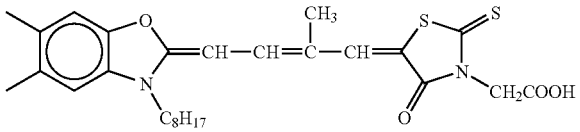

Spectral sensitizing dye B

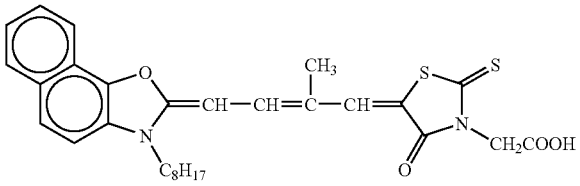

Tellurium sensitizer C

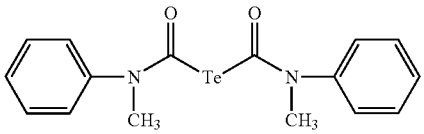

Compound 1 Whose One-electron Oxidant can Release 1 or More Electron(s):

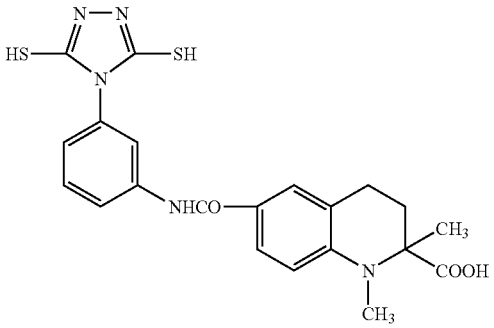

Compound 2 Whose One-electron Oxidant can Release 1 or More Electron(s):

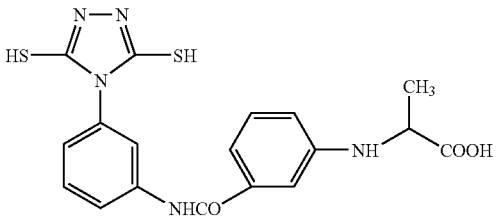

Compound 1 Whose One-electron Oxidant can Release 1 or More Electron(s):

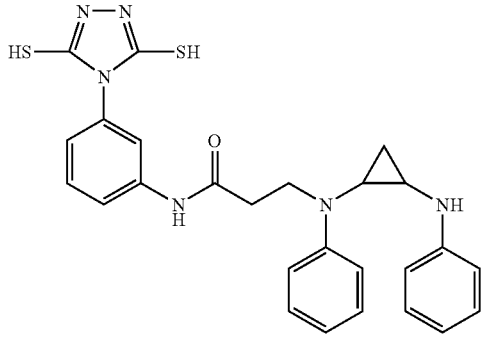

Adsorbent Redox Compound 1 Having Adsorbent Group and Reducing Group

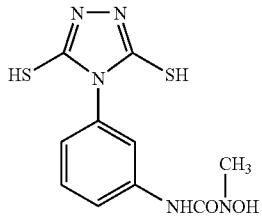

Adsorbent Redox Compound 2 Having Adsorbent Group and Reducing Group

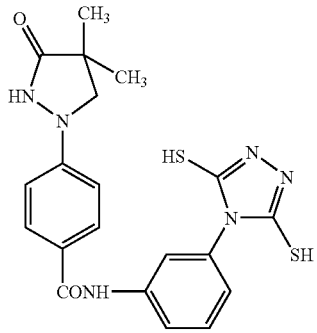

Base Precursor Compound 1

Base precursor compound 1

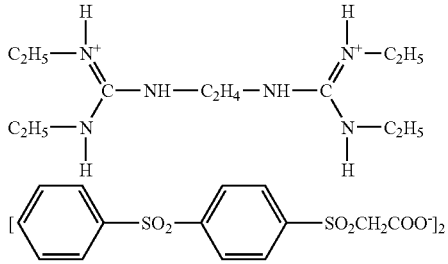

Cyanine Dye Compound 1
Cyanine dye compound 1
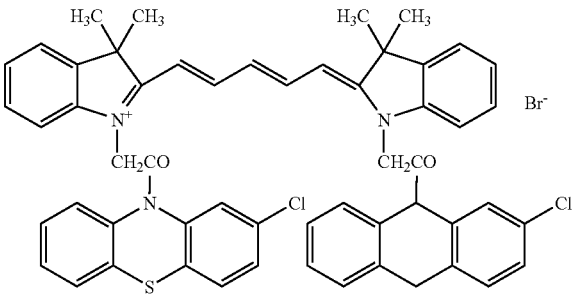
Blue dye compound 1
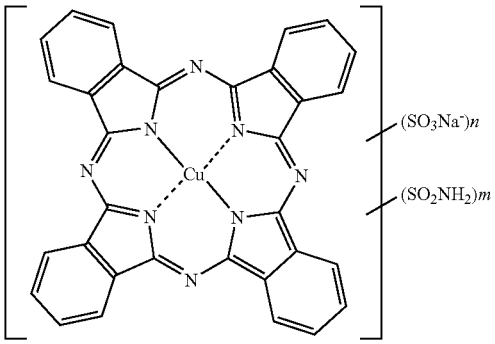
n = 0.5 ~ 2.0
m = 0.5 ~ 2.5
(Reducing agent-R1)
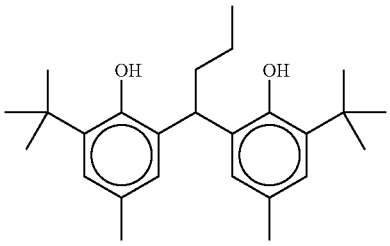
(Reducing agent-R2)
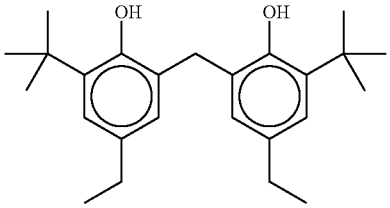
(Reducing agent-R3)
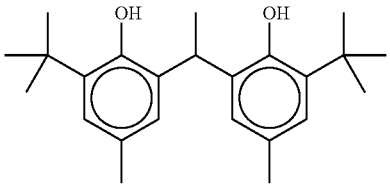
-continued
(Reducing agent-R4)
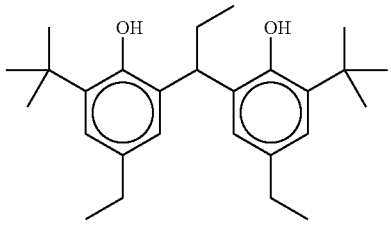
(Reducing agent-R5)
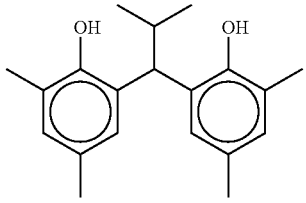
(Reducing agent-R6)
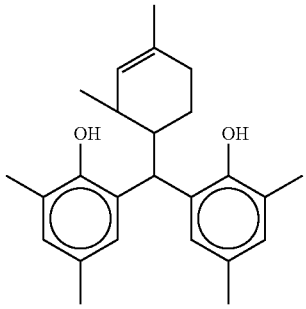
(Hydrogen bonding compound 1)
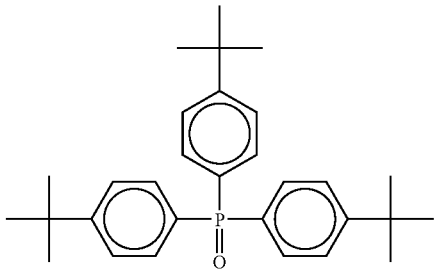
(Polyhalogen compound 1)
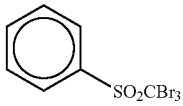
(Polyhalogen compound 2)
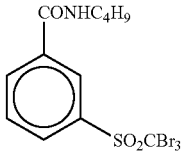
(Mercapto compound 1)
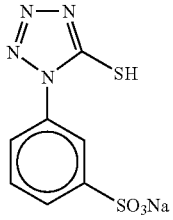

-continued (Mercapto compound 2)

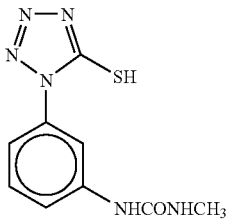

(Phthalazine compound 1)

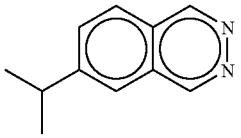

(Development accelerator 1)

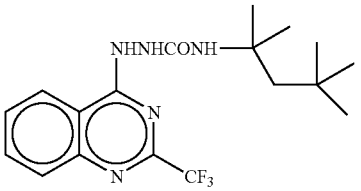

(Development accelerator 2)

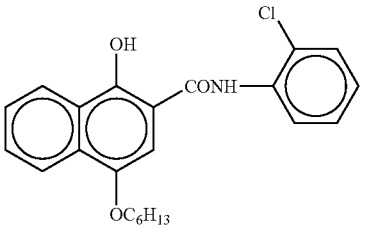

(Color tone controlling agent 1)

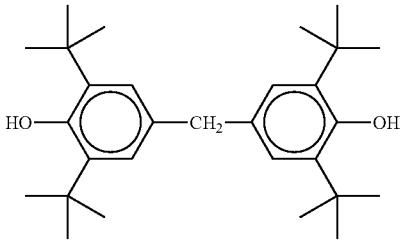

(F-1)

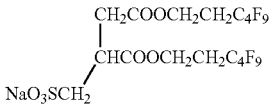

-continued (F-2)

Mixture of

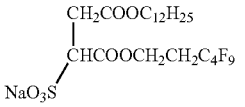

and

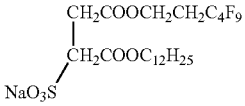

4. Evaluation of Photographic Performance

1) Preparation

The obtained samples were cut into a half size (length of 43 cm and a width of 35 cm), enclosed in the following packaging material under conditions of 25° C. and 50% RH, stored at the ordinary temperature for 2 weeks, and subjected to the following evaluation, respectively.

2) Packaging Material

Structure: (10-μm PET)-12-μm PE)-(9-μm aluminum foil)-(15-μm Ny)-(50-μm polyethylene including 3% by mass of carbon)

Oxygen permeability: 0.02 ml/atm·$m^2$·25° C.·day

Water permeability: 0.10 g/atm·$m^2$·25° C.·day

3) Exposure and Development

Each of the photothermographic materials 1 to 13 was exposed and heat-developed by Fuji Medical Dry Laser Imager DRYPIX 7000 equipped with a 660 nm semiconductor laser having the maximum output of 50 mW (IIIB). The material was heat-developed for 14 seconds using three panel heaters controlled at 107° C., 121° C., and 121° C. respectively. Thus-obtained image was evaluated by a densitometer.

4) Evaluation of Photographic Performance

<Measurement of Image Density (Dmax)>

Optical density of the obtained image was measured by a Macbeth densitometer, and a characteristic curve of optical density versus logarithm of exposure was determined. The image density of a part which had been exposed with the maximum exposure amount was considered as Dmax.

<Evaluation of Image Graininess>

Each sample was uniformly exposed with a Dry Laser Imager DRYPIX7000 so as to give an optical density of 1.0 and was subjected to heat development treatment. Graininess of the obtained sample was evaluated by visual inspection on a film viewer. The evaluated results were classified into three ranks of A, B and C. Rank A indicates that graininess was not remarkable and has excellent image quality; rank B indicates that graininess was slightly remarkable but image recognizability was secured; and rank C indicates that graininess was remarkable and image recognizability is impaired.

The evaluated results are shown in Table 1.

TABLE 1

| | Photosensitive layer | | | | | Non-photosensitive layer S | | | | | | | |
|---|---|---|---|---|---|---|---|---|---|---|---|---|---|
| | Coating liquid | | Organic acid silver salt | Reducing agent | | Coating liquid | | Organic acid silver salt | Reducing agent | | | | |
| Sample No. | No. | Coating amount | Content of behenic acid | Compound | Mixing ratio | No. | Coating amount | Content of behenic acid | Compound | Mixing ratio | Dmax | Graini-ness | Remarks |
| 1 | 1 | 100% | 96 mol % | R1/R2 | 30/70 | — | — | — | — | — | 3.51 | C | Comp. Ex. |
| 2 | 1 | 90% | 96 mol % | R1/R2 | 30/70 | 1 | 10% | 96 mol % | R1/R2 | 70/30 | 3.78 | B | Invention |
| 3 | 1 | 70% | 96 mol % | R1/R2 | 30/70 | 1 | 30% | 96 mol % | R1/R2 | 70/30 | 4.10 | A | Invention |
| 4 | 1 | 50% | 96 mol % | R1/R2 | 30/70 | 1 | 50% | 96 mol % | R1/R2 | 70/30 | 3.95 | A | Invention |
| 5 | 1 | 80% | 96 mol % | R1/R2 | 30/70 | 2 | 20% | 88 mol % | R1/R2 | 70/30 | 4.05 | A | Invention |
| 6 | 1 | 80% | 96 mol % | R1/R2 | 30/70 | 3 | 20% | 70 mol % | R1/R2 | 70/30 | 4.11 | B | Invention |
| 7 | 2 | 80% | 88 mol % | R1/R2 | 30/70 | 4 | 20% | 60 mol % | R1/R2 | 70/30 | 4.08 | B | Invention |
| 8 | 3 | 75% | 96 mol % | R2 | 100 | 5 | 25% | 88 mol % | R1 | 100 | 4.06 | A | Invention |
| 9 | 4 | 75% | 96 mol % | R4 | 100 | 6 | 25% | 88 mol % | R3 | 100 | 3.98 | A | Invention |
| 10 | 5 | 75% | 96 mol % | R5 | 100 | 5 | 25% | 88 mol % | R1 | 100 | 3.85 | A | Invention |
| 11 | 6 | 75% | 96 mol % | R6 | 100 | 5 | 25% | 88 mol % | R1 | 100 | 3.88 | A | Invention |
| 12 | 3 | 75% | 96 mol % | R2 | 100 | 7 | 25% | 88 mol % | R1/R2 | 50/50 | 4.02 | A | Invention |
| 13 | 7 | 75% | 96 mol % | R1/R2 | 50/50 | 5 | 25% | 88 mol % | R1 | 100 | 4.04 | A | Invention |

As shown in Table 1, when the non-photosensitive layer and the image-forming layer were provided adjacent to each other and both contained organic silver salt, the photothermographic material showed high image density and image quality with excellent graininess. In particular, the photothermographic materials showed better characteristics when the silver behenate content in a fatty acid silver salt of the non-photosensitive layer is lower than that of the image-forming layer.

Example 2

<<Preparation of Coating Liquid 8 for Non-photosensitive Layer S>>

Preparation of a coating liquid 8 for a non-photosensitive layer S was carried out in the same manner as the preparation of the coating liquid 1 for a non-photosensitive layer S except that the reducing agent was not added.

<<Preparation of Coating Liquid 9 for Non-photosensitive Layer S>>

Preparation of a coating liquid 9 for a non-photosensitive layer S was carried out in the same manner as the preparation of the coating liquid 1 for a non-photosensitive layer S except that 153 g of the dispersion of the reducing agent R1 was used instead of the combination of 107 g of the dispersion of the reducing agent R1 and 46 g of the dispersion of the reducing agent R2 (the mass ratio of R1/R2 is 70/30).

<<Preparation of Coating Liquids 10 to 12 each for non-photosensitive layer S>>

(i) Preparation of Dispersion of Nucleating Agent

Preparation of a dispersion of a nucleating agent was carried out in the same manner as in the preparation of the dispersion of the reducing agent in Example 1 except that the nucleating agent shown in Table 2 was used in place of the reducing agent and that the amount of water added was changed such that the concentration of the nucleating agent was 10 mass %.

(ii) Preparation of Coating Liquids 10 to 12 Each for Non-photosensitive Layer S Preparation of each of coating liquids 10 to 12 for a non-photosensitive layer S was carried out in the same manner as the preparation of the coating liquid 1 for a non-photosensitive layer S except that 153 g of one of the reducing agents R3 and R4 shown in Table 2 was used instead of the combination of 107 g of the dispersion of the reducing agent R1 and 46 g of the dispersion of the reducing agent R2 (the mass ratio of R1/R2 is 70/30), and that 30.6 g of the dispersion of the nucleating agent prepared above was added.

<<Preparation of Coating Liquid 13 for Non-photosensitive Layer S>>

Preparation of a coating liquid 13 for a non-photosensitive layer S was carried out in the same manner as the preparation of the coating liquid 1 for a non-photosensitive layer S except that 30.6 g of the dispersion of the nucleating agent prepared above was added.

<<Preparation of Coating Liquid 14 for Non-photosensitive Layer S>>

Preparation of a coating liquid 14 for a non-photosensitive layer S was carried out in the same manner as the preparation of the coating liquid 1 for a non-photosensitive layer S of Example 1 except that 153 g of the reducing agent R1 was used instead of the combination of 107 g of the dispersion of the reducing agent R1 and 46 g of the dispersion of the reducing agent R2 (the mass ratio of R1/R2 is 70/30), and that the dispersion of the organic polyhalogen compound 1 and the dispersion of the organic polyhalogen compound 2 were not added.

<<Preparation of Coating Liquids 15 to 17 Each for Non-photosensitive Layer S>>

Preparation of coating liquids 15 to 17 each for non-photosensitive layer S was carried out in the same manner as in the preparation of the coating liquid 1 for a non-photosensitive layer S of Example 1 except that 153 g of the reducing agent R1 was used instead of the combination of 107 g of the dispersion of the reducing agent R1 and 46 g of the dispersion of the reducing agent R2 (the mass ratio of R1/R2 is 70/30), and that the dispersion of the organic polyhalogen compound 1 was used in an amount of 6.4 g, 12.8 g and 25.6 g (respectively in the coating liquids 15 to 17, the amounts respectively corresponding to 10 mass %, 20 mass % and 40 mass % of the total amount of the polyhalogen compound added to the coating liquid 3 for the photosensitive layer) instead of 12.8 g in total of the dispersion of the organic polyhalogen compound 1 and the dispersion of the organic polyhalogen compound 2.

<<Preparation of Coating Liquid 18 for Non-photosensitive Layer S>>

Preparation of a coating liquid 18 for a non-photosensitive layer S was carried out in the same manner as the preparation of the coating liquid 1 for a non-photosensitive layer S of Example 1 except that 153 g of the reducing agent R1 was used instead of the combination of 107 g of the dispersion of the reducing agent R1 and 46 g of the dispersion of the reducing agent R2 (the mass ratio of R1/R2 is 70/30), and the dispersion of the organic polyhalogen compound 2 was used in an amount of 16 g (in an amount of 25 mass % based on the total amount of the polyhalogen compound added to the coating liquid 3 for a photosensitive layer) instead of 12.8 g in total of the dispersion of the organic polyhalogen compound 1 and the dispersion of the organic polyhalogen compound 2.

<<Production of Photothermographic Material 201>>

Photothermographic material 201 was produced in the same manner as the production of photothermographic material 1 of Example 1 except that the coating liquid 3 for a photosensitive layer was used in place of the coating liquid 1 for a photosensitive layer.

<<Production of Photothermographic Materials 202 to 212>>

Each of photothermographic materials 202 to 212 was produced in the same manner as the production of the photothermographic material 1 of Example 1 except that the coating liquid 3 for a photosensitive layer was used in place of the coating liquid 1 for a photosensitive layer, and that one of the coating liquids 8 to 18 for a non-photosensitive layer S shown in Tables 2 and 3 was coated, such that the ratio of the mass of the photosensitive layer to the mass of the non-photosensitive layer S was 70/30.

<<Evaluation>>

The obtained photothermographic materials 201 to 212 were evaluated in the same manner as in Example 1, and the results are shown in Tables 2 and 3.

TABLE 2

| | Photosensitive layer | | | | | Non-photosensitive layer S | | | | | | | | |
|---|---|---|---|---|---|---|---|---|---|---|---|---|---|---|
| | Coating liquid | | Organic acid silver salt Content of | Reducing agent | | Coating liquid | | Organic acid silver salt Content of | Reducing agent | | Nucleating | | | |
| Sample No. | No. | Coating amount | behenic acid | Compound | Mixing ratio | No. | Coating amount | behenic acid | Compound | Mixing ratio | agent Compound | Dmax | Graininess | Remarks |
| 201 | 3 | 100% | 96 mol % | R2 | 100 | — | — | — | — | — | — | 3.42 | C | Comp. Ex. |
| 202 | 3 | 70% | 96 mol % | R2 | 100 | 8 | 30% | 96 mol % | — | — | — | 3.68 | B | Invention |
| 203 | 3 | 70% | 96 mol % | R2 | 100 | 9 | 30% | 96 mol % | R1 | 100 | — | 3.95 | B | Invention |
| 204 | 3 | 70% | 96 mol % | R2 | 100 | 10 | 30% | 96 mol % | R3 | 100 | N-1 | 4.05 | B | Invention |
| 205 | 3 | 70% | 96 mol % | R2 | 100 | 11 | 30% | 96 mol % | R3 | 100 | N-2 | 4.11 | B | Invention |
| 206 | 3 | 70% | 96 mol % | R2 | 100 | 12 | 30% | 96 mol % | R4 | 100 | N-1 | 4.08 | B | Invention |
| 207 | 3 | 70% | 96 mol % | R2 | 100 | 13 | 30% | 96 mol % | R1/R2 | 70/30 | N-1 | 4.06 | A | Invention |

TABLE 3

| | Photosensitive layer | | | | | Non-photosensitive layer S | | | | | | | | | |
|---|---|---|---|---|---|---|---|---|---|---|---|---|---|---|---|
| | | | | | | | | | | | Polyhalogen compound | | | | |
| Sample No. | Coating liquid No. | Coating amount | Organic acid silver salt Content of behenic acid | Reducing agent Compound | Mixing ratio | Coating liquid No. | Coating amount | Organic acid silver salt Content of behenic acid | Reducing agent Compound | Mixing ratio | No. | Coating amount (based on amount of coating liquid 1 for photosensitive layer) | Dmax | Graininess | Remarks |
| 208 | 3 | 70% | 96 mol % | R2 | 100 | 14 | 30% | 96 mol % | R1 | 100 | — | — | 4.20 | C | Invention |
| 209 | 3 | 70% | 96 mol % | R2 | 100 | 15 | 30% | 96 mol % | R1 | 100 | 1 | 10% | 4.13 | B | Invention |
| 210 | 3 | 70% | 96 mol % | R2 | 100 | 16 | 30% | 96 mol % | R1 | 100 | 1 | 20% | 4.08 | A | Invention |
| 211 | 3 | 70% | 96 mol % | R2 | 100 | 17 | 30% | 96 mol % | R1 | 100 | 1 | 40% | 3.95 | A | Invention |
| 212 | 3 | 70% | 96 mol % | R2 | 100 | 18 | 30% | 96 mol % | R1 | 100 | 2 | 25% | 4.06 | A | Invention |

As shown in Table 2, photothermographic materials providing further improved image density and graininess were obtained when the non-photosensitive layer and the image-forming layer contained organic silver salt and the reducing agent represented by formula (I) and the nucleating agent were added to the non-photosensitive layer. As shown in Table 3, photothermographic materials with further improved graininess were obtained when the organic polyhalogen compound was added to the non-photosensitive layer.

Example 3

(Production of PET Support)

An undercoated support was produced in the same manner as the production of the PET support in Example 1 except that both surfaces of the support were coated with the undercoat coating liquid formulation (1) to have a wet coating amount of 6.6 ml/m$^2$ (per one surface) and the coating liquid was dried at 180° C. for 5 minutes instead of coating one surface of the support with the undercoat coating liquid formulation (1) and coating the other surface with the undercoat coating liquid formulations (2) and (3).

(Back Layer)

Although the photothermographic materials of Example 1 had back layers, photothermographic materials of Example 3 did not have back layers.

(Image-Forming Layer, Intermediate Layer and Surface Protective Layer)

1. Preparation of Materials for Coating

1) Silver Halide Emulsion

<<Preparation of Silver Halide Emulsion A>>

To 1421 ml of distilled water was added 4.3 ml of a 1 mass % solution of potassium bromide. Further, 3.5 ml of 0.5 mol/L sulfuric acid, 36.5 g of gelatin phthalide and 160 ml of a 5 mass % solution of 2,2'-(ethylenedithio)diethanol in methanol were added thereto. The mixture thus obtained was maintained at a temperature of 75° C. while stirred in a stainless reaction vessel. Then a solution A was prepared by diluting 22.22 g of silver nitrate with distilled water to give a total volume of 218 ml and another solution B was prepared by diluting 36.6 g of potassium iodide with distilled water to give a total volume of 366 ml. To the aforementioned mixture in the stainless steel reaction vessel, the entire solution A was added at a constant flow rate over 16 minutes, and the solution B was added by the controlled double jet method while maintaining the pAg at 10.2. Subsequently, 10 ml of a 3.5 mass % aqueous solution of hydrogen peroxide and 10.8 ml of a 10 mass % aqueous solution of benzoimidazole were successively added thereto. Moreover, a solution C was prepared by diluting 51.86 g of silver nitrate with distilled water to give a total volume of 508.2 ml and a solution D was prepared by diluting 63.9 g of potassium iodide with distilled water to give a total volume of 639 ml. To the resultant mixture, the entire solution C was added at a constant flow rate over 80 minutes, and the solution D was added by the controlled double jet method while maintaining the pAg at 10.2. 10 minutes after the initiation of the addition of the solution C and the solution D, potassium hexachloroiridate (III) was added at once in an amount of $1\times10^{-4}$ mole per mole of silver. 5 seconds after the completion of the addition of the solution C, a solution of iron (II) potassium hexacyanide was added at once in an amount of $3\times10^{-4}$ mole per mole of silver. Then the mixture was adjusted to pH 3.8 with the a 0.5 mol/L sulfuric acid. After stopping stirring, the mixture was subjected to precipitation, desalting, and washing with water. Next, the mixture was adjusted to pH 5.9 with a 1 mol/L sodium hydroxide, thereby obtaining a silver halide dispersion with a pAg of 11.0.

The silver halide emulsion A thus prepared was a pure silver iodide emulsion. In the silver iodide emulsion, tabular grains having an average diameter of 0.93 μm of projected area, a variation coefficient of the average diameter of the projected area of 17.7%, an average thickness of 0.057 μm, and an average aspect ratio of 16.3, occupied 80% or more of the total projected area. The equivalent-sphere diameter of the grains was 0.42 μm. X-ray powder diffraction analysis showed that 90% or more of silver iodide existed in a γ phase.

<<Preparation of Silver Halide Emulsion B>>

1 mol of the tabular AgI grain emulsion prepared in the preparation of the silver halide emulsion A was placed in a reaction vessel, so that the pAg was 10.2 at 38° C. Subsequently, a 0.5 mol/L KBr solution and a 0.5 mol/L $AgNO_3$ solution were added at a rate of 10 ml/min over 20 minutes by a controlled double jet method to substantially epitaxially deposit 10 mol % of silver bromide on the AgI host emulsion. In the operation, pAg was maintained at 10.2. Further, the mixture was adjusted to pH 3.8 with a 0.5 mol/L sulfuric acid. After stopping stirring, the mixture was subjected to precipitation, desalting, and washing with water. Next, the mixture was adjusted to pH 5.9 with a 1 mol/L sodium hydroxide, thereby obtaining a silver halide dispersion with a pAg of 11.0.

The above described silver halide dispersion was maintained at 38° C. under stirring and 5 ml of a 0.34 mass % solution of 1,2-benzoisothiazolin-3-one in methanol was added thereto. After 40 minutes, the mixture was heated to 47° C. 20 minutes after heating, a solution of sodium benzenethiosulfonate in methanol was added in an amount of $7.6\times10^{-5}$ mole per mole of silver. 5 minutes thereafter, a solution of the tellurium sensitizer C in methanol was added in an amount of $2.9\times10^{-5}$ mole per mole of silver and the resultant mixture was aged for 91 minutes. Subsequently, 1.3 ml of a 0.8 mass % solution of N,N'-dihydroxy-N"-diethylmelamine in methanol was added. After 4 minutes, a solution of 5-methyl-2-mercaptobenzoimidazole in methanol in an amount of $4.8\times10^{-3}$ mole per mole of silver, a solution of 1-phenyl-2-heptyl-5-mercapto-1,3,4-triazole in methanol in an amount of $5.4\times10^{-3}$ mole per mole of silver and an aqueous solution of 1-(3-methylureidophenyl)-5-mercaptotetrazole in an amount of $8.5\times10^{-3}$ mole per mole of silver were added thereto to give a silver halide emulsion B.

<<Preparation of Silver Halide Emulsion C>>

A silver halide emulsion C was prepared in the same manner as the preparation of the silver halide emulsion A, except for changing the amount of a 5 mass % solution of 2,2'-(ethylenedithio)diethanol in methanol to be added, the temperature at grain formation, and the time required for adding the solution A. The silver halide emulsion C thus prepared was a pure silver iodide emulsion. In the silver halide emulsion C, tabular grains having an average diameter of 1.369 μm of projected area, a variation coefficient of the average diameter of the projected area of 19.7%, an average thickness of 0.130 μm, and an average aspect ratio of 11.1, occupied 80% or more of the total projected area. The equivalent-sphere diameter of the grains was 0.71 μm.

X-ray powder diffraction analysis showed that 90% or more of silver iodide existed in a γ phase.

<<Preparation of Silver Halide Emulsion D>>

A silver halide emulsion D having 10 mol % of silver bromide epitaxial was prepared in the same manner as the preparation of the silver halide emulsion B except that the silver halide emulsion C was used in place of the silver halide emulsion A.

<<Preparation of Mixed Emulsion for Coating liquid>>

The silver halide emulsion B and the silver halide emulsion D were mixed such that the ratio of the amount of the silver halide emulsion B to the amount of the silver halide emulsion D was 5/1 in terms of silver amount by mol. A 1 mass % aqueous solution of benzothiazolium iodide was added thereto in an amount of $7\times10^{-3}$ mole per mole of silver.

Further, compounds 1, 2 and 3 whose 1-electron oxidized forms are each capable of releasing 1 or more electrons, were added thereto respectively in an amount of $2\times10^{-3}$ mole per mole of silver of silver halide.

In addition, compounds 1 and 2 each having an adsorbent group and a reducing group were added thereto respectively in an amount of $8\times10^{-3}$ mole per mole of silver of silver halide.

Further, water was added thereto to give a silver halide content (in terms of silver content) of 15.6 g per liter of the mixed emulsion for a coating liquid.

<<Preparation of Other Additives>>

Other additives contained in the image-forming layer, the immediate layer and the surface protective layer were prepared in the same manner as in Example 1.

2. Preparation of Coating Liquid

1) Preparation of Coating Liquid for Photosensitive Layer

<<Preparation of Coating liquid 301 for Photosensitive Layer>>

To a mixture of 1000 g of the fatty acid silver salt dispersion B of Example 1 and 276 ml of water, the dispersion of the organic polyhalogen compound 1, the dispersion of the organic polyhalogen compound 2, the SBR latex (Tg: 17° C.), the dispersion of the reducing agent R1, the dispersion of the reducing agent R2 (the mass ratio of the reducing agents R1/the reducing agent R2 is 30/70), the dispersion of the hydrogen bonding compound 1, the dispersion of the development accelerator 1, the dispersion of the development accelerator 2, the dispersion of the color tone controlling agent 1, the aqueous solution of the mercapto compound 1 and the aqueous solution of the mercapto compound 2 were successively added, and a silver iodide complex-forming agent was further added. Then, immediately before coating, the mixed emulsion for a silver halide coating liquid was added thereto in an amount of 0.22 mol (in terms of silver amount) per mol of fatty acid silver salt, followed by sufficiently mixing. The thus obtained coating liquid for photosensitive layer was fed to a coating die and then coated.

The coating liquid for a photosensitive layer had a viscosity of 25 mPa.s, measured by a B-type viscometer available from Tokyo Keiki Co,. Ltd. at 40° C. (No. 1 rotor, 60 rpm).

The viscosity of the coating liquid for a photosensitive layer, obtained by RFS fluid spectrometer manufactured by Rheometrics Far East at 25° C., was 242, 65, 48, 26, and 20 [mPa.s] at a shear rate of 0.1, 1, 10, 100, and 1000 [1/second], respectively.

The zirconium content of the coating liquid for a photosensitive layer was 0.52 mg per 1 g of silver.

<<Preparation of Coating Liquid 301 for Non-Photosensitive Layer S>>

Preparation of a coating liquid 301 for a non-photosensitive layer S was carried out in the same manner as the preparation of the coating liquid 301 for a photosensitive layer except that the amount of the dispersion of the organic polyhalogen compound 1 and the dispersion of the organic polyhalogen compound 2 were reduced to 20 mass % of the respective amounts thereof in the coating liquid 301 for a photosensitive layer, and that the mass ratio of the reducing agents R1 to the reducing agent R2 was changed from 30/70 to 70/30, and that the mixed emulsion for a silver halide coating liquid was not added.

<<Preparation of Coating Liquid 302 for a Non-photosensitive Layer S>>

Preparation of a coating liquid 302 for a non-photosensitive layer S was carried out in the same manner as the preparation of the coating liquid 301 for a non-photosensitive Layer S except that 30.6 g of the dispersion of the nucleating agent prepared in Example 1 was added.

2) Preparation of Coating Liquid for Intermediate Layer

<<Preparation of Coating Liquid 2 for Intermediate Layer>>

To a mixture of 1000 g of polyvinyl alcohol PVA-205 (manufactured by Kuraray Co., Ltd.) and 4200 ml of a 19 mass % latex solution of a methyl methacrylatetyrene-butyl acrylate-hydroxyethyl methacrylateacrylic acid copolymer (copolymerization weight ratio: 64/9/20/5/2) were added 27 ml of a 5 mass % aqueous solution of AEROSOL OT (manufactured by American Cyanamid), 135 ml of a 20 mass % aqueous solution of diammonium phthalate and water in such an amount as giving a total amount of 10000 g. Then the resultant mixture was adjusted to pH 7.5 with NaOH to give a coating liquid for an intermediate layer. Next, it was fed into a coating die to give a dose of 9.1 $ml/m^2$.

The coating liquid 1 had a viscosity of 58 mPa.s, measured by a B-type viscometer at 40° C. (No. 1 rotor, 60 rpm).

3) Preparation of Coating Liquid 2 for First Layer of Surface Protective Layer 64 g of inert gelatin was dissolved in water. Then, 112 g of a 19 mass % latex solution of a methyl methacrylate-styrenebutyl acrylate-hydroxyethyl methacrylate-acrylic acid copolymer (copolymerization weight ratio: 64/9/20/5/2), 30 ml of a 15 mass % solution of phthalic acid in methanol, 23 ml of a 10 mass % aqueous solution of 4-methylphthalic acid, 28 ml of a 0.5 mol/L sulfuric acid, 5 ml of a 5 mass % aqueous solution of AEROSOL OT (manufactured by American Cyanamid), 0.5 g of phenoxy ethanol and 0.1 g of benzoisothiazolinone were added thereto. Then, water was further added thereto to give a total amount of 750 g, thus giving a coating liquid. Immediately before coating, 26 ml of 4 mass % chrome alum was mixed with the coating liquid by a static mixer and the resultant mixture was fed to a coating die to give a dose of 18.6 $ml/m^2$.

The coating liquid had a viscosity of 20 [mPa.s] at 40° C., measured by a B-type viscometer (No. 1 rotor, 60 rpm).

4) Preparation of Coating Liquid 2 for Second Layer of Surface Protective Layer 80 g of inert gelatin was dissolved in water. Then, 102 g of a 27.5 mass % latex solution of a methyl methacrylate-styrenebutyl acrylate-hydroxyethyl methacrylateacrylic acid copolymer (copolymerization weight ratio: 64/9/20/5/2), 5.4 ml of a 2 mass % solution of the fluorine-based surfactant (F-1), 5.4 ml of a 2 mass % aqueous solution of the fluorine-based surfactant (F-2), 23 ml of a 5 mass % solution of AEROSOL OT (manufactured by American Cyanamid), 4 g of polymethyl methacrylate particles (average particle size: 0.7 μm, the average particle size corresponding to 30% point on the cumulative volume-weighted size distribution), 21 g of fine polymethyl methacrylate particles (average particle size: 3.6 μm, the average particle size corresponding to 60% point on the cumulative volume-weighted size distribution), 1.6 g of 4-methylphthalic acid, 4.8 g of phthalic acid, 44 ml of 0.5 mol/L sulfuric acid, 10 mg of benzoisothiazolinone and water in such an amount as giving a total amount of 650 g were added thereto. Immediately before coating, 445 ml of an aqueous solution containing 4 mass % chrome alum and 0.67 mass % of phthalic acid was mixed with the above mixture by a static mixer to give a coating liquid for a surface protective layer. The obtained coating liquid was fed to a coating die to give a dose of 8.3 ml/m$^2$.

The coating liquid had a viscosity of 19 [mPa.s] at 40° C., measured by a B-type viscometer (No. 1 rotor, 60 rpm).

3. Production of Photothermographic Material

1) Production of Photothermographic Material 301

Immediately before coating, the mixed emulsion for a silver halide coating liquid was added to the coating liquid 301 for a photosensitive layer in an amount of 0.22 mol (in terms of silver amount) per mol of fatty acid silver salt, followed by mixing sufficiently, as described above. On one side (Side A), the coating liquid 301 for a photosensitive layer, the coating liquid 2 for an intermediate layer, the coating liquid 2 for a first layer of a surface protective layer and the coating liquid 2 for a second layer of a surface protective layer are coated in this order from the undercoated surface in a simultaneous multi-layer coating manner using a slide bead coating method. In the coating, the coating liquids respectively for a photosensitive layer and for a intermediate layer were controlled at 31° C., while the coating liquid for a first layer of a surface protective layer and the coating liquid for a second layer of a surface protective layer were controlled at 36° C. and 37° C., respectively. The amount of coated silver of the photosensitive layer was 0.821 g/m$^2$ per one side in terms of the total amount of fatty acid silver salt and silver halide.

On the other side (Surface B), the coating liquid 301 for a photosensitive layer, the coating liquid 2 for an intermediate layer, the coating liquid 2 for a first layer of a surface protective layer and a coating liquid 2 for a second layer of a surface protective layer were coated in this order from the undercoated surface in a simultaneous multi-layer coating manner using a slide bead coating method.

The coating amount (g/m$^2$) per one surface of each compound contained in the photosensitive layer was as follows.

| | |
|---|---|
| Fatty acid silver salt | 2.80 |
| Polyhalogen compound 1 | 0.028 |
| Polyhalogen compound 2 | 0.094 |
| Silver iodide complex-forming agent | 0.46 |
| SBR latex | 5.20 |
| Reducing agent R1 | 0.33 |
| Reducing agent R2 | 0.13 |
| Hydrogen bonding compound 1 | 0.15 |
| Development accelerator 1 | 0.005 |
| Development accelerator 2 | 0.035 |
| Color tone controlling agent 1 | 0.002 |
| Mercapto compound 1 | 0.001 |
| Mercapto compound 2 | 0.003 |
| Silver halide (in terms of Ag amount) | 0.146 |

The coating and drying were carried out under the following conditions.

The coating was carried out at the rate of 160 m/min. The distance between the support and the tip of the coating die was 0.10 to 0.30 mm. The inner pressure of the decompression chamber was 196 to 882 Pa-lower than the atmospheric pressure. The support was subjected to electrical neutralization by an ionic wind before the application.

The coating liquid was cooled by a wind having a dry-bulb temperature of 10 to 20° C. in the chilling zone. Then the coating liquid was contactless-transported and dried by a helical type contactless drying apparatus using a drying wind having the dry-bulb temperature of 23 to 45° C. and the wet-bulb temperature of 15 to 21° C.

After the drying, the moisture content was controlled by leaving the photothermographic material in a condition of 25° C., 40 to 60% RH. Then, the dried layer was heated to 70 to 90° C. and cooled to 25° C.

2) Production of Photothermographic Materials 302 and 303

Each of photothermographic materials 302 and 303 were produced in the same manner as the preparation of the photothermographic material 301 except that the amount of the coating liquid 301 for a photosensitive layer was changed and that a coating liquid 301 or 302 for a non-photosensitive layer S was further coated. The ratio of the amount of the coating liquid for a photosensitive layer to the amount of the coating liquid for a non-photosensitive layer S was 70 mass %: 30 mass %. The amounts of coating liquids for photosensitive layers and amounts of coating liquids for non-photosensitive layers S shown in Table 4 are based on the amount of the coating liquid for a photosensitive layer in the photothermographic material 301. In addition, the amount of the added mixed emulsion for coating liquid was adjusted to give the coating amount of silver halide which is the same amount as that in the photothermographic material 301.

The coating amount (g/m$^2$) per one surface of each compound contained in total of the photosensitive layers and the non-photosensitive layer S was as follows.

| | |
|---|---|
| Fatty acid silver salt | 2.80 |
| Polyhalogen compound 1 | 0.02128 |
| Polyhalogen compound 2 | 0.07144 |
| Silver iodide complex-forming agent | 0.46 |
| SBR latex | 5.20 |
| Reducing agent R1 | 0.33 |
| Reducing agent R2 | 0.13 |
| Hydrogen bonding compound 1 | 0.15 |
| Development accelerator 1 | 0.005 |
| Development accelerator 2 | 0.035 |
| Color tone controlling 1 | 0.002 |
| Mercapto compound 1 | 0.001 |
| Mercapto compound 2 | 0.003 |
| Silver halide (as Ag) | 0.146 |

4. Evaluation of Photographic Performance

The obtained samples were cut into a half size (length of 43 cm and a width of 35 cm), enclosed in the following packaging material under conditions of 25° C. and 50% RH, stored at the ordinary temperature for 2 weeks, and subjected to the following evaluation, respectively.

(Packaging Material)

Structure: (10-μm PE)-(12-μm PE)-(9-μm aluminum foil)-(15-μm Ny)-(50-μm polyethylene including 3% by mass of carbon)

Oxygen permeability: 0.02 ml/atm·$m^2$·25° C.·day

Water permeability: 0.10 g/atm·$m^2$·25° C.·day

The coated both-sided photosensitive material thus prepared was evaluated as follows.

An assembly for image formation was produced by sandwiching the sample between two sheets of X-ray regular screen HI-SCREEN B3 (including $CaWO_4$ as phosphor, emission peak wavelength 425 nm) manufactured by Fuji Photo Film Co., Ltd. The assembly was subjected to X-ray sensitometry by being exposed to X-ray radiation for 0.05 sec. The X-ray instrument used for the sensitometry was an X-ray generating apparatus (trade name: DRX-3724HD, manufactured by Toshiba Corporation) equipped with a tungsten target. The X-ray generating apparatus was activated by a voltage of 80 kVp generated by a three-phase pulse generator, to emit X-rays. The emitted X-rays, which had been allowed to pass a water filter with a thickness of 7 cm whose X-ray absorption is equivalent to the absorption by a human body, was used for the exposure. The assembly was exposed to X-rays at such a distance from the X-ray source as to give an optical density of 1.2. After the exposure, the assembly was subjected to heat development under the following heat development conditions. Then, the obtained images were evaluated with a densitometer.

Screen exposed photothermographic materials 301 to 303 were developed for 24 seconds by a Dry Laser Imager FM-DP-L (manufactured by FujiFilm Medical Co., Ltd) while turning off the laser output. Then, the heat development section of FM-DP-L was changed to a drum-type heat development section and the materials were further developed at 116° C. for 24 seconds. The drum-type heat development section had a drum diameter of 320 mm and the drum surface contacting with a film was coated with fluorine-containing rubber having a thickness of 0.5 mm, and the transporting roller was a stainless roller having a diameter of 12 mm.

Further, the heat development section was changed to a heat development section comprising a Chidori-type heat roller and then the materials were further developed at 123° C. for 24 seconds. The Chidori-type heat roller was a roller in which a metallic roller made of stainless steel and having a diameter of 12 mm was coated with fluorine-containing rubber with a thickness of 0.5 mm.

Evaluation of photographic performance was carried out in the same manner as in Example 1 and the results are shown in Table 4.

As shown in Table 4, a photothermographic material enabling high image density and superior graininess was obtained when the non-photosensitive layer and the image-forming layer were provided adjacent to each other and both layers contained organic silver salt, also in the case of a double-sided photothermographic material having image-forming layers on both sides of the support.

What is claimed is:

1. A photothermographic material comprising a support, and an image-forming layer and a non-photosensitive layer provided on a surface of the support, wherein the image-forming layer and the non-photosensitive layer are adjacent to each other;

the image-forming layer includes a photosensitive silver halide, a first non-photosensitive organic silver salt, a first reducing agent, a polyhalogen compound and a binder; and the non-photosensitive layer includes a second non-photosensitive organic silver salt and a second reducing agent, so as to form an image on the non-photosensitive layer.

2. A photothermo graphic material comprising a support, and an image-forming layer and a non-photosensitive layer provided on a surface of the support, wherein the image-forming layer and the non-photosensitive layer are adjacent to each other;

the image-forming layer includes a photosensitive silver halide, a first non-photosensitive organic silver salt, a first reducing agent, a polyhalogen compound and a binder;

the non-photosensitive layer includes a second non-photosensitive organic silver salt and a second reducing agent; and the second reducing agent is a reducing agent represented by formula (I) having a nucleating activity, so as to form an image on the non-photosensitive layer:

Formula (I)

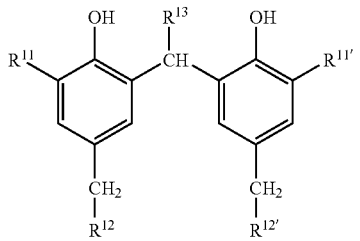

wherein in formula (1), $R^{11}$ and $R^{11'}$ each independently represent a secondary or tertiary alkyl group having 3 to 20 carbon atoms; $R^{12}$ and $R^{12'}$ each independently represent a hydrogen atom, or a group in which an atom

TABLE 4

| | Photosensitive layer | | | | | Non-photosensitive layer S | | | | | | | | |
|---|---|---|---|---|---|---|---|---|---|---|---|---|---|---|
| | Coating liquid | | Organic acid silver salt Content of | Reducing agent | | Coating liquid | | Organic acid silver salt Content of | Reducing agent | | Nucleating | | | |
| Sample No. | No. | Coating amount | behenic acid | Com-pound | Mixing ratio | No. | Coating amount | behenic acid | Com-pound | Mixing ratio | agent Compound | Dmax | Graini-ness | Remarks |
| 301 | 301 | 100% | 96 mol % | R1/R2 | 30/70 | — | — | — | — | — | — | 2.1 | C | Comp. Ex. |
| 302 | 301 | 70% | 96 mol % | R1/R2 | 30/70 | 301 | 30% | 96 mol % | R1/R2 | 70/30 | — | 3.2 | B | Invention |
| 303 | 301 | 70% | 96 mol % | R1/R2 | 30/70 | 302 | 30% | 96 mol % | R1/R2 | 70/30 | N-1 | 3.2 | B | Invention |

bonded to the $CH_2$ group on the benzene ring is selected from the group consisting of a nitrogen atom, an oxygen atom, a phosphorus atom and a sulfur atom; and $R^{13}$ represents a hydrogen atom or an alkyl group having 1 to 20 carbon atoms.

3. A photothermographic material comprising a support, and an image-forming layer and a non-photosensitive layer provided on a surface of the support, wherein the image-forming layer and the non-photosensitive layer are adjacent to each other;

the image-forming layer includes a photosensitive silver halide, a first non-photosensitive organic silver salt, a first reducing agent, a polyhalogen compound and a binder; and the non-photosensitive layer includes a second non-photosensitive organic silver salt, a second reducing agent, and a nucleating agent, so as to form an image on the non-photosensitive layer.

4. The photothermographic material of claim 1, wherein the first reducing agent and the second reducing agent are different from each other, second reducing agent is a reducing agent represented by formula (I), and the first reducing agent is a reducing agent represented by formula (II):

Formula (I)

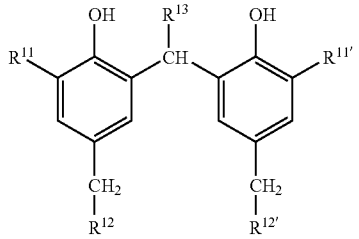

wherein in formula (1), $R^{11}$ and $R^{11'}$ each independently represent a secondary or tertiary alkyl group having 3 to 20 carbon atoms; $R^{12}$ and $R^{12'}$ each independently represent a hydrogen atom, or a group in which an atom bonded to the $CH_2$ group on the benzene ring is selected from the group consisting of a nitrogen atom, an oxygen atom, a phosphorus atom and a sulfur atom; and $R^{13}$ represents a hydrogen atom or an alkyl group having 1 to 20 carbon atoms, Formula (II)

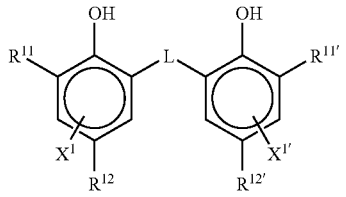

wherein in formula (2), $R^{11}$ and $R^{11'}$ each independently represent an alkyl group having 1 to 20 carbon atoms; $R^{12}$ and $R^{12'}$ each independently represent a hydrogen atom or a substituent which can be bonded to the benzene ring; L represents a —S— group or a —$CHR^{13}$— group and $R^{13}$ represents a hydrogen atom or an alkyl group having 1 to 20 carbon atoms; and $X^1$ and $X^{1'}$ each independently represent a hydrogen atom or a substituent which can be bonded to the benzene ring.

5. The photothermographic material of claim 1, wherein the first non-photosensitive organic silver salt has a silver behenate content which is higher than a silver behenate content of the second non-photosensitive organic silver salt.

6. The photothermographic material of claim 2, wherein the first non-photosensitive organic silver salt has a silver behenate content which is higher than a silver behenate content of the second non-photosensitive organic silver salt.

7. The photothermographic material of claim 1, wherein the photosensitive silver halide has a content of silver iodide in a range of 40 mol % to 100 mol %.

8. The photothermographic material of claim 1, wherein the non-photosensitive layer further includes a binder which has a proportion of hydrophobic polymers of 50 mass % or higher.

9. The photothermographic material of claim 3, wherein the photosensitive silver halide has a content of silver iodide in a range of 40 mol % to 100 mol %.

10. The photothermographic material of claim 1, wherein a ratio of an amount of the first organic silver salt to an amount of the second organic silver salt is within a range of 80:20 to 60:40.

11. The photothermographic material of claim 3, wherein the second reducing agent contained in the non-photosensitive layer is represented by formula (R):

Formula (R)

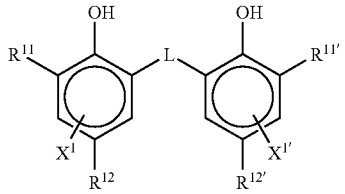

wherein in formula (R), $R^{11}$ and $R^{11'}$ each independently represent an alkyl group having 1 to 20 carbon atoms; $R^{12}$ and $R^{12'}$ each independently represent a hydrogen atom or a substituent which can be bonded to the benzene ring; L represents an —S— group or a —$CHR^{13}$— group, and $R^{13}$ represents a hydrogen atom or an alkyl group having 1 to 20 carbon atoms; $X^1$ and $X^{1'}$ each independently represent a hydrogen atom or a substituent which can be bonded to the benzene ring.

12. The photothermographic material of claim 3, wherein the first reducing agent and the second reducing agent are different from each other, second reducing agent is a reducing agent represented by formula (I), and the first reducing agent is a reducing agent represented by formula (II):

Formula (I)

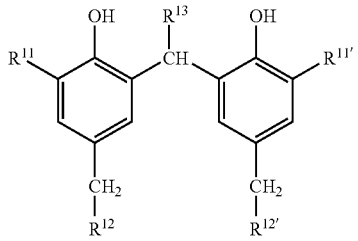

wherein in formula (1), $R^{11}$ and $R^{11'}$ each independently represent a secondary or tertiary alkyl group having 3 to 20 carbon atoms; $R^{12}$ and $R^{12'}$ each independently represent a hydrogen atom, or a group in which an atom bonded to the $CH_2$ group on the benzene ring is selected from the group consisting of a nitrogen atom, an oxygen atom, a phosphorus atom and a sulfur atom; and $R^{13}$ represents a hydrogen atom or an alkyl group having 1 to 20 carbon atoms, Formula (II)

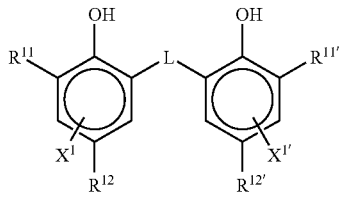

wherein in formula (2), $R^{11}$ and $R^{11'}$ each independently represent an alkyl group having 1 to 20 carbon atoms; $R^{12}$ and $R^{12'}$ each independently represent a hydrogen atom or a substituent which can be bonded to the benzene ring; L represents a —S— group or a —$CHR^{13}$— group and $R^{13}$ represents a hydrogen atom or an alkyl group having 1 to 20 carbon atoms; and $X^1$ and $X^{1'}$ each independently represent a hydrogen atom or a substituent which can be bonded to the benzene ring.

13. The photothermographic material of claim 3, wherein the first non-photosensitive organic silver salt has a silver behenate content which is higher than a silver behenate content of the second non-photosensitive organic silver salt.

14. The photothermographic material of claim 1, wherein the non-photosensitive layer further includes a development accelerator.

15. The photothermographic material of claim 3, wherein the non-photosensitive layer further includes a development accelerator.

16. The photothermographic material of claim 2, wherein the non-photosensitive layer further includes a binder which has a proportion of hydrophobic polymers of 50 mass % or higher.

17. The photothermographic material of claim 3, wherein the non-photosensitive layer further includes a binder which has a proportion of hydrophobic polymers of 50 mass % or higher.

18. The photothermographic material of claim 2, wherein the photosensitive silver halide has a content of silver iodide in a range of 40 mol % to 100 mol %.

19. The photothermographic material of claim 2, wherein a ratio of an amount of the first organic silver salt to an amount of the second organic silver salt is within a range of 80:20 to 60:40.

20. The photothermographic material of claim 3, wherein a ratio of an amount of the first organic silver salt to an amount of the second organic silver salt is within a range of 80:20 to 60:40.

* * * * *